US012060756B2

(12) United States Patent
Petrella et al.

(10) Patent No.: US 12,060,756 B2
(45) Date of Patent: Aug. 13, 2024

(54) COUPLED DOWNHOLE SHIFTING AND TREATMENT TOOLS AND METHODOLOGY FOR COMPLETION AND PRODUCTION OPERATIONS

(71) Applicant: KOBOLD CORPORATION, Calgary (CA)

(72) Inventors: Allan Petrella, Calgary (CA); Mark Andreychuk, Calgary (CA); Per Angman, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 140 days.

(21) Appl. No.: 17/099,014

(22) Filed: Nov. 16, 2020

(65) Prior Publication Data

US 2021/0148179 A1 May 20, 2021

Related U.S. Application Data

(60) Provisional application No. 62/936,262, filed on Nov. 15, 2019.

(51) Int. Cl.

| | |
|---|---|
| ***E21B 23/04*** | (2006.01) |
| ***E21B 33/127*** | (2006.01) |
| ***E21B 34/08*** | (2006.01) |
| ***E21B 34/14*** | (2006.01) |

(52) U.S. Cl.

CPC ..... *E21B 23/0413* (2020.05); *E21B 33/1277* (2013.01); *E21B 34/08* (2013.01); *E21B 34/142* (2020.05)

(58) Field of Classification Search

CPC .. E21B 23/0006; E21B 23/0413; E21B 33/00; E21B 33/1277; E21B 34/14; E21B 34/08; E21B 34/142; E21B 2200/06

See application file for complete search history.

(56) References Cited

U.S. PATENT DOCUMENTS

| | | | | |
|---|---|---|---|---|
| 5,156,210 | A * | 10/1992 | Roth | E21B 34/14 166/374 |
| 5,271,461 | A | 12/1993 | Decker et al. | |
| 5,513,703 | A | 5/1996 | Mills et al. | |
| 5,813,456 | A | 9/1998 | Milner et al. | |
| 10,472,928 | B2 * | 11/2019 | Andreychuk | E21B 23/006 |

(Continued)

*Primary Examiner* — Kristyn A Hall
(74) *Attorney, Agent, or Firm* — Parlee McLaws LLP

(57) ABSTRACT

A bottomhole assembly (BHA) located on a conveyance string for actuating downhole tools in a wellbore, such as sleeve valves. The bottomhole assembly has a shifting tool that is capable of being hydraulically actuated independently of a mechanically actuated treatment tool also located on the BHA. The shifting tool has hydraulically actuated shifting dogs for engaging with the sleeve valves, and a shifting-assist mechanism for applying a downhole force on the BHA. The treatment tool is mechanically actuated via manipulation of the conveyance string to isolate the wellbore, for example to treat a formation through an opened sleeve valve. A hydraulically cycled flow control valve can be located on the BHA for more convenient control of the fluid flow and pressure in the BHA. The BHA can also have a repositioning mechanism for positioning the shifting tool downhole of an opened sleeve valve without requiring repositioning of the entire BHA.

22 Claims, 42 Drawing Sheets

(56) References Cited

U.S. PATENT DOCUMENTS

| | | | | |
|---|---|---|---|---|
| 2013/0299200 | A1* | 11/2013 | Hughes | E21B 33/124 166/321 |
| 2017/0058644 | A1* | 3/2017 | Andreychuk | E21B 34/14 |
| 2020/0024916 | A1 | 1/2020 | Andreychuk et al. | |
| 2021/0002980 | A1 | 1/2021 | Shpak et al. | |

* cited by examiner

OPEN - FRAC - CLOSE
PULL UP TO LOCATE - TP PUMP ON
PUSH DOWN TO SHIFT OPEN - TP PUMP ON
PUSH DOWN TO SET FRACTURING TOOL - TP PUMP OFF - PUMP ANNULAR FRAC
COIL
DIS
JET
CONN
SUB
ANNULAR FRAC

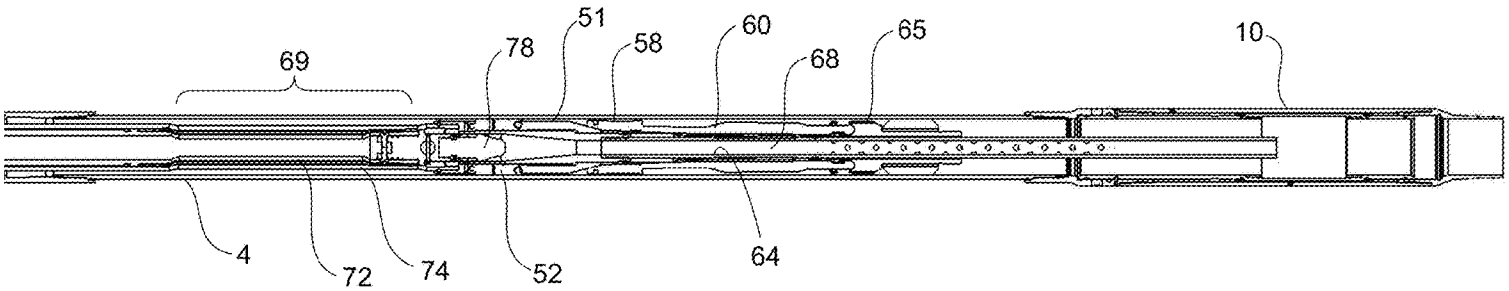
Fig. 5A
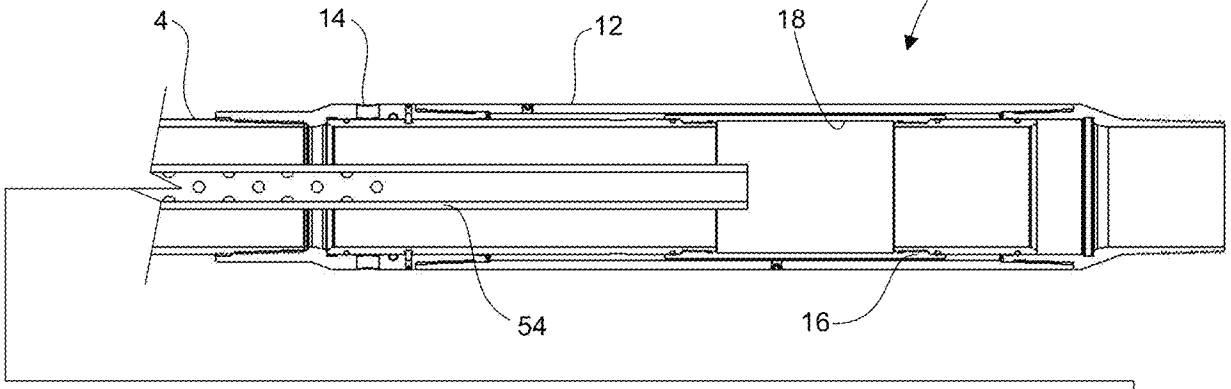
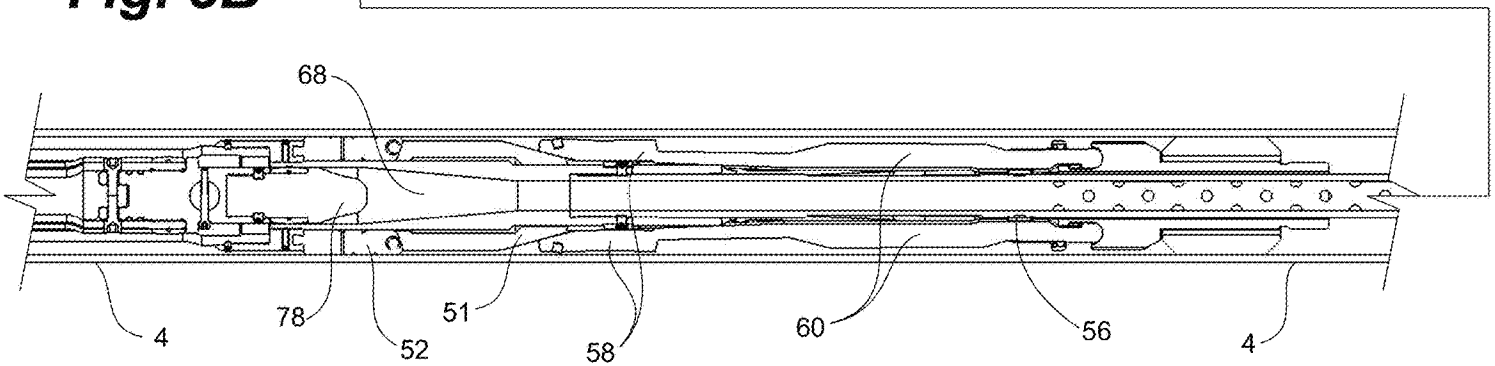
Fig. 5B

| | TP Pump (m3/min) | Frac Pump (m3/min) | CT Move | Hydraulic jay (fluid exit) | Hyd Dogs | Shifting Packer | Selector Valve | Treat tool Mode | | Figure |
|---|---|---|---|---|---|---|---|---|---|---|
| RIH | 0-1.0 | 0-2.0 | push | circ | in | deflated | collapsed | RIH | | 12A |
| Hyd Jay Cycle | go to 0.300 (500psi) confirm flow through mode, if not cycle TP pump | | | | | | | | | 12B |
| Pull to Loc | 0.300 | off | pull up | flow through | out | | extended | POOH | flush in front of dogs | |
| Lock Dogs | 0.425 (1000psi) to hold dogs | | | | | inflated | | | | 12C |
| Open Down | | on/off | push | | | | -3" | SET | | 12D |
| Release Dogs | off | off | stopped | circ | in | deflated | collapsing | | | 12E |
| Move Down 5' | | | push | | | | | | | 12E |
| Set Packer | | | | | | | btm out | final set | | 12F |
| Pump Frac | 0.100 | 0-9.0 | circ optional hi rate | | | | | | | 12F |
| Leave sleeve open and move to next sleeve | | | | | | | | | flush in front of dogs | |
| | 0.100 | off | pull up | | | | extend | POOH | | 12G |

FIG. 11

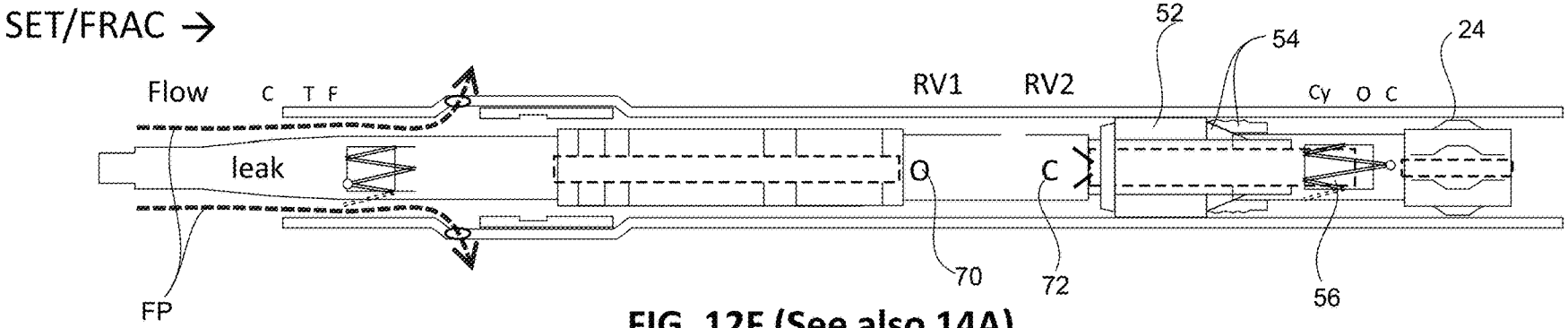
FIG. 12F (See also 14A)
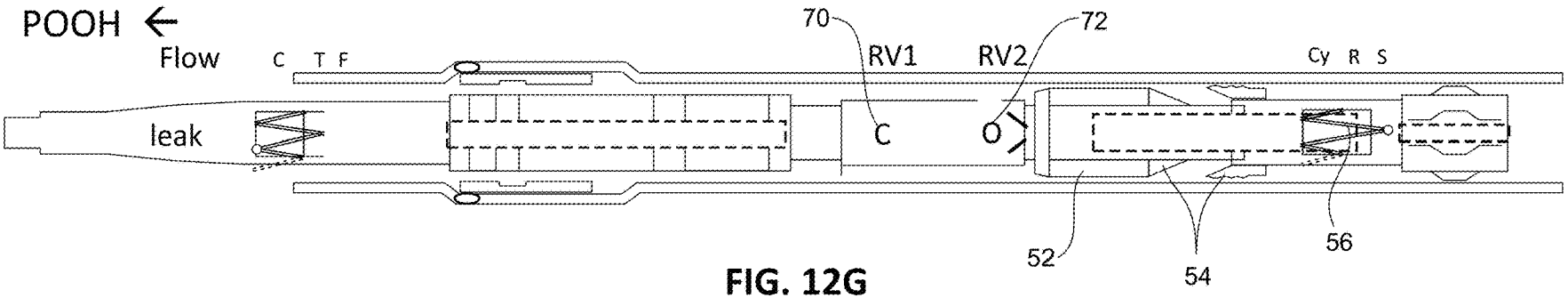
FIG. 12G

| | TP Pump (m3/min) | Frac Pump (m3/min) | CT Move | Hydraulic jay (fluid exit) | Hyd Dogs | Shifting Packer | Selector Valve | Treat tool Mode | | Figure |
|---|---|---|---|---|---|---|---|---|---|---|
| Pull up to close the sleeve | | | | | | | | | | |
| Hyd Jay Cycle | go to 0.300 (500psi) confirm flow through mode, if not cycle TP pump | | | | | | | | | 14B |
| Pull to Loc | 0.300 | off | pull up | flow through | out | deflated | extended | POOH | | |
| Close | | | pull up | | | | | | | 14C |
| Release Dogs | off | | release tension | circ | in | | | | | 14D |
| POOH | 0.100 | | pull up | | | | | | | 14E |
| Treatment tool | | | push | | | | | RIH | | 14F |
| Cycle Hyd Jay | go to 0.300 (500psi) confirm flow through mode, if not cycle TP pump | | | | | | | POOH | | 14G |
| Pull to Loc | 0.300 | | pull up | flow through | out | | | | | 14I |

FIG. 13

FIG. 14A (See also 12F)

| | TP Pump (m3/min) | Frac Pump (m3/min) | CT Move | Hydraulic jay (fluid exit) | Hyd Dogs | Shifting Packer | Selector Valve | Treat tool Mode | | Figure |
|---|---|---|---|---|---|---|---|---|---|---|
| Re-open RIH to bottom POOH on same run | | | | | | | | | | |
| RIH | 0-1.0 | 0-2.0 | push | circ | in | deflated | collapsed | RIH | | 17A |
| Hyd Jay Cycle | go to 0.300 (500psi) confirm flow through mode, if not cycle TP pump | | | | | | | | | 17B |
| Pull to loc | 0.300 | off | pull up | flow through | out | | extended | POOH | flush in front of dogs | |
| Lock Dogs | 0.425 (1000 psi) to hold dogs | | | | | inflated | | | | 17C |
| Open Down | | on/off | push | | | | -3" | SET | | 17D |
| Release Dogs | off | off | stopped | circ | in | deflated | collapsing | | only half cycle down | |
| POOH | off | off | pull up | circ | in | deflated | extended | POOH | | 17F |
| Loc | 0.300 | off | pull up | flow through | out | inflated | extended | POOH | | 17G |

FIG. 16

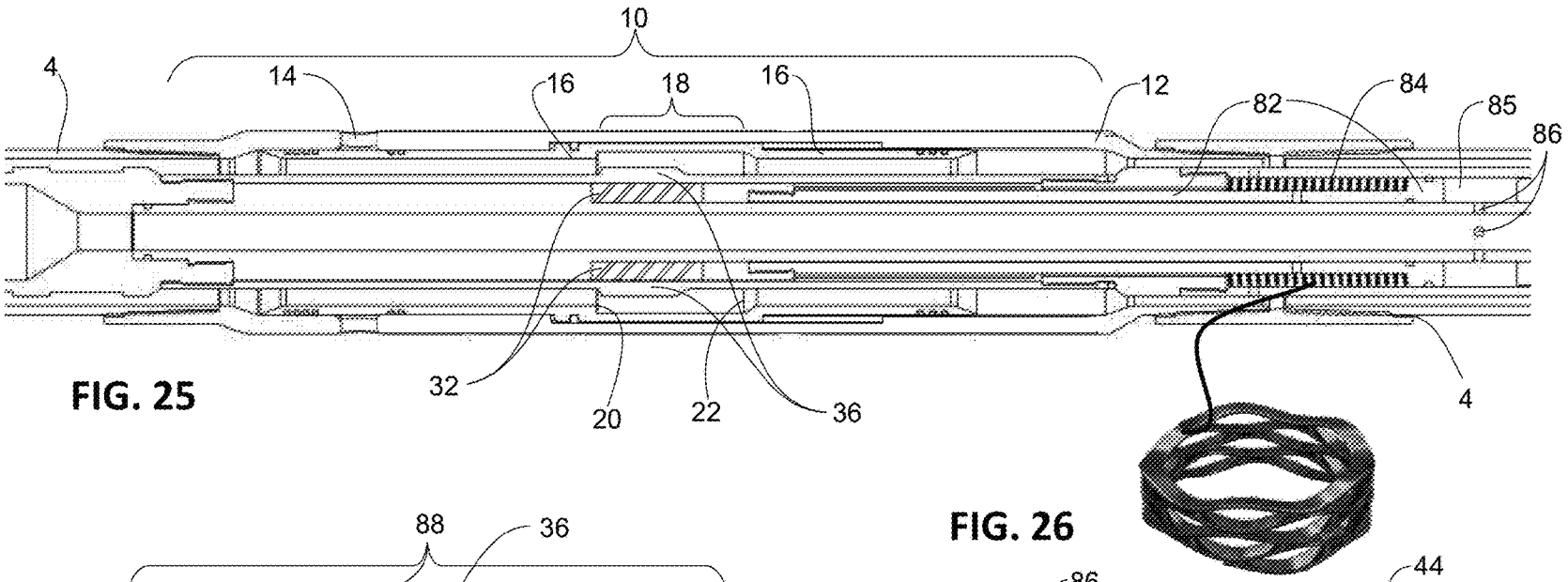
FIG. 25
FIG. 26
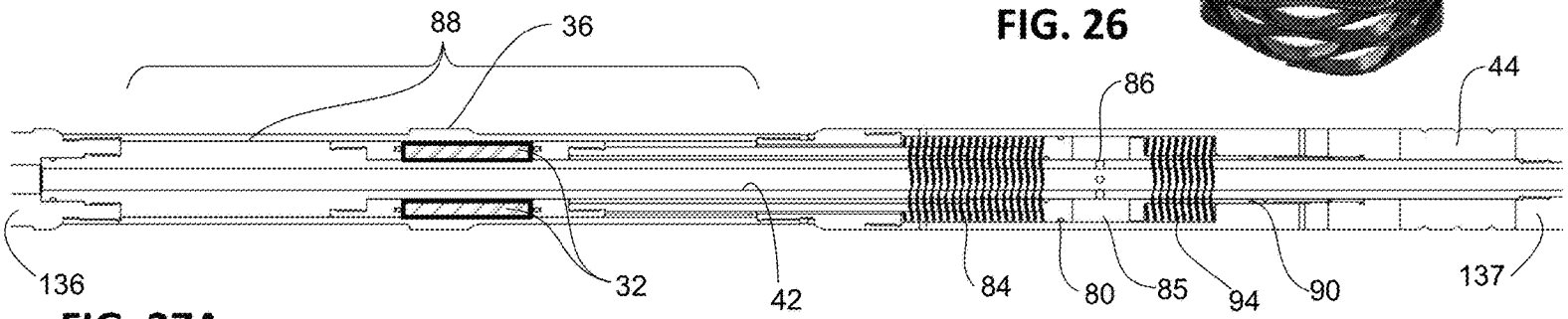
FIG. 27A
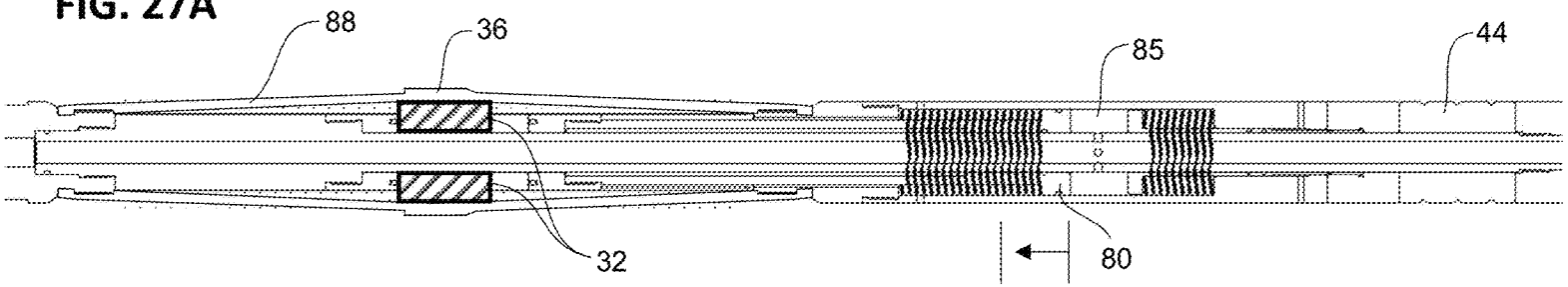
FIG. 27B

COUPLED DOWNHOLE SHIFTING AND TREATMENT TOOLS AND METHODOLOGY FOR COMPLETION AND PRODUCTION OPERATIONS

CROSS-REFERENCE TO RELATED APPLICATIONS

This application claims the benefit of U.S. Provisional Application 62/936,262, filed Nov. 15, 2019, the entirety of which is incorporated fully herein by reference.

FIELD

Embodiments taught herein relate to completion of wellbores, in particular to deviated wellbores and, more particularly, to apparatus for applying a dependable actuation of the sliding sleeve of downhole sleeve valves for fracturing and for post-production tuning of production zones along the wellbore, more particularly, a downhole assembly combining shifting tool and wellbore isolation/treatment tools enables operation of the shifting tool to engage and shift sliding sleeves independent of the isolation/treatment tool.

BACKGROUND

It is well known to line wellbores with a completion string, liners, or casing and the like and, thereafter, to create a plurality of flowpaths through the casing at multiple axially-spaced locations therealong to permit fluids, such as fracturing fluids, to reach different zones in the formation therebeyond.

The casing can include pre-machined ports, located at intervals therealong for accessing zones of the formation. The ports are typically sealed during insertion of the casing into the wellbore, such as by a dissolvable plug, a burst port assembly, a sleeve valve, or the like. Optionally, the casing can thereafter be cemented into the wellbore, the cement being placed in an annulus between the wellbore and the casing. Thereafter, the ports are typically selectively opened to permit fluids, such as fracturing fluids, to reach the formation therethrough.

Typically, when sleeve valves are used to seal the ports, a sliding sleeve is releasably retained over ports of each sleeve valve, the sliding sleeve being actuable to slide within a sleeve valve housing to open and close the respective ports. Many different types of sleeves and sleeve-shifting apparatus to actuate the sleeves are known. Fluids are directed into the formation through the open ports. At least one sealing means, such as a packer, is employed to isolate the balance of the wellbore from the treatment fluids such that fluid is directed through the open ports as opposed to elsewhere in the wellbore.

It is now commonplace to have formations accessed with deviated wells having generally horizontal heel-to-toe sections that are potentially located kilometers downhole. Accessing the deviated sections to manipulate the sleeves therein using coil tubing conveyed downhole tools can be challenging.

Often, one can perform sequential fracturing of the formation, zone-to-zone, from toe-to-heel, by opening successive sleeve valves with a shifting tool located on a bottomhole assembly (BHA) and treating zone-after-zone while stepwise pulling the BHA out-of-hole. It is also desirable to permit a fractured zone to rest or heal for several hours after treatment and a toe-to-heel operation has advantages in that one can open a sleeve, treat the formation through the now exposed ports, close the sleeve, and move uphole to open, treat, and close a sleeve at the next zone and so on. After all zones are treated, the actuator tool can be run back downhole to the toe of the well, typically hours later or after another suitable delay, and begin to sequentially re-open each valve or their respective sliding sleeves while pulling the actuator tool back out of hole.

Once all the sleeve valves are opened, the wellbore is in production mode for the recovery of hydrocarbons from the various zones up to surface. At any time thereafter, and more so as the wellbore ages, an operator may seek to block or shut in access to one or more portions of the formation due to detrimental production issues. To do so, it is desirable to run the sleeve-shifting tool back downhole to access the corresponding sleeve valves of interest and close them. However, the sleeve valves are potentially distant from surface and sleeve valves located uphole of the identified sleeve valve of interest are open to the formation, which interferes with the flow of pump down fluid used for providing pressure-aided assistance with conveyance of the shifting tool downhole, such as for the application of force on the tool to manipulate the sliding sleeves downhole. At such depths, extended reach coil tubing has disadvantages including challenges exerting a push force at the distal end of the coiled tubing located far underground, and wear and fatigue on the coil tubing due to the up-and-down cycling required using surface manipulation to position the downhole tool at depth and actuate the tool.

In U.S. Pat. No. 5,513,703 to Mills, in a disclosure directed to various treatment operations in a wellbore including fracturing treatment and manipulation of sleeve valves, Mills identifies various difficulties related to completing horizontal wells, which may be thousands of feet below the surface. Mills notes that shifting of sleeves in the horizontal section of the well is problematic as the shifting tool must complete its task without the transmission of torque (as would be available with rotary tubing), and at substantial depths below the surface. In the specification, Mills notes that a packer disposed about the tool can be expanded into sealing engagement between the tool body and the sleeve. The shifting of the sleeve can then be aided by the assistance of a force applied by fluid pressure in the annulus.

There is a divergence in the industry regarding the use of sleeve valves that open when the sliding sleeve is pulled uphole (open up), and those that open when the sliding sleeve is pushed downhole (open down). While opening sleeves valves using pull force on coiled tubing is readily accomplished with many basic CT-conveyed tools, there are challenges re-closing such open up sleeves including generation of downhole hydraulic force to push the sliding sleeve closed with one or more open sleeve valves already open thereabove. Sleeve valves configured for open down operation have been traditionally more expensive to manufacture. Further decisions regarding which sleeve valves to install, be they open up or open down, need to be made before installation. This is an economic barrier and can lead to operational restraints later during completion.

There is a need to increase the well owner's flexibility during design of a wellbore treatment plan and to improve the operability and reliability of the use of downhole tools to open and close sleeves in extended, deviated wells.

SUMMARY

A shifting tool and a fracturing or treatment tool are coupled in series and incorporated into a bottomhole assembly (BHA) to be deployed into and out of the wellbore using coiled tubing. Sliding sleeve assemblies, or sleeve valves, are devices distributed along the casing of a cased wellbore for selectable communication of treatment fluid from the wellbore annulus to the formation therealong.

At a downhole end, and progressing toward an uphole end, a typical embodiment of such a BHA comprises a toe sub, the treatment tool including a resettable packer, a drag beam, and a relief valve, the shifting tool, a wear section, and a coil connect/disconnect apparatus. In embodiments a jetting tool is positioned on the BHA, uphole of the shifting tool.

The treatment tool's resettable packer can be conventional in that it incorporates a casing-engaging packer, compressible using a casing anchor, telescopic mandrel and housing, a mandrel bypass or relief valve, and a drag beam.

The shifting tool can be functioned independently of the resettable packer, increasing its functionality to a variety of operations on sleeve valves including open up, open down, open and closing, and re-opening operations. When desired, the treatment tool's resettable packer can be actuated to isolate the wellbore below an opened sleeve and enable treatment fluids to be directed therethrough.

The shifting tool comprises a sliding sleeve-engaging shifting dog and a releasable wellbore-restricting shifting packer. The treatment tool comprises a resettable packer for blocking the wellbore during treatment operations and an anchor for axially securing the treatment tool.

Separating mechanical uphole and downhole manipulation of the treatment tool from the actuation of the shifting tool, the shifting tool is operated by manipulation of fluid flow or pressure. The control of the various operations of the the shifting tool and the treatment tool can be controlled through the use of cycling mechanisms such as a J-slot mechanism.

As introduced above, the operation of the positioning of the shifting tool at a selected sleeve valve and shifting of the sliding sleeve thereof can be independent of the isolation of the wellbore by the treatment tool for the treatment process.

In one embodiment, the shifting tool has a fluid bore that can be releasably restricted for enabling controllable hydraulic actuation of sleeve-engaging dogs and hydraulic actuation of a shifting packer to temporarily restrict the wellbore annulus. Fluid is provided down the tubing and an increase in fluid pressure in the fluid bore of the tubing drives the dogs radially outward into engagement with the wellbore at a strategic position uphole or downhole of a selected sleeve. The radially outwardly extended shifting dogs are dragged along the wellbore toward the selected sleeve to position and engage the shifting dogs in a circumferential profile in the sliding sleeve. For an open up sleeve, an uphole pull or tension of the coil tubing can overcome any sleeve restraint, such as a releasable shear screw or detent, and open the sleeve. For an open down sleeve, lowering or compressive set down of the coil tubing may be sufficient to overcome any sleeve restraint and shift the sleeve down to open. At extended wellbore depths, if needed, or as a default operation, a further increase in fluid pressure actuates the shifting packer to an expanded position to restrict the annulus and annular fluid can be pumped down to impose a fluid force on the shifting packer such that it acts as a piston, aiding in forcing the shifting packer, engaged shifting dogs, and connected BHA downhole. As the treatment tool is independent of the shifting tool, sufficient downhole hydraulic force can be developed on the shifting packer even when compromised by open sleeve valves uphole thereof, as the shifting packer is not necessarily engaged in robust casing engagement needed for treatment operations.

The treatment tool is employed to sealingly and grippingly engage the wellbore casing downhole of an opened sleeve valve sufficient to remain in place during treatment pressures. In embodiments, the treatment tool can be an otherwise resettable bridge plug or resettable sealing device used in treatments, including the high fluid pressures employed during hydraulic fracturing. Applicant has also disclosed a form of resettable downhole tool as disclosed in U.S. Pat. No. 10,472,928 (US'928) to Andreychuk et al. The US '928 tool substitutes slips with dogs at the distal end of arms. The dogs are actuated in a similar manner to slips in that a packer and cone are driven under the dogs to force the dogs radially outward into the casing. The dogs are fit with carbide buttons that are rotated appropriately for the relative angle of engagement to bite into the casing and restrict downhole movement of the treatment tool against the force generated from uphole treatment pressure.

In another embodiment, a dual-functioning hydraulic and mechanical bottomhole assembly (BHA) is provided comprising a flow or pressure actuated shifting tool for manipulating the sliding sleeve of sliding sleeve assemblies, and a resettable packer for wellbore isolation and for treatment of the wellbore uphole thereof. Hydraulic actuation and operation of the shifting tool can be independent of a mechanical actuation and operation of the resettable packer for increased flexibility and functionality in the wellbore.

The BHA components are coupled in series for deployment into and out of the wellbore at the distal end of a conveyance tubing, such as coiled tubing. The conveyance tubing has a first, tubing fluid path or fluid bore to the BHA, and the BHA forms a second, annular fluid path in the annulus formed between the tubing and the wellbore.

From the uphole end, the BHA comprises a connector to the conveyance tubing and a wear section. Many operations utilize annular transport of treatment fluids and the tubing is used for pressure balancing to avoid tubing collapse or other fluid management considerations. The wear section could include a treatment port, for discharge of tubing-conveyed fluids along the tubing fluid path to the wellbore annulus. Typically the annular fluid path is sole source of treatment fluids to the wellbore annulus and through the open sleeve valve; the tubing and a treatment port could act as adjunct fluids provided in combination with treatment fluids provided down the annular fluid path. In embodiments, elimination of a tubing treatment port simplifies optional addition of uphole devices including abrasive perforating subs.

This BHA similarly comprises a sleeve-shifting tool having a sleeve engagement shifting dog or dogs, a shifting packer, and an associated hydraulic, uphole J-mechanism for cycling of the shifting dogs and shifting packer operation. The shifting dogs and shifting packer are operated between a radially-retracted and extended position. Manipulation of the uphole J-mechanism is controlled through the tubing fluid path such as through changes in flow rate and pressure. Changes in flow rates result in pressure drops along the bore which can be used to trigger toggling of a hydraulic flow valve and application of hydraulic actuation for the dogs and shifting packer. Manipulation through tubing bore pressure is typically made relative to pressure along the annular flow path. In other words, behaviour of fluid flows and pressure can be related to the fluid interconnectivity and conditions of the tubing and annular flow paths during operation.

Again, the shifting packer provides control of the annular fluid path and hydraulically generated axial forces available therefrom. The shifting tool enables positioning of the shifting dog at, and the actuation of, a selected sliding sleeve assembly, including to shift the sliding sleeve open to expose flow ports in the sleeve assembly, for fluid communication between the annulus and the formation. The shifting tool can also be operated to close a sleeve after opening. Actuated, the extended shifting dogs are compatible for engagement with a circumferential shifting profile formed in the bore of the sleeve so as to enable axial shifting forces to be transferred thereto from the BHA. Forces applied by the BHA include uphole and downhole applied forces from the conveyance tubing, and further can include annular fluid hydraulic downhole forces applied to the BHA uphole or downhole of the shifting dogs. Forces applied to the BHA are transmitted though the dogs to the sliding sleeve.

The shifting tool is actuated by fluid hydraulics. The shifting tool's shifting dogs are operable radially from a radially-retracted or stowed position to a radially extended position that engages the cased wellbore and can permit positioning of the BHA relative to a selected sliding sleeve valve and more particularly at the shifting profile of the selected sliding sleeve. The shifting tool's shifting packer is operable between a retracted and radially expanded positions. Expanded, the shifting packer can partially or fully block the annular flow path and the flow of annular fluids thereby.

The treatment tool, having a resettable packer, is spaced downhole of the shifting tool and comprises a casing-engaging component, a packer, a bypass bore, and BHA drag device. The bypass bore is fit with a relief or bypass valve for alternately isolating the wellbore uphole and downhole of the resettable bridge plug when the packer is set, and permitting bypass of fluid communication around the packer, whether the packer is set or not. The bypass valve is typically functioned with string manipulation. The BHA drag device, such as a drag beam, provides resistance between the BHA and the wellbore such as for enabling mechanical operations of the resettable packer such as through uphole and downhole manipulation of the conveyance tubing and connected BHA to cycle through the operational modes of the bridge plug. The resettable packer is preferably controlled using a mechanical device such as a J-mechanism actuated with the uphole and downhole manipulation of the BHA.

In embodiments, the hydraulic actuation valve can be located uphole of the shifting dogs and shifting packer for reducing the overall length of the BHA. The hydraulic actuation valve could be incorporated in the treatment wear tubing uphole of shifting dogs. Further, operational advantages are obtained by locating the shifting packer downhole of the shifting dogs, thereby minimizing the distance that the BHA is collapsed or otherwise shifted downhole of the opened sleeve valve before treatment commences.

Generally, in operation, the BHA's shifting tool is positioned in a selected sliding sleeve for open or closing shifting operations. The dog engages the shifting profile in the sleeve and the shifting packer is actuable between a retracted position for free wellbore movement and an expanded position for localized restriction of the wellbore annulus. With the shifting packer in the expanded position, uphole annular fluid pressure can generate hydraulic downhole force on the BHA for aiding tool transport in long reach lateral wellbores and for downhole sleeve-shifting actuation as needed.

The BHA design can minimize coiled tubing reversing stress cycles by eliminating mechanical string manipulation steps between opening a sleeve, setting the treatment tool, and treatment operations. Use of Applicant's previously disclosed slack sub, see US Application US20200024916A1, published Jan. 23, 2020, for cycle-free repositioning of a BHA below an opened sleeve valve or other axially collapsible positioning means between the shifting and treatment tools, eliminates up and down cycles.

Applicant believes the use of a downhole repositioning means reduces tubing cycling at least one cycle over the current shifting technology. Applicant understands that current shift-up-to-open dog-based shifting tools pull uphole or locate a sleeve, shift it up to open, retract the dogs, and reverse tubing tension to run downhole to some depth below the sleeve, pull up again to known depth then run in hole once again to set their resettable packer of the treatment tool below the sleeve. The current embodiment shifts a sleeve open, releases the dog, and in a single stroke runs-in-hole to lower the BHA below the sleeve and set the resettable packer below the sleeve, thereby eliminating an up and down cycle. Further, the lowering of the BHA below an opened sleeve can be utilized to minimize tool erosion in treatment such as hydraulic fracturing using erosive particulates such as proppant. If BHA length is a factor, such as to accommodate existing or shorter surface lubricators, the collapsible reposition means can be eliminated, and one can simply cycle the tools more as others do, only with the added versatility of shift up or shift down operations in a single run.

Further, Applicant's setting of the tool below the opened sleeve valve at a known distance via an incorporated repositioning means, a short section of tubing or wear bar, and having a reduced diameter for lowered annular velocities, can be reliably located at the treatment ports, thus enabling high fluid rates, sand loading, and tonnage, with a ultimate goal of eliminating erosion.

As a result of the embodiments disclosed herein the capital cost of sleeves can be reduced by providing sleeve valves having short axial extent, determined by the length of the sleeve needed to incorporate the circumferential profile and sufficient uphole and downhole length to accommodate seals in the annulus between the sliding sleeve and the sleeve valve housing. The sleeves need not embody additional length previously accessed for gripping and shifting means. Short sleeves can still incorporate superior performance utilizing scraper rings to maximize seal reliability, and yet still install multiple redundant seals both uphole and downhole of the treatment ports to maximize seal reliability. Further, seal placement and spacing can ensure sleeve travel distance to ensure seal rings are not adversely affected by port erosion experienced at high fracturing fluid rates and sand tonnages.

Further, minimal inventory is permitted wherein shift up and shift down sleeve valves can be of like design or with careful management of installation protocol, merely the same sleeve valve design can be installed upright or upside down for reversed up or down operation. Improved positioning, engagement, and shifting options could permit sleeve design to forego shear screws, rely on sleeve opening or closing detent actuation resistance or reduction of existing detent resistance, overcoming industry limitations in conveyance tubing capacity in long deep wells where not enough force is available to open the sleeve.

Various hydraulic operation of dogs can be drawn from the prior art and further advantages are obtained using shifting dog embodiments disclosed herein. The shifting packer provides improved shift down force on any sleeve.

Other than the full service operation of opening a sleeve, manipulating the resettable packer for hydraulic fracturing, closing the sleeve, and repeating for all the sleeves, operations for simple re-opening procedures of open-up sleeves requires no tubing cycling once pulling up hole.

The embodiments herein enable repeated opening of shift-up-to-open successive sleeves in a single tool run. In this situation, there is virtually no cycling of the tubing. The operator initially runs the tool to the wellbore bottom, pumps fluid down the tubing to activate the hydraulic shifting dogs, pulls up to position the shifting dogs in the shifting profile of the sleeve, continues to pull up to open the sleeve, stops tubing pumping, and continue to pull up to the next sleeve. This basic functionality is achieved without sacrificing the ability to return downhole to close one or more sleeves and resume opening other sleeves.

Similarly, embodiments herein enable repeated opening of shift-down-to-open successive sleeves in a same tool run. The operation can be completed with minimum cycling of the tubing. Again, the operator initially runs the tool to the wellbore bottom, pumps fluid down the tubing to activate the hydraulic shifting dogs, pulls up to position the shifting dogs in the shifting profile of the first sleeve, runs in hole to open the sleeve with additional pumped annular fluid to hydraulically assist the shifting down of the sleeve, if tubing weight is insufficient, stop the tubing pumping to release the shifting dogs, and pull up to the next sleeve.

BRIEF DESCRIPTION OF THE DRAWINGS

FIG. 1A illustrates a sleeve opening and closing embodiment wherein, after running in hole (RIH), downhole of the sleeve valve of interest, a tubing pump (TP) is turned on and the treatment tool is pulled uphole in pull-out-of-hole (POOH) or locate mode (PTL), the shifting tool dogs shown having located and engaged the closed sliding sleeve's profile, the shifting tool's packer located in the casing downhole of the sleeve valve;

FIG. 1B illustrates opening of the treatment ports of the sliding sleeve, in which the tubing and annular pumps are flowing to energize and drive the shifting dogs and engaged sliding sleeve downhole to the open position, the flow valve transitioning, after the sliding sleeve is freed for sliding movement, to open the bore of the treatment tool;

FIG. 1C illustrates setting of the treatment tool in the SET mode to block or isolate the wellbore downhole of the opened sleeve valve the tubing pump being turned off (or on idle for pressure balancing the tubing bore and annulus) for retracting the shifting tool and packer, the flow valve transitioning to open the conveyance tubing to the annulus and the frac pump is turned on for annular fracturing flow through the open sleeve ports;

FIG. 1D illustrates an embodiment wherein, after treatment the sleeve valve is to be closed, the shifting tool is pulled uphole to re-engage the sliding sleeve, the shifting tool dogs shown having located and engaged the opened sliding sleeve's profile and the treatment tool also being pulled uphole in the pull-out-of-hole/pull-to-locate mode POOH/PTL, the flow valve closing off the tubing bore from the annulus and the tubing pump turned on to activate the shifting tool dogs and shifting packers;

FIG. 1E illustrates the operational step after FIG. 1D wherein after re-engaging the sliding sleeve, a further uphole pull on the shifting tool shifts the sliding sleeve to close the sleeve valve, such as to avoid sand returns and/or permit the formation to "reset", the treatment tool remaining in POOH/PTL;

FIG. 1F illustrates the operational step after FIG. 1E wherein after the sleeve valve is closed, the tubing pump is turned off to retract the shifting tool dogs and packer, and continued uphole pull on the shifting tool pulls both the shifting tool and treatment tool, in POOH/PTL mode, free of the sliding sleeve and moves uphole to the next successive sleeve for treatment;

FIG. 1G illustrates a sleeve open and leave-open embodiment starting in manner similar to the step illustrated in FIG. 1A, wherein after running-in-hole (RIH) downhole of the sleeve valve of interest, the tubing pump is turned on to energize the shifting dogs and the treatment tool is pulled uphole in the POOH/PTL mode, the shifting tool dogs shown having located and engaged the closed sliding sleeve's profile;

FIG. 1H illustrates the operational step after FIG. 1G for opening of the treatment ports of the sliding sleeve, similar to that of FIG. 1B, in which the annular pump is flowing to drive the shifting packer and shifting dogs downhole, the flow valve transitioning, after releasing the sliding sleeve for movement, to open the treatment tool bore;

FIG. 1I illustrates an operational step after FIG. 1H wherein after the sleeve valve is opened, the tubing pump is turned off to retract the shifting tool dogs and packer, and an uphole pull on the shifting tool pulls both the shifting tool and treatment tool, in the POOH/PTL mode, free of the sliding sleeve for movement to the next sleeve valve for opening;

FIG. 3A illustrates a sleeve open and close embodiment wherein, after running-in-hole (RIH) downhole of the sleeve valve of interest, the tubing pump is turned on and the treatment tool is pulled uphole in the pull-out-of-hole or locate mode (POOH/PTL), the shifting tool dogs shown having located and engaged the closed sliding sleeve's profile, the shifting tool's packer located in the casing downhole of the sleeve valve;

FIG. 3B illustrates opening of the treatment ports of the sliding sleeve, in which the tubing pump is flowing to energize the shifting dogs whilst the conveyance string is pulled uphole to pull the engaged sliding sleeve open;

FIG. 3C illustrates a downhole movement and setting of the treatment tool in the SET mode to block the wellbore downhole of the opened sleeve valve, the tubing pump being turned off (or on idle for pressure balancing) for retracting the shifting tool and packer, the flow valve transitioning to open the conveyance tubing to the annulus and the frac pump is on for annular fracturing flow through the open ports;

FIG. 3D illustrates an embodiment wherein, after treatment, the sleeve valve is to be closed, the shifting tool is being pulled uphole to re-engage the opened sliding sleeve, the shifting tool dogs shown having located and re-engaged the opened sliding sleeve's profile and the treatment tool also being pulled uphole in the locate mode POOH/PTL;

FIG. 3E illustrates the operational step after FIG. 3D wherein after the dogs have re-engaged the sliding sleeve, in which the tubing and annular pumps are flowing to energize and drive the shifting packer, shifting dogs and engaged sliding sleeve downhole to close the sleeve valve, the treatment tool remaining in POOH/PTL;

FIG. 3F illustrates the operational step after FIG. 3E wherein after the sleeve valve is closed, the tubing pump is turned off to retract the shifting tool dogs and packer, and an uphole pull on the shifting tool pulls both the shifting tool and treatment tool, in the POOH/PTL mode, free of the closed sliding sleeve and moves uphole to the next successive sleeve for treatment;

FIG. 3G illustrates a sleeve open and leave-open embodiment starting in manner similar to the step illustrated in FIG. 3A, wherein after running-in-hole (RIH) downhole of the sleeve valve of interest, the tubing pump is turned on to energize the dogs and the treatment tool is pulled uphole in the POOH/PTL mode, the shifting tool dogs shown having located and engaged the closed sliding sleeve's profile;

FIG. 3H illustrates the operational step after FIG. 3G for opening of the treatment ports of the sliding sleeve, similar to that of FIG. 3B, in which the tubing pump is flowing to energize the shifting dogs whilst the conveyance string is pulled uphole to pull the engaged sliding sleeve open;

FIG. 3I illustrates an operational step after FIG. 3H wherein after the sleeve valve is opened, the tubing pump is turned off to retract the shifting tool dogs and packer, and an uphole pull on the shifting tool pulls both the shifting tool and treatment tool, in the POOH/PTL mode, free of the sliding sleeve for movement to the next sleeve valve for opening;

FIGS. 5A and 5B illustrate the prior art (BHA) according to FIGS. 4A to 4C, in which the dogs are shown set in casing between successive sleeve housings, and the enlarged view of FIG. 5B illustrates the relationship between dogs, cone, and packer in the casing, the conveyance tubing, downhole J-slot mechanism, drag blocks, and toe sub, if any, are omitted;

FIG. 11 is a table of the sequenced operations of a BHA according to another embodiment of the invention, more particularly the steps of operation of the hydraulic shifting tool and treatment tool as set forth in FIGS. 12A to 12G;

FIGS. 12A through 12G are schematic cross-sectional representations of the operation of a BHA for shift down sleeves according to FIG. 11. A shifting tool hydraulic J-mechanism of the BHA is labled "C" for circ or cycle, "T" flowthrough, and "F" for high flow mode. The treatment tool J-Mechanism is labled "Cy" for cycle or POOH mode, "R" for RIH mode, and "S" for SET mode. Tubing and annular flow valving between the shifting tool and treatment tool are identified as RV1 for opening and closing the tubing discharge from the shifting tool and RV2 for opening and closing the bypass valve atop the treatment tool;

FIG. 12A illustrates the BHA in run in hole mode (RIH) with the shifting tool idle and the treatment tool in RIH mode;

FIG. 12B illustrates the BHA in locating mode (LOC) with the shifting tool dogs actuated and the treatment tool in POOH mode and the dogs positioned in the sleeve profile;

FIG. 12C illustrates the BHA in dog locking mode (LOCK) with the shifting tool dogs and shifting packer actuated and the treatment tool in POOH mode;

FIG. 12D illustrates the BHA in shifting mode (SHFT) with the shifting tool dogs engaged in the sleeve profile and shifting packer actuated and lowered downhole the short distance needed to open the sleeve, the treatment tool remaining in POOH mode;

FIG. 12E illustrates the BHA in move mode (MOVE) with the shifting tool released and the entire BHA continuing downhole below the sleeve valve to locate the uphole wear tubing at the opened ports;

FIG. 12F illustrates the BHA in set and treatment mode (SET) with the treatment tool actuated to isolate the wellbore in SET mode;

FIG. 12G illustrates the BHA in pull-out-of-hole (POOH) mode to move uphole towards the next sleeve where the sequence repeats from FIG. 12B;

FIG. 13 is a table of the sequenced operations of the BHA of FIGS. 11 through 12G according to another embodiment of the method of operation of the BHA, more particularly to include a re-closing operation on the sleeve valve after treatment, more particularly the steps of operation of the hydraulic shifting tool and treatment tool as set forth in FIGS. 14A to 14I;

FIG. 14A illustrates the operation of the BHA from SET and fracturing operation duplicated in FIG. 12F;

FIG. 14H1 illustrates a flow cycling operation with the tubing pump to decrease tubing pressure and cycle the shifting tool to the circulate mode;

FIG. 14H2 illustrates a flow confirmation operation with the tubing pump to ensure the shifting tool is cycled to hydraulic actuate flowthrough mode;

FIG. 16 is a table of the sequenced operations of the above BHA according to another embodiment of the method of operation thereof the BHA, namely to reopen a plurality of closed sleeve valves;

FIGS. 18A to 18C are cross-sectional views of an embodiment of a hydraulic actuation flow valve for flow-rate actuation of the shifting tool, the flow valve shown respectively in: a no-or-low-flow circulation mode for flow down the tubing and to the annulus, a triggering flow mode for advancing the flow valve cycle, and a high flow mode to block annular discharge and direct full flow down the tubing to the shifting tool;

FIGS. 19A to 19C2 are schematic representations of the J-mechanism for the flow valve of FIGS. 18A to 18C respectively, the J-slot being located in the mandrel and the pin fixed in the housing, FIGS. 19C1 and 19C2 illustrating the hydraulic cycling needed to move between triggering mode and high flow mode;

FIG. 19E illustrates a J-mechanism where the extreme uphole and downhole positions are delimited by the mandrel movement rather than by a pin and slot collision;

FIG. 22A illustrates the BHA in RIH mode with the shifting tool idle and the treatment tool in RIH mode;

FIG. 22B illustrates the BHA in LOC mode with the shifting tool dogs actuated and the treatment tool in POOH mode and the dogs positioned in the sleeve profile;

FIG. 22C illustrates the BHA in dog hold or locking mode (LOCK) with the shifting tool dogs and shifting packer actuated and the treatment tool in POOH mode;

FIG. 22D illustrates the BHA in shifting mode (SHFT) with the shifting tool dogs engaged in the sleeve profile and shifting packer actuated and lowered downhole the short distance needed to open the sleeve, the treatment tool remaining in POOH mode;

FIG. 22E illustrates the BHA in set and treatment mode (SET) with the treatment tool actuated to isolate the wellbore in SET mode, the BHA can be moved downhole below the sleeve valve to locate the uphole wear tubing at the opened ports;

FIG. 25 is a cross-sectional view of the shifting tool of FIG. 24 positioned in a form of sleeve valve with the dog portion of the beam-type shifting dog aligned with the sleeve profile;

FIG. 26 is an isometric view of a wave spring suitable for use with both shifting dog and shifting packer piston return when the tubing pressure returns to low flow mode;

FIGS. 27A and 27B are schematic of a polyurethane-type elastomer in the released and axially actuated or compressed and radially expanded mode under the shifting dog beam of FIG. 26, the dog-actuating piston not illustrated in the actuated position (better seen in FIGS. 29A and 28B);

DESCRIPTION

A bottomhole assembly (BHA) 8 is provided for installation on conveyance tubing 6 for servicing subterranean formations assessed by a cased wellbore. Generally, embodiments of the BHA disclosed herein, comprise a shifting tool that is operable independent of a downhole treatment tool that typically functions as wellbore isolation/treatment tool for treatment thereabove.

Figures 1A, 1B, 1C:
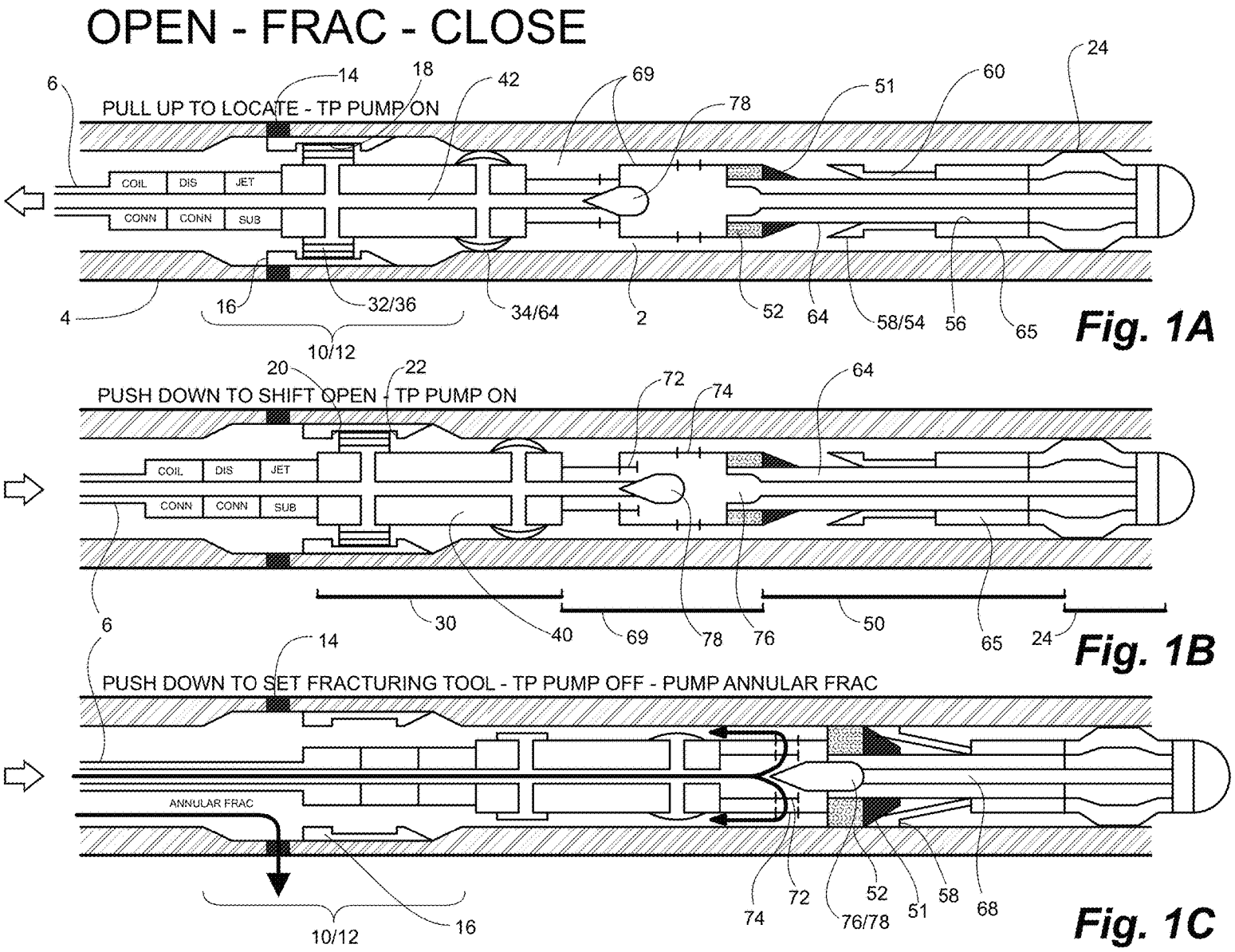
FIGS. 1A through 1I are schematic side cross-sectional views of an embodiment of the coupled shifting and treatment tools, and an uphole flow/selector valve telescopically actuable therebetween, for use with a downhole, push-down-action-to-open the sleeve valve, FIG. 1A though 1C illustrative of the locating and opening of the sleeve valve for treatment therethrough, FIGS. 1D through 1F illustrative of a closing of the sleeve before moving to the next successive sleeve valve, and FIGS. 1G through 1I illustrating a later opening of previously closed sleeve valves.
Figure 12A:
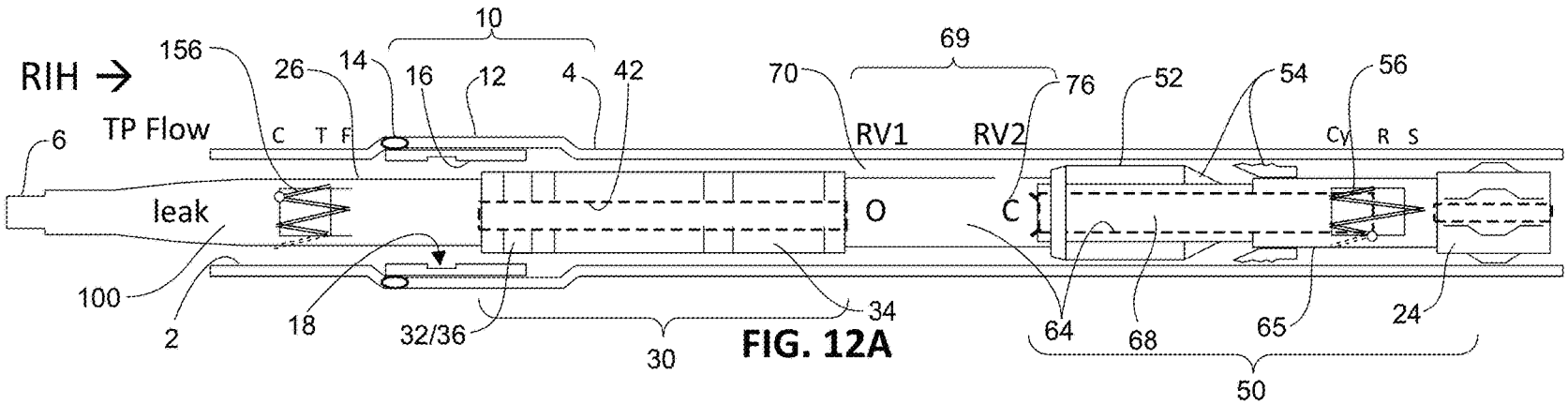
Figure 12B:
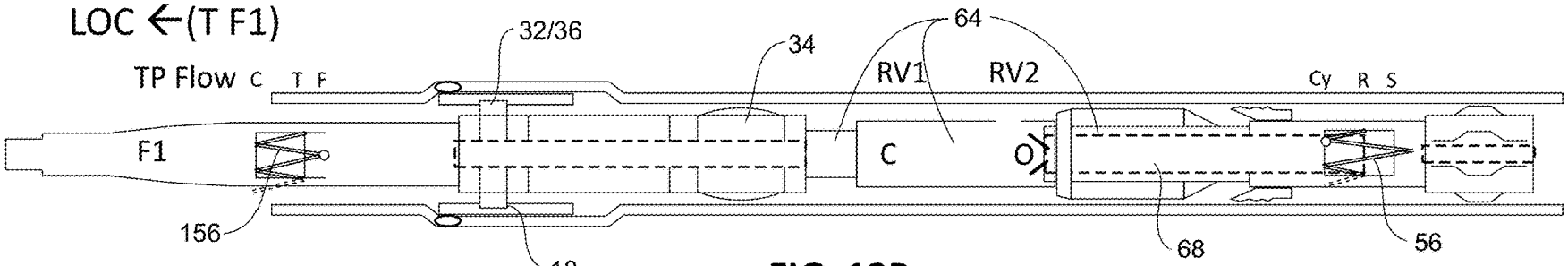
Figure 32A:
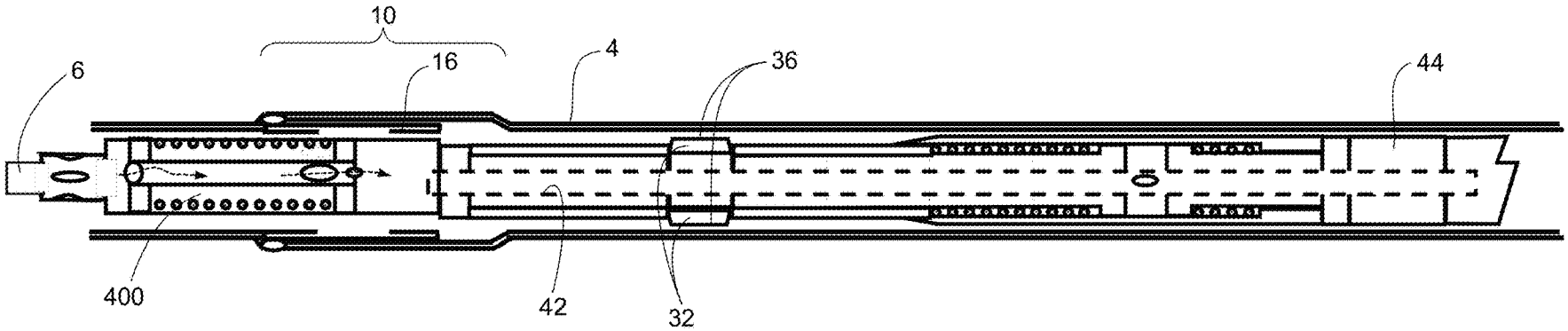
FIGS. 32A and 32B are schematic cross-sectional views of the shifting tool of FIGS. 31A and 31B coupled with another embodiment of an uphole hydraulic flow valve used for actuating the shifting tool therebelow from released to actuated, axially compressed states respectively, the flow or pressure insufficient to have actuated the shifting packer.

In various embodiments, and with reference to FIGS. 1A, 12A, and 32A, the BHA 8 can be used to locate and actuate one or more sleeve valves 10 spaced along a completion string or casing 4. Each sleeve valve 10 comprises a sleeve housing 12 spaced along the casing 4, each sleeve housing 12 having one or more treatment ports 14 formed therethrough and being fit with a sliding sleeve 16 that is axially movable therein and actuable between an open position and a closed position. In the open position, the sleeve 16 exposes the treatment ports 14 and permits fluid communication therethrough. In the closed position, the sleeve 16 fluidly blocks the treatment ports 14.

Structure of BHA

Generally, as shown in the embodiment of FIGS. 1A through 31, the BHA 8 comprises both a shifting tool 30 and a treatment tool 50 coupled together and having substantially independent operations. The shifting tool 30 both locates and shifts the sliding sleeve 16 of a sleeve valve of interest 10. The treatment tool 50 retains the BHA 8 axially in the wellbore and fluidly isolates the portion of the wellbore uphole of the treatment tool 50.

The shifting tool 30 comprises a sleeve-engaging mechanism 32, such as a shifting dog, and a shifting assist mechanism 34. The treatment tool 50 comprises a resettable wellbore isolation mechanism 52, such an isolation packer, for isolating the annulus 2 defined between the wellbore and the BHA 8/conveyance tubing 6 during treatment operations, and an anchor 54 for axially retaining the treatment tool 50 in the wellbore. The shifting tool 30 is operated by manipulation of fluid pressure and uphole and downhole manipulation of the BHA 8 via the conveyance tubing 6. The treatment tool 50 is operated by uphole and downhole manipulation of the BHA 8 via the conveyance tubing 6. A cycling tool 56 such as a J-slot mechanism can be used to delimit various operational modes of the treatment tool 50, as described in further detail below.

The sliding sleeves 16 of the sleeve valves 10 can be any sleeve valve having a sleeve profile 18 formed in an inner wall of the sleeve 16 configured for engagement with the sleeve-engaging mechanism 32 of the shifting tool 30. In embodiments, the sleeves 16 can be relatively short, only needing to be as long as necessary to incorporate the sleeve profile 18. The sleeve housing 12 can also be correspondingly short in length, resulting in a less expensive consumable. The sleeve valve 10 need not have a separate downhole locator portion within the housing 12, nor incorporate a separate pup therebelow to facilitate location of the sleeve 16. Instead, location and actuation of the sleeves 16 can be performed via engagement of the sleeve profile 18 thereof with the shifting tool 30. The sleeve profile 18 can be configured to enable bi-directional controlled actuation thereof, in other words selective actuation of the sleeve 16 between the open and closed positions.

The sliding sleeves 16 can be unitary or comprise multiple discrete portions. Each sleeve 16 is fit with annular recess or sleeve profile 18 along the inner bore thereof, as described above. For more effective axial engagement with the shifting tool 30, the sleeve profile 18 can have a length that is readily distinguishable from other annular gaps found along the sleeve 16 or at connections between casing sections or tools. Namely, the sleeve profile 18 can be longer in length than the other annular gaps. The sleeve profile 18 has uphole and downhole shoulders 20,22 for delimiting an axial engagement length thereof. In embodiments, the shoulders 20,22 can radially extend at right angles from the inner wall of the sleeve 16. In some circumstances, release of the sleeve-engaging mechanisms 32 from the sleeve profile 18 can be more difficult with right angled shoulders 20,22. In embodiments, for easier release of the sleeve-engaging mechanisms 32, an angular relief can be provided, such as angular shoulders 38 on the sleeve-engaging mechanisms 32. The sleeve profile 18 can also have angular uphole and/or downhole shoulders 20,22 as opposed to right angle shoulders to enable easier release of the sleeve-engaging mechanisms 32.

In the embodiments of the BHA 8 depicted in FIGS. 1A to 7B, beginning at a downhole end of the BHA 8 and progressing toward an uphole end, the illustrated BHA 8 comprises a drag block 24, the treatment tool 50, the shifting tool 30 and a valve assembly 69 located between the shifting tool 30 and treatment tool 30, and having an uphole flow valve or selector valve 70 and a bypass valve 76. The shifting tool 30 comprises a tubular shifting mandrel 40 having a fluid bore 42 in communication with the conveyance tubing 6 and telescopically connected to a tubular isolation mandrel 64 of the treatment tool 50. The isolation mandrel 64 is in turn telescopically connected to an isolation housing 65. As described above, a cycling mechanism 56 is located between the isolation mandrel 64 and isolation housing 65 to delimit various operational modes of the treatment tool 50. The shifting mandrel 40 supports the shifting tool 30, an optional abrasive jetting tool positioned uphole of the shifting tool 30, and an optional coil connect/disconnect apparatus between the BHA 8 and the conveyance tubing 6. The shifting mandrel 40 also supports the sleeve-engaging mechanism 32 and shifting assist mechanism 34. Additionally, an erosion-resistant annular shield 26 can be located uphole of the shifting tool 30 to protect components of the BHA 8 from erosion during fracturing treatment operations.

The isolation mandrel 64 supports the wellbore isolation mechanism 52, depicted as an isolation packer 52. The isolation housing 65 supports an anchor 54, depicted as dogs 58 located at the ends of arms 60 pivotably connected to the isolation housing 65. Drag block 24 configured to frictionally engage the wellbore casing 4 is connected to the isolation housing 65 to provide sufficient axial drag on the isolation housing 65 to enable telescopic actuation between the isolation mandrel 64 and housing 65 in response to axial manipulation of the conveyance string 6.

In greater detail, the shifting tool 30 is telescopically connected to the treatment tool 50 and is manipulated from surface by uphole and downhole actuation of the conveyance string 6. For example, in the embodiment depicted in FIGS. 1A-7B, the conveyance string 6 is connected to the tubular shifting mandrel 40 of the shifting tool 30 and the shifting mandrel 40 is telescopically connected to the tubular isolation mandrel 64 of the treatment tool 50. The isolation mandrel 64 is in turn connected to the tubular isolation housing 65. An axially manipulated valve assembly 69 is located between the isolation and treatment tools 30,50. In the embodiment depicted in FIGS. 4A-7B, as described in further detail below, the valve assembly 69 comprises a flow blocking or selector valve 70 and a bypass valve 76.

Figure 8A:
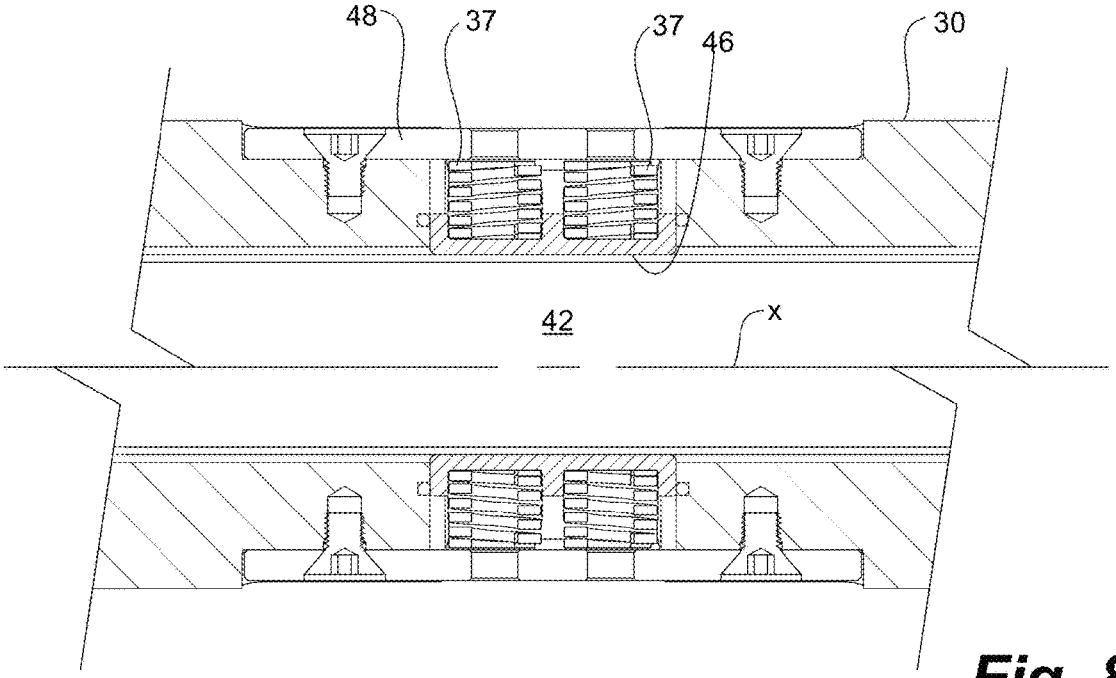
FIGS. 8A and 8B are partial, cross-sectional views of one embodiment of the dog-portion of current shifting tool, using circumferentially-spaced, tubing fluid pressure-actuated dogs, the cloven pistons radially actuable about a stop plate, the dogs shown as being biased to the retracted position by coil springs and hydraulically extended, respectively.
Figure 8B:
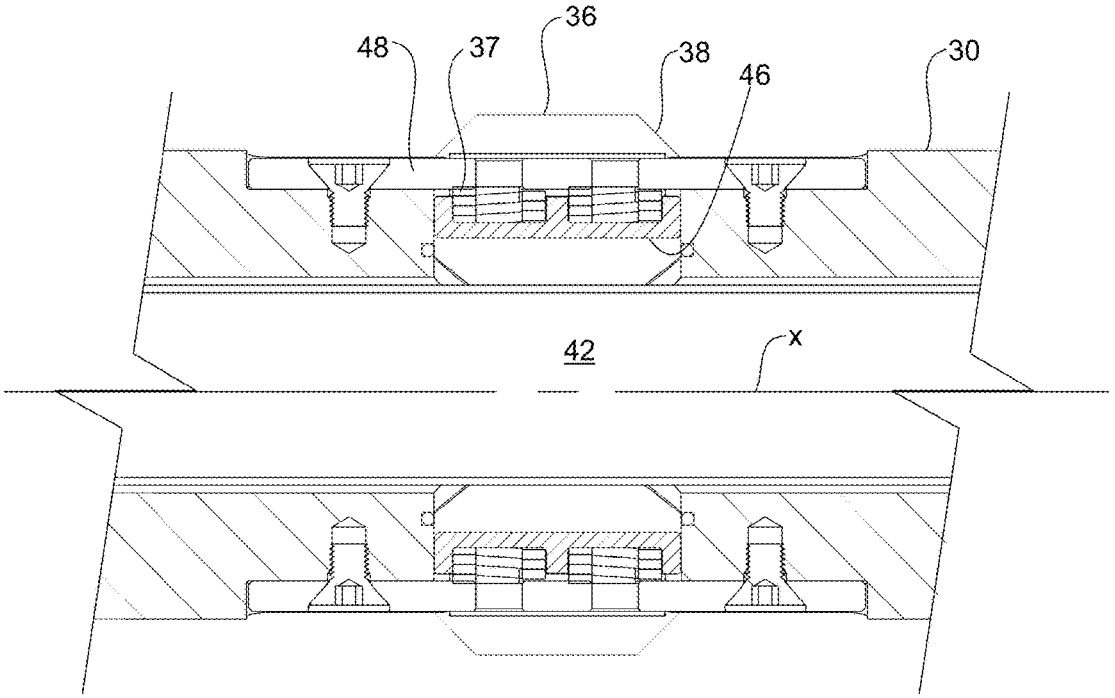

With reference to FIGS. 8A and 8B, the shifting tool 30 has two hydraulically actuated mechanisms, the sleeve-engaging mechanism 32 and the shifting assist mechanism 34. The sleeve-engaging mechanism 32 can be any suitable hydraulically actuated tool that is selectively actuable to locate and engage the sleeve profile 18 of the sleeve valve of interest 10. One group of suitable hydraulic tools includes piston-actuated, radially extending shifting dogs 36. Hold-down subs for anchoring a tool in a wellbore are also examples of tools that can be re-tasked as a sleeve-engaging mechanism 32. Other examples of suitable hydraulically-actuated sleeve-engaging mechanism 32 include Otis Type B shifting tools, and inflatable bladders or packers that can, in turn, actuate dogs.

The sleeve-engaging mechanism 32 can be configured to be activated by tubing pressure PTP in the conveyancing tubing 6 for locating and engaging the sleeve profile 18 of the sleeve 16. The engagement between the sleeve-engaging mechanism 32 and sleeve profile 18 should be robust enough to maintain engagement therebetween during actuation of the sleeve 16 between the open and closed positions, and withstand the axial loads experienced during such actuation.

With reference to FIGS. 8A and 8B, an embodiment of a sleeve-engaging element 32 of the current shifting tool 30 can use circumferentially-spaced, radially extending dogs 36 driven by pistons 46, such as cloven pistons, radially actuable via tubing fluid pressure PTP. A respective radial stop plate 48 can be located radially outward of the pistons 46 to radially restrain them from being pushed out too far. Springs 47 can be located between the pistons 46 and stop plates 48 to urge the pistons 46 and shifting dogs 36 to a radially-retracted position. Tubing pressure PTP in the conveyancing string 6 and shifting mandrel bore 42 can be used to overcome the biasing force of the springs 47 and hydraulically drive the pistons 46 radially outwardly, thereby also urging the dogs 36 radially outward. Due to the radially inward biasing force applied on the pistons 46 by the springs 47, upon reduction of tubing pressure PTP, the shifting dogs 36 retract into the shifting tool 30 to minimize annular obstruction, as well as reducing erosion thereto caused by wellbore fluids including fracturing fluids.

The shifting dogs 36 can have a profile to permit axial sleeve location capabilities while enabling the dogs 36 to more easily pass over other wellbore interfaces, such as interfaces between casing sections and tools. For example, as best shown in FIG. 8B, the shifting dogs 36 can have angular shoulders 28. The tubing pressure PTP can be selected such that the hydraulically-actuated shifting dogs 36 can dynamically move radially inward and outward as the diametrical contour in the wellbore varies. When engaged with the sliding sleeve profile 18, the radial force applied to the shifting dogs 36 by tubing pressure PTP can be selected to be sufficient to retain the dogs 36 axially within the sleeve profile 18 despite axial shifting forces and radial forces generated at the interface between the dog shoulders 38 and the sleeve shoulders 20,22. The shifting dogs 36 can have leading and trailing edges between right angels or at an angle from the central axis X of the shifting tool 30 to ensure axial engagement of the dogs 36 with the sleeve profile 18 and transmission of axial forces to the sleeve 16 for shifting thereof. Should the shifting dogs 36 not full release due to some anomalous condition, the one or more or both the shifting dogs 36 and sleeve profile 18 interfaces, or one or more of the shoulders 20,22,28, can also be designed to permit axial release of the dogs 36 from the sleeve profile 18 upon application of over nominal threshold axial forces and after hydraulic actuation pressure PTP in the conveyance tubing 6 has been reduced.

Figure 9A:
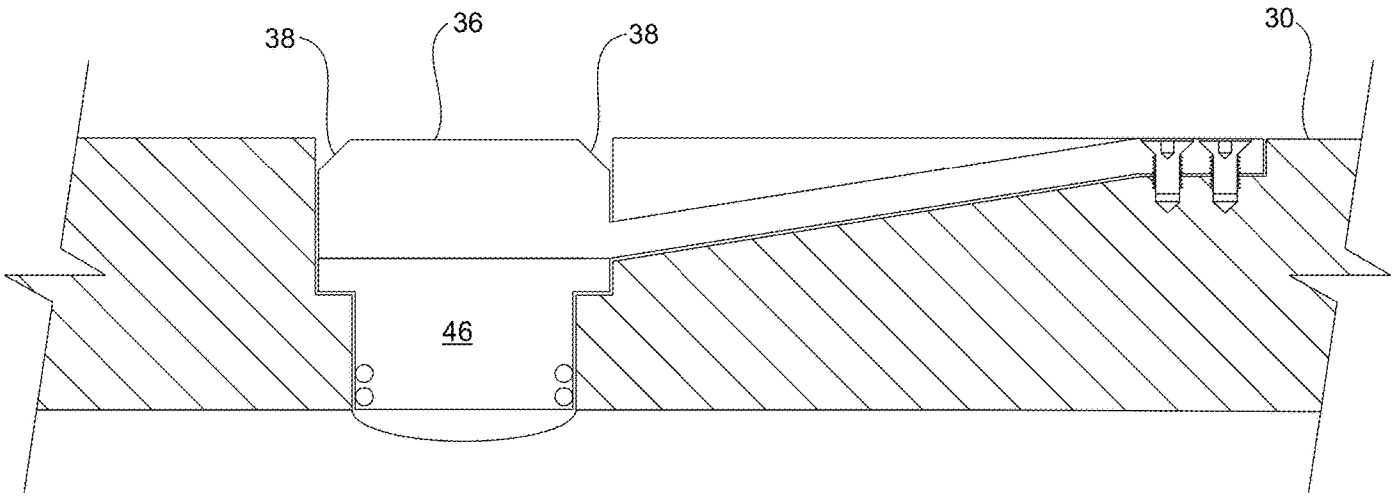
FIGS. 9A and 9B are schematic representations of partial, cross-sectional views of one embodiment of the current shifting tool's sleeve-engaging dog section, the dog of biased arm-mounted dogs actuable by radially underlying pistons for engaging the profile of a sliding sleeve.
Figure 9B:
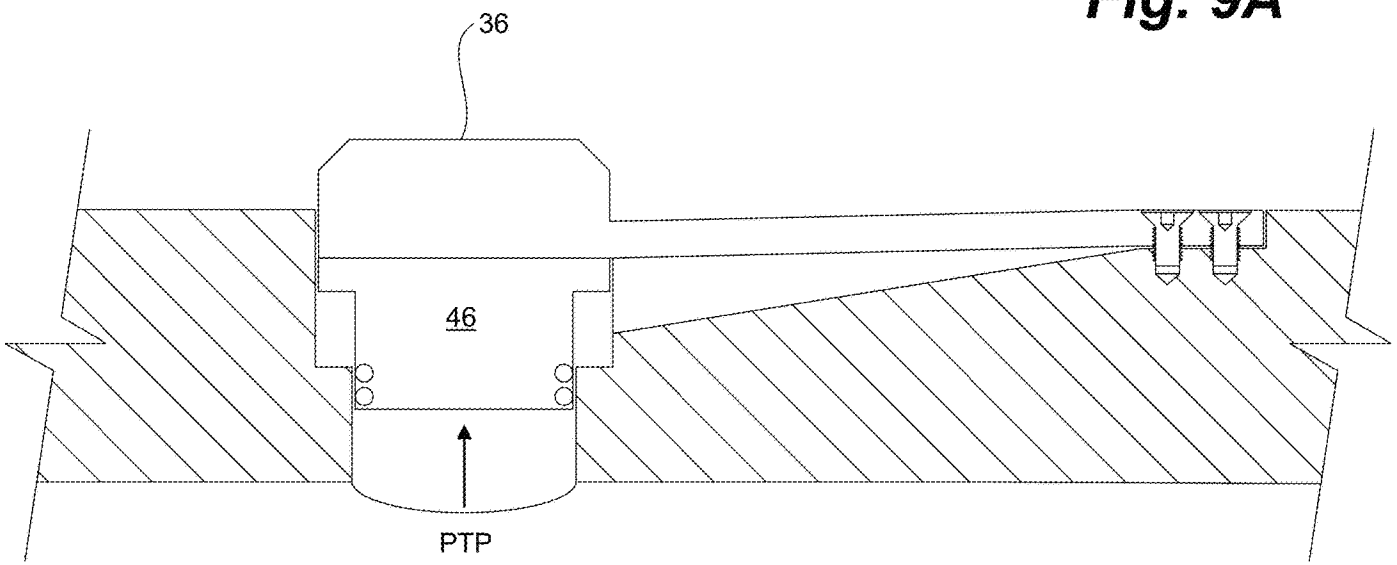

The radially actuable shifting dogs 36, such as those shown in FIGS. 8A and 8B, are subjected to large side, or axial, loads. Over time, such loads are potentially a source of wear, jamming, and failure. In an embodiment, as shown in FIGS. 9A and 9B, axially pinned, cantilevered dogs 36 can be used in conjunction with radially extending pistons 46, thereby separating the axial loads experienced by the dogs 36 from the radial forces produced by the pistons 46. In embodiments, the shifting dogs 36 can be leaf springs that are biased radially inward. Such radially inward bias can be overcome by tubing pressure PTP applied to the radially underlying pistons 46 to drive the shifting dogs 36 radially outwards, such as to engage the profile 18 of a sliding sleeve 16.

Figure 10A:
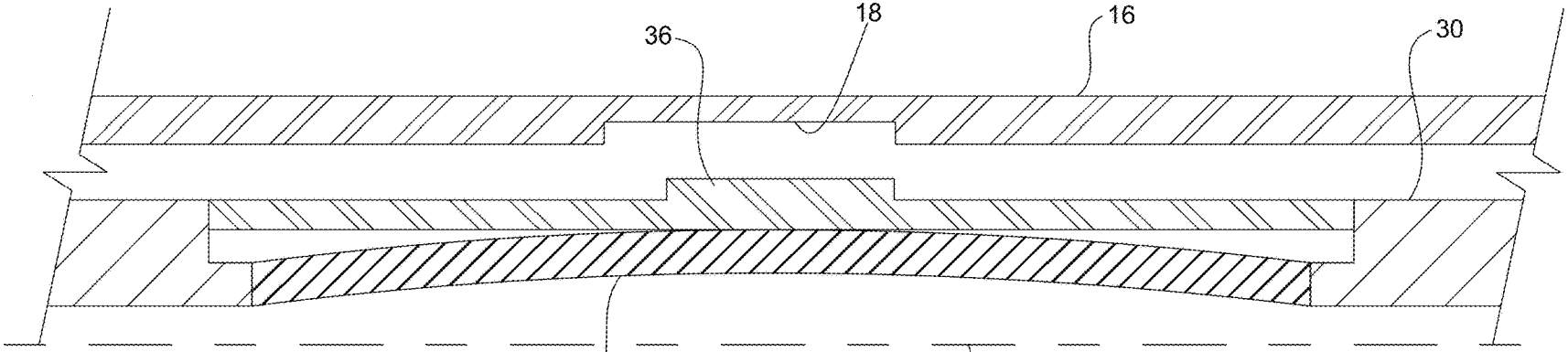
FIGS. 10A and 10B are schematic representations of partial, cross-sectional views of one embodiment of the shifting tool's sleeve-engaging dog section, the leaf-spring mounted dogs being biased radially inwardly and actuable radially outwards by a radially underlying hydraulically inflatable bladder for engaging the profile of a sliding sleeve, FIG. 10A showing the dog in a radially retracted position and FIG. 10B showing the dog in a radially outwardly extending position.
Figure 10B:
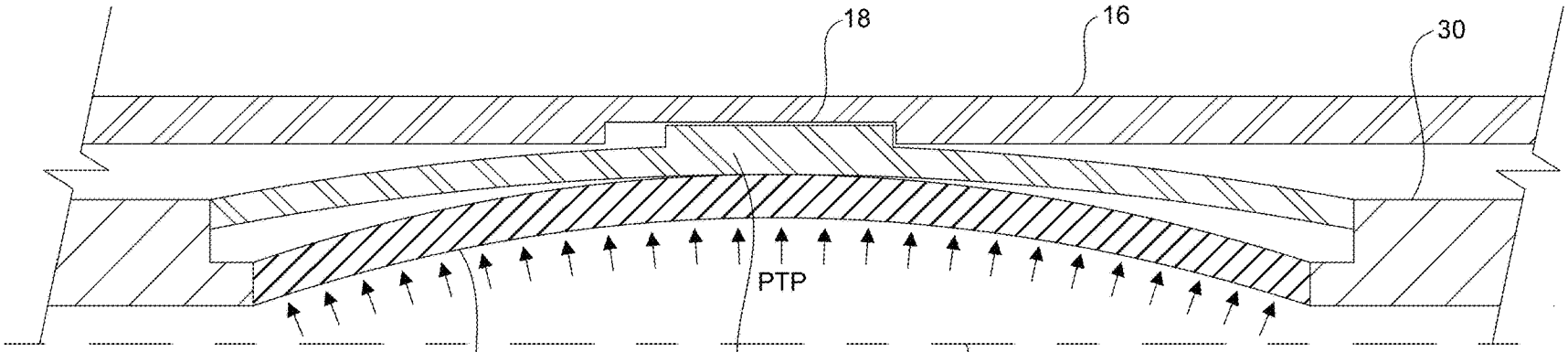

With reference to FIGS. 10A and 10B, in embodiments, the sleeve-engaging mechanism 32 can be a radially extending dog 36 located on a radially inwardly biased leaf spring 37. A bladder 47 can be located radially inwardly of the dog 36 and leaf spring 37 and be in communication with the shifting mandrel bore 42. Tubing pressure PTP can be increased to expand the bladder 47 and overcome the radially inward biasing of the spring 37 to urge the dog 36 radially outwards for locating and engaging the sleeve profile 18 of a sleeve 16.

Turning to the shifting assist mechanism 34 of the shifting tool 30, as shown in FIGS. 1A through 31, said shifting assist mechanism can be hydraulically or mechanically actuated shifting packers 44. The shifting packers 44 can be any suitable downhole inflatable packers, axially-actuated packers driven by an axial hydraulic piston, or be any other suitable packer design for enabling annular fluid pressure PANN to be used to exert an assistive downhole force on the shifting packers 44 and in turn the BHA 8 to assist with shifting a sleeve 16 downhole.

In the depicted embodiments, the shifting assist mechanism 34 is depicted as an inflatable shifting packer 44. The shifting packer 44 can be an inflatable packer 44 or an axially and hydraulically-actuated packer (for example, having reference to the shifting packer embodiment of FIGS. 28A to 29B) to provide a significant mechanical advantage and radial force against the casing 4.

Applicant has determined that a shifting packer 44, despite being engaged with the casing 4, can be shifted downhole short distances, such as that needed to shift a sleeve 16 (e.g. 3 inches), for a multiplicity of cycles, without substantial reduction in the packer's fluid-blocking effectiveness. The expanded outer diameter of the packer 44 can be varied depending on the hydraulic pressure PTP applied in the conveyance tubing 6. The expanded diameter of the shifting packer 44 can be selected to seal with the wellbore casing 4 form a pressure differential so as to enable the application of downhole force as needed, for example via fluid flow down the annulus 2, to overcome a sleeve retention force during actuation of the sleeves 16 to the open or closed positions. The sleeve retention force can be determined by elements such as sleeve-retaining detents of the sleeve 16 or sleeve housing 12 designed to release the sleeve 16 after a threshold force has been released, or by initial retention members such as shear screws used for initially maintaining the sleeves 16 in the closed position. Such assistive downhole force is useful in situations where the compressive downhole force from the weight of the conveyance tubing 6 alone is not sufficient to shift the sleeve 16 downhole.

In situations where less downhole assistive force is needed, the expanded outside diameter of the inflatable shifting packer 44 can be slightly less than the inside diameter of the wellbore casing 4 so there is some bypass flow area for sand and other debris to flow downhole past the shifting packer 44 as opposed to accumulating. The actuating pressure or the maximum OD of the inflatable shifting packer 44 (when inflated) can be selected to block the annulus 2 enough, but not completely, such that one can pump fluid down the annulus 2 with a frac pump (FP), generating and annular pressure PANN to force the shifting packer 44 and connected shifting tool 30 downhole to actuate the sliding sleeve 16.

In other embodiments, as shown in FIGS. 28A to 29B, the shifting packer 44 can be a compressive packer located between an axial stop 90 and a hydraulically actuable piston 88 controlled by tubing pressure PTP. By increasing PTP, the hydraulic piston 88 axially compresses the shifting packer 44 and radially expands it to at least partially fill the annulus 2.

Having a hydraulic shifting tool 30 independently actuable and separate from a mechanically actuated treatment tool 50 is advantageous, as the radially outward force applied by the shifting piston 46 and shifting dogs 36, and the differential pressure of the shifting assist mechanism 34, can be controlled by varying the tubing pressure PTP without the need to actuate the treatment tool 50.

Other embodiments and advantages are provided by the shifting tool 30, selector valve 70, and treatment tool 50. Using a pull up movement for locating, the selector valve 70 closes, blocking the tubing flow from uphole and enabling control of the tubing pressure PTP thereabove, with or without the abrasa-jet cutting head above the sleeve locator.

Figure 2A:
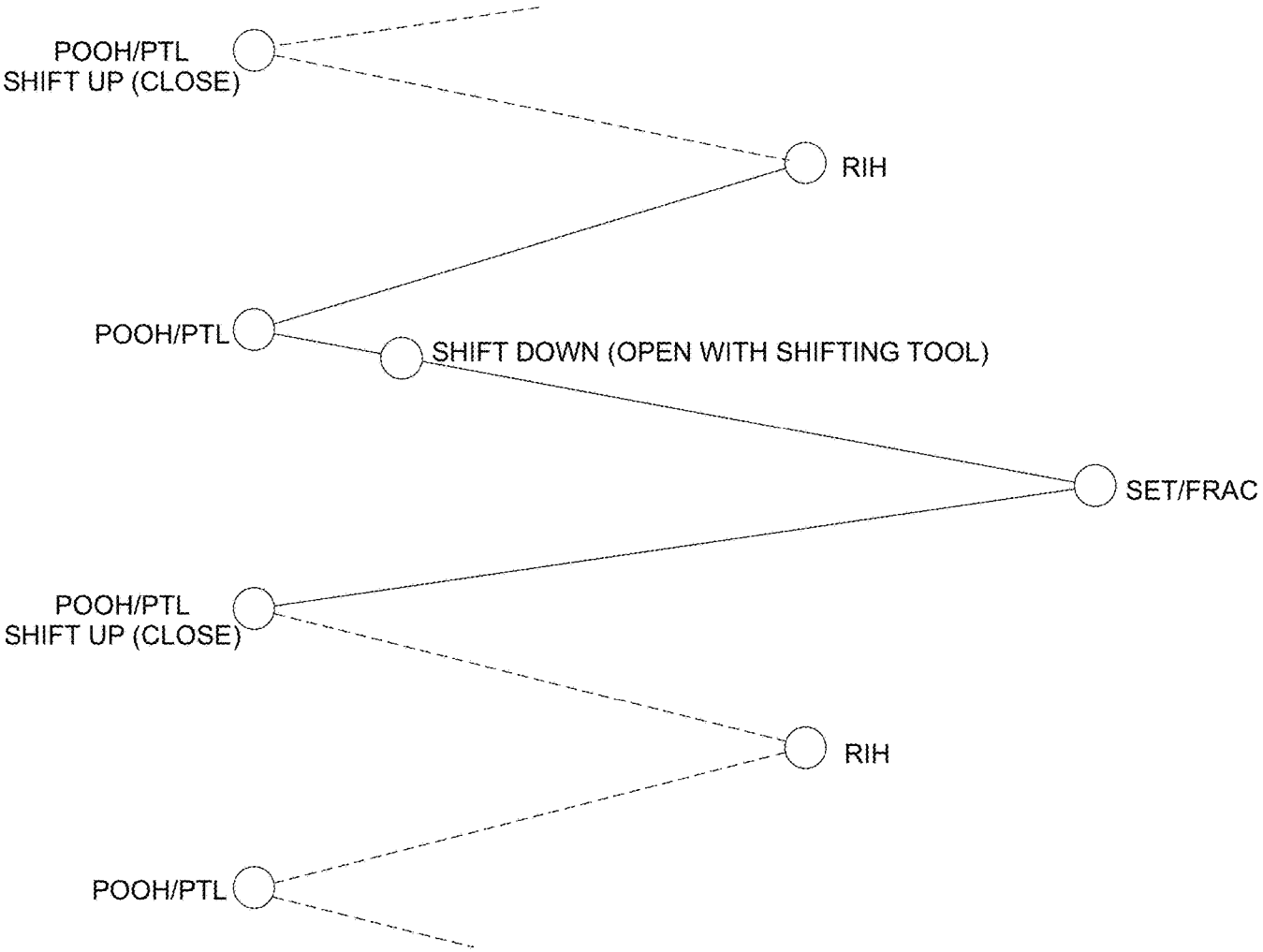
FIG. 2A is illustrative of the J-slot mechanism profile for the embodiments according to FIGS. 1A to 1F, for enabling the treatment tool to cycle between the RIH, POOH/PTL, SET, and POOH/PTL modes, and returning to the RIH mode of a new cycle.
Figure 2B:
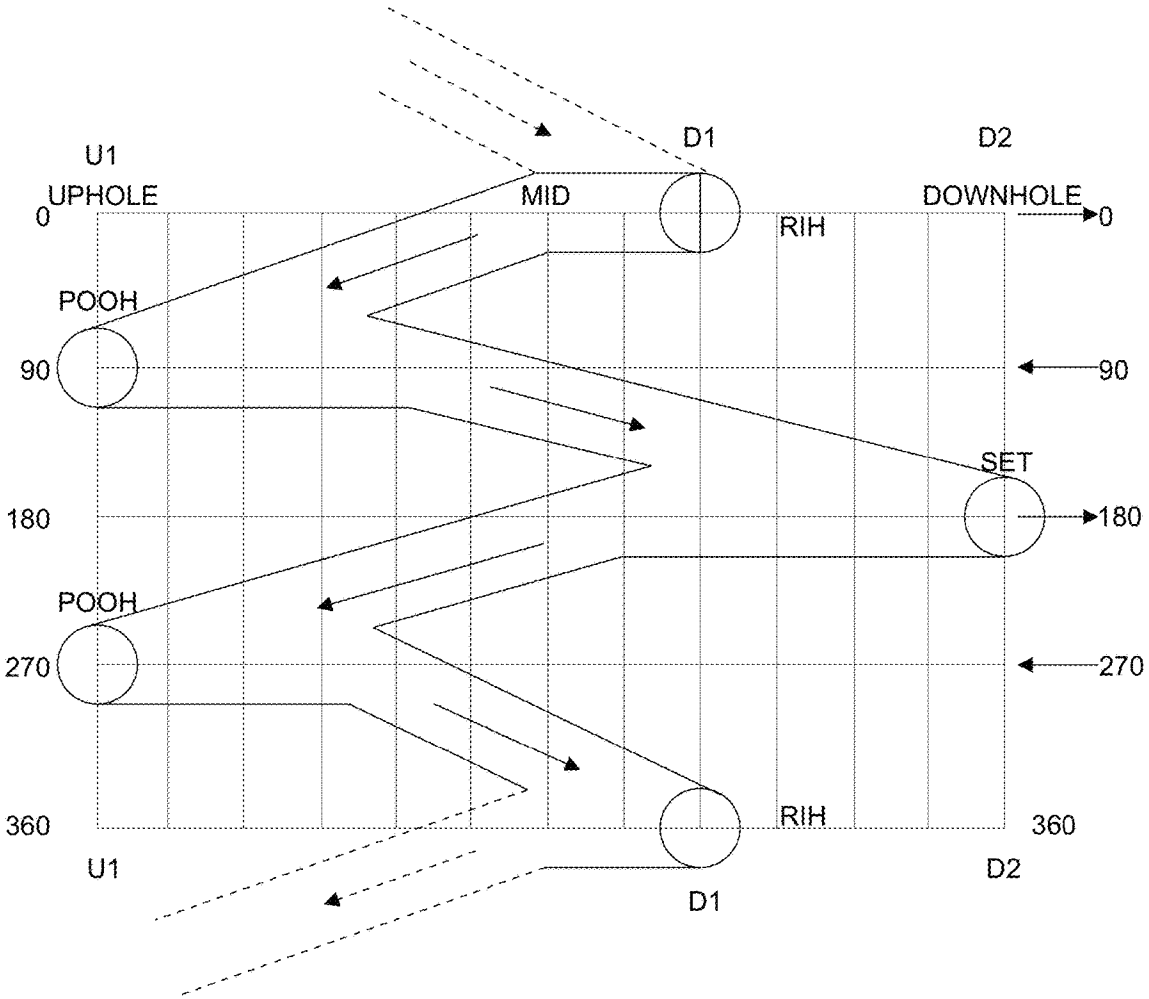
FIG. 2B is illustrative of the J-slot mechanism for the embodiments according to FIGS. 3A to 3F, for enabling the treatment tool to cycle between the RIH, POOH/PTL, SET, and POOH/PTL modes, and returning to the RIH mode of a new cycle.
Figures 3A, 3B, 3C:
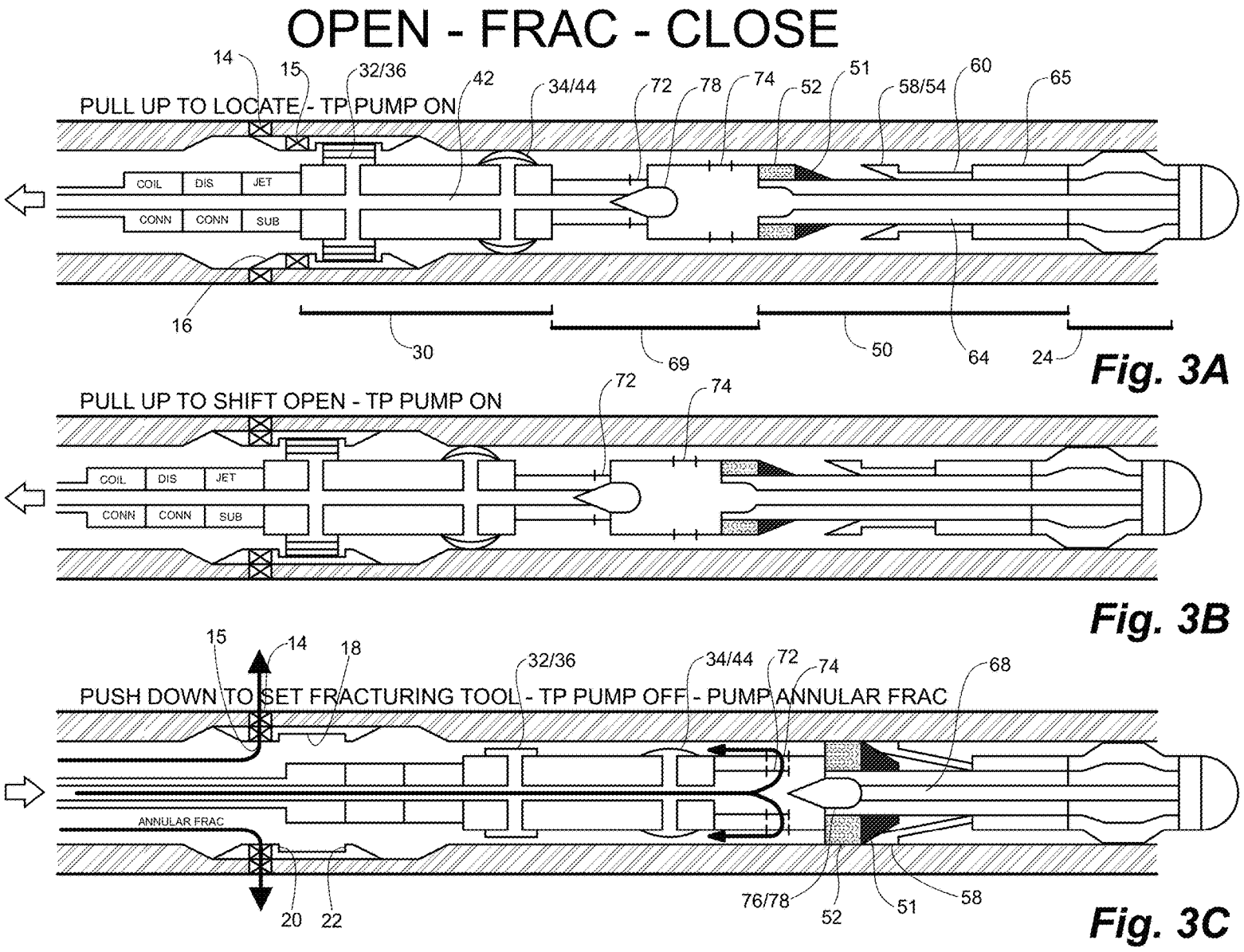
FIGS. 3A through 3I are schematic side cross-sectional views of an embodiment of the coupled shifting and treatment tools, and flow valve telescopically actuable therebetween, for use with a pull-uphole-to-open sleeve valve, FIG. 3A though 3C illustrative of the locating and opening of the sleeve valve for treatment therethrough, FIGS. 3D through 3F illustrative of a closing of the sleeve before moving to the next successive sleeve valve, and FIGS. 3G through 3I illustrating a later opening of previously closed sleeve valves.

For the pull-up-to-open scenario of FIG. 3A, when the BHA 8 is in the PTL mode, the shifting dogs 36 engage in response to increased tubing pressure PTP, allowing a coiled tubing operator to pull hard, overcome the sleeve retention mechanisms, such as detents, and open the sleeve 16. Once the sleeve 16 is open, one simply cycles the BHA 8 to the SET mode to set the treatment tool 50, which is now located in the casing 4 below the sleeve valve 10 because of the travel in the selector valve 70 and the treatment tool 50. The treatment tool 50 only sets once the shifting tool 30, and telescopic selector valve 70, collapse. The movement can be confirmed at surface with a decrease in tension in the conveyance string With reference to FIGS. 1A to 7B, the valve assembly 69 is located between the shifting tool 30 and treatment tool 50, and can be actuated between two valve modes as the shifting mandrel 40 telescopically extends and retracts from the isolation mandrel 64. In a first valve mode, the selector valve 70 of the valve assembly 69 aligns ports 72 of the shifting mandrel 40 and ports 74 of the isolation mandrel 64 to enable fluid communication between the annulus 2 and the fluid bore 42 of the shifting mandrel 40. In the depicted embodiments, the valve assembly 69 is actuated to the first valve mode when the conveyance string 6 is run in hole and the shifting mandrel 50 is telescopically retracted relative to the isolation mandrel 64. In this first valve mode, a bypass valve 76 of the valve assembly 69 is closed by inserting bypass plug 78 into a bore 68 of the isolation mandrel 64, thereby blocking bypass flow into, or out of, the isolation mandrel 64. When the isolation mechanism 52 of the treatment tool 50 is also activated, for example during treatment of the formation, the bypass plug 78 and isolation mechanism 52 work in conjunction to isolate the wellbore uphole thereof from wellbore pressure therebelow.

In a second valve mode, the selector valve 70 misaligns the ports 72 of the shifting mandrel 40 and the ports 74 of the isolation mandrel 64 for blocking fluid communication between the annulus 2 and the fluid bore 42 of the shifting mandrel 40. Further, the bypass plug 78 is removed from the bore 68 of the isolation mandrel 64, enabling flow between the wellbore and the isolation mandrel bore 68, and equalizing fluid flow and pressure uphole and downhole of the treatment tool 50. The shifting mandrel bore 42 is only in communication with the annulus 2, and thereby in communication with the isolation mandrel bore 68, when the ports 72,74 are at least partially aligned and the shifting mandrel connected plug 78 has not yet moved downhole sufficiently to seat in the isolation mandrel bore 68. Accordingly, until the ports 72,74 are at least partially aligned, pressurization of the tubing bore thereabove is maintained.

In the depicted embodiments, the valve assembly 69 is actuated to the second valve mode when the conveyance string 6 is pulled uphole and the shifting mandrel 50 is telescopically extended relative to the isolation mandrel 64.

In other embodiments, the valve assembly 69 can be actuated to the first valve mode via an uphole pull of the conveyance tubing 6 and extension of the shifting mandrel 40 relative to the isolation mandrel 64, and actuated to the second valve mode via a downhole movement of the conveyance tubing 6 and retraction of the shifting mandrel 40 relative to the isolation mandrel 64.

The selector valve 70 can be designed such that, over the short distance needed to shift the sleeve 16 between the open and closed positions using the shifting tool 30, for example about 3 inches, the selector valve 70 remains in the second valve mode, the ports remaining 72,74 remaining misaligned so as to maintain the pressure integrity of the shifting mandrel bore 42. Thus, the BHA 8 can be pulled uphole to locate the sleeve 16 with the shifting dogs 36, as described in further detail below, and then set down to shift the sleeve 16 to the open position without aligning the ports 72,74 of the selector valve 70. In this manner, the shifting mandrel bore 42 can remain pressurized to maintain the shifting dogs 36 in the radially extended position in engagement with the sleeve 16, and continue to energize the shifting packer 44 to enable annular fluid flow to be used to assist in driving the shifting tool 30 downhole to shift the sleeve 16. A larger downhole stroke actuates the selector valve 70 from the second valve mode to the first valve mode, aligning the ports 72,74 to permit flow between the shifting mandrel bore 42 and blocking the bypass flow through the isolation mandrel bore 68 with the bypass plug 78.

Turning to the treatment tool 50, as mentioned above, the isolation mandrel 64 is telescopically connected to shifting mandrel 40 at an uphole end and telescopically connected to the fracturing housing 65 at a downhole end. The shifting mandrel 40 supports resettable wellbore isolation mechanism 52, such as isolation packers, and the isolation housing 65 supports an anchor or slips 54. Drag sub 24, configured to contact the wellbore wall and provide a frictional drag force, is connected to the fracturing housing 65 to enable the isolation mandrel 64 to telescope relative to the isolation housing 65 in response to uphole and downhole actuation of the conveyance tubing 6. The mechanical telescoping of the isolation mandrel 64 in relation to the isolation housing 65 can be utilized to affect the release and setting of the wellbore isolation mechanism 52 for selectable isolation of the wellbore, and the anchor 54 for axially securing the treatment tool 50 in the wellbore during treatment.

The treatment tool 50 further comprises a cycling mechanism 56 located between the isolation mandrel 64 and isolation housing 65 for delimiting various operating modes of the treatment tool 50 and BHA 8. The cycling mechanism 56 is configured to cycle through the operating modes in response to the uphole and downhole actuation of the BHA 8 via the conveyance string 6. In an embodiment, the cycling mechanism 56 is a J-mechanism 56 acting between the fracturing mandrel 64 and fracturing housing 65. For example, the fracturing mandrel 64 can have a J-pin 56*a* extending into a J-profile 56*b* of the fracturing housing 65, the J-profile 56*b* delimiting the various operational modes of the treatment tool 50. In other embodiments, the J-pin 56*a* can be located on the fracturing housing 65 and the J-profile 56*b* in the fracturing mandrel 64.

In an embodiment, the cycling mechanism 56 can define a run-in-hole (RIH) mode and a pull-out-of-hole (POOH)/pull-to-locate (PTL) mode, wherein the isolation mechanism 52 and anchor 54 are deactivated for permitting the BHA 8 to be run into the wellbore without interference, and a SET/FRAC mode, wherein the isolation mechanism 52 and anchor 54 are activated to axially secure the treatment tool 50 in the wellbore and isolate the annulus 2 for treatment of the formation. The isolation mechanism 52 and anchor 54 are deactivated (i.e. are in the POOH/PTL mode) in both the shifting tool's sleeve locating and opening operations due to the independence of the two tools. The treatment tool 50 can be cycled through the modes defined by the cycling mechanism 56 via uphole and downhole cycling of the conveyance string 6. FIG. 2A is illustrative of an exemplary J-slot mechanism profile 56 employed the embodiments depicted in FIGS. 1A to 1F for enabling the treatment tool 50 to cycle between the modes RIH, POOH/PTL, SET, POOH/PTL, and returning to RIH, while FIG. 2B is illustrative of the same J-slot mechanism 56 during the operations depicted in FIGS. 3A to 3F. The treatment tool 50 can initially be in the RIH mode when it is run into the wellbore, then cycle to the POOH/PTL mode when the conveyance string 6 is pulled uphole to permit the shifting tool 30 to locate, engage, and shift a closed sleeve 16 to the open position. A subsequent downhole actuation of the conveyance string 6 actuates the treatment tool 50 to the SET/FRAC mode to activate the isolation mechanism 52 and anchor 54 in preparation for treatment of the formation through the opened sleeve valve 10. A further uphole pull on the conveyance string 6 actuates the treatment tool 50 to the POOH/PTL mode, for example for the shifting tool 30 to locate, engage, and close the opened sleeve 16. The cycle the repeats with the RIH mode when the conveyance string 6 is again run into the wellbore. The number and types of operational modes defined by the cycling mechanism 56 can be customized as needed to suit the operations performed by the BHA 8.

A resettable, retrievable bridge plug or seal for fracturing operations is an example of a suitable treatment tool 50 for use with the BHA 8. The bridge plug includes a cone and casing slips arrangement as the anchor 54, and a seal or packer sandwiched between the cone and a stop on the conveyance tubing as the isolation mechanism 52. The bridge plug can further utilize a J-slot mechanism 56 for delimiting the various modes, such as the four-position, repeatable cycle for setting and releasing the packers 52 and slips 54 as described above.

An example of such a bridge plug is well known in the prior art and and example of which is described in U.S. Pat. No. 5,813,456 to Milner, incorporated herein in its entirety. The bridge plug 50 includes mechanical slips and compression type elastomeric sealing packer rubbers coupled with a mechanically-operated J-slot mechanism that is cycled for locking the packer in the radially-retracted running position or the radially expanded set position. The packer has a relaxed diameter suitable for permitting an annular space between the packer body and the wall of the casing for permitting fluid to flow by the bridge plug as it travels in and out of the wellbore in the running position, yet the diameter has a sufficiently close tolerance to the casing for preventing extrusion of the packer when actuated to the set position and exposed to high differential pressure such as during fracturing operations. An equalizing valve is also provided for equalization of pressure uphole and downhole of the packer before the tool is released and providing a bypass path for fluid travelling in and out of the wellbore for faster running of the tool in and out of the casing 4.

Conventional resettable bridge plugs and seals utilize packers and slips that are closely arranged and operational only within small ranges of movement. Therefore, such bridge plugs remain vulnerable to adverse downhole conditions and may be susceptible to inadvertent actuation when the shifting tool 30 and conveyance tubing 6 moves a short distance, such as during shifting of a sleeve valve 10. As hydraulic fracturing is inherently related to producing a sand-laden environment, treatment tools have been adapted for minimizing sand accumulation.

Figure 4A:
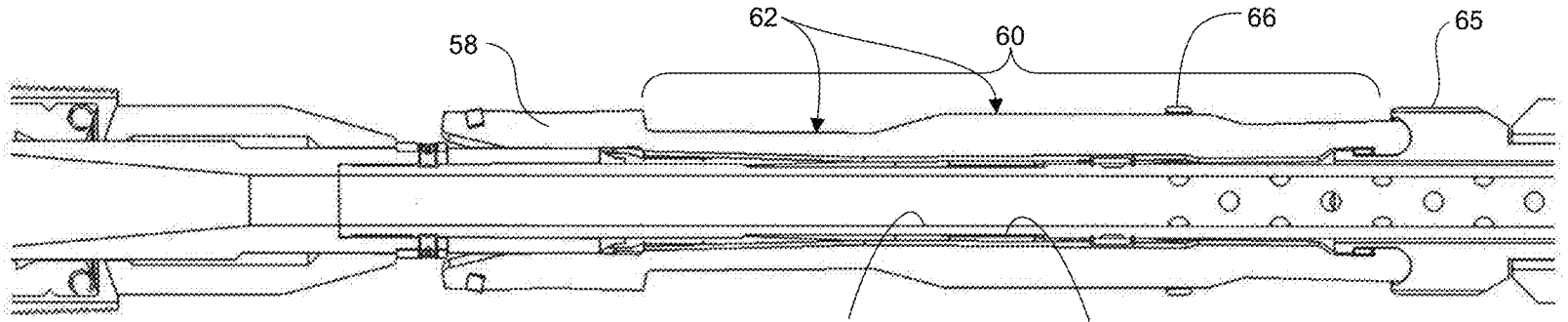
FIGS. 4A through 4C are cross-sectional views of a bottomhole assembly (BHA) of the prior art according to Applicants application published as US20170058644A1 on Mar. 2, 2017, the entirety of which is included herein by reference, the shifting tool comprising dogs at ends of radially controllable, circumferentially spaced support arms. The figures illustrate various arm and tool orientations related to running in an out of hole, outward biasing of the tool for locating and positioning purposes, and lastly for forcibly engaging a sleeve profile or casing.
Figure 4B:
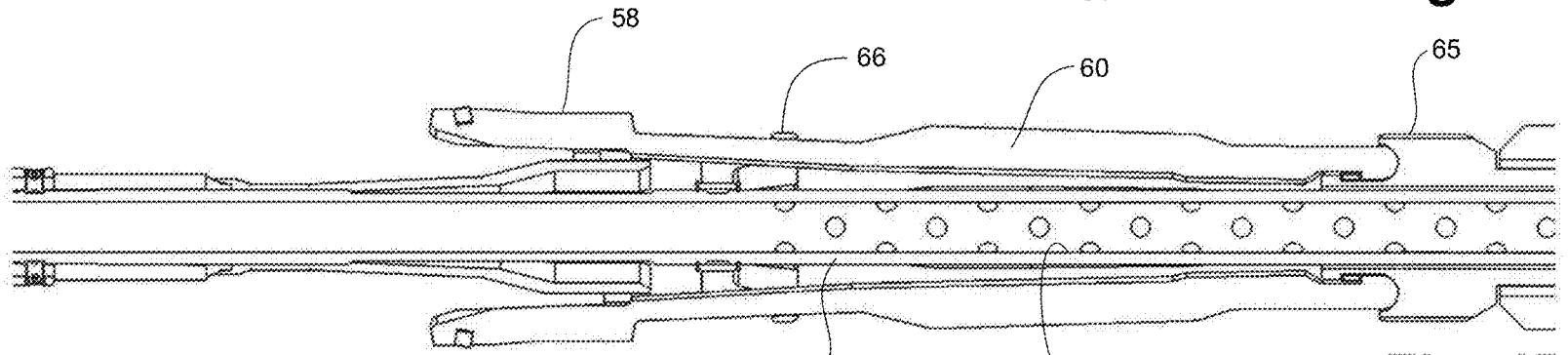
Figure 4C:
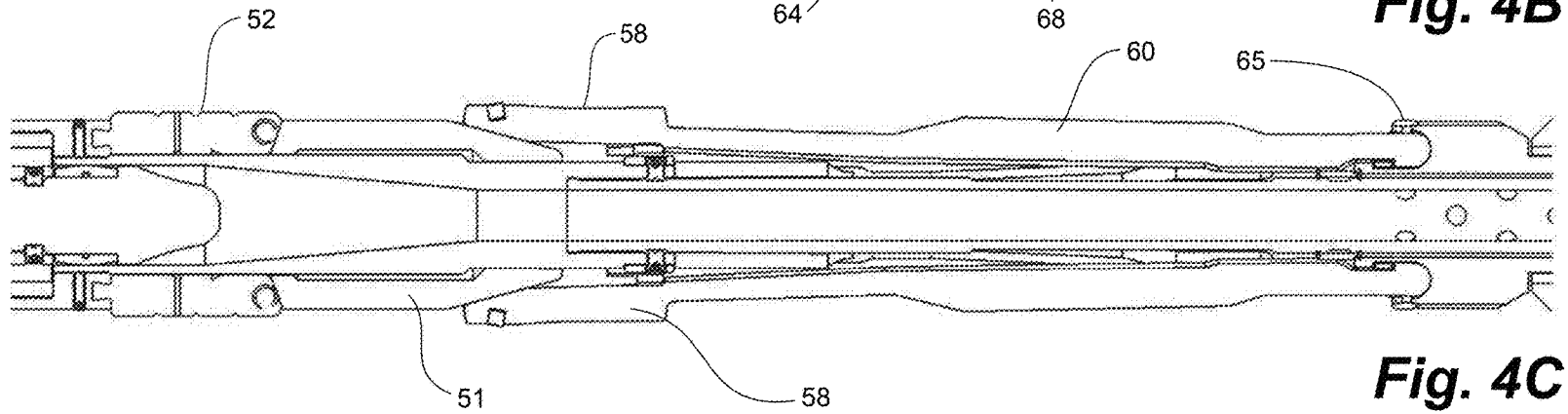

With reference to FIGS. 4A through 4C, and according to Applicant's application published as US20170058644A1 on Mar. 2, 2017 (the '644 application), incorporated herein in its entirety, a BHA of the prior art illustrates another suitable shifting and treatment tool for use as a treatment tool 50 of the present BHA 8 that is operable in the sand-laden environments. The shifting and treatment tool disclosed in the '644 application comprises an isolation mandrel 64 connected at an uphole end to the conveyance tubing 6 and telescopically connected with an isolation housing 65 toward a downhole end. As described therein, the isolation tool is capable of locating and engaging an annular profile 18 of a sliding sleeve 16, shifting the sleeve 16, and setting in casing 4 of the wellbore for fracturing the formation through the opened sleeve 16. The isolation housing 65 supports dogs 58 located at ends of radially controllable and circumferentially spaced support arms 60 pivotably mounted on the isolation housing 65. The dogs 58 and arms 60 act as the anchor device 54 of the tool 50 and replace the conventional slips of bridge plugs, providing improved sand tolerance relative thereto. Further, the arms 60 and dogs 58 can be manipulated radially for selectable location and actuation of a sleeve 16.

An isolation packer 52 and dog-actuating cone 51 are supported on the isolation mandrel 64 and move axially relative to the isolation dogs 58 and arms 60 supported on the isolation housing 65 when the isolation mandrel 64 is telescopically actuated in relation to the isolation housing 65. The isolation packer 52 can be located between an annular stop and the cone 51 such that the packer 52 is energized when the cone is driven into the arms 60 in the SET/FRAC mode. Additionally, the isolation mandrel 64 can have an arm-restraining mechanism 66 such as a ring or spider for restraining the arms 60 and dogs 58 radially inwardly when the treatment tool 50 is in the RIH and POOH modes.

The arms 60 and supported dogs 58 can be outwardly biased by springs, and the radial position thereof can be forcibly manipulated according to the operational mode of the tool. Such forcible manipulation includes radially inward restraint of the arms 60 and dogs 58 using the restraining mechanism 66, overriding the biasing, for running the tool 50 in and out of hole in the RIH and POOH modes, and radially outward restraint using the cone 51 to lock the dogs 58 radially outwardly, for example to lock the dogs 58 in engagement with a sleeve profile 18 or to use the dogs 58 as slips to anchor the tool in the wellbore casing 4. The unrestrained, radially outwardly biased configuration of the arms 60 and dogs 58 can be used to drag the dogs 58 along the casing 4 to locate a sleeve profile 18. The manipulation of the arms 60 dogs 58 between the various radial positions is achieved using up and downhole movement of the isolation mandrel 64 relative to the isolation housing 65, and the interaction of the restraining mechanism 66 with a cam 62 of the arms 60. The cam 62 has a varying radial profile for determining the radial position of the arms 60 and dogs 58 depending on the position of the restraining ring 66 thereabelong.

The axial position of the isolation mandrel 64 relative to the isolation housing 65 is controlled by a J-slot mechanism 56 located therebetween. The '644 application describes various arm and tool orientations related to the various operational modes of the tool as delineated by the J-slot mechanism 56. In the tool shown in the '644 application, the J-slot profile 56*b* of the treatment J-slot mechanism 56 delineates four distinct positions corresponding to four operational modes of the tool. Specifically, with reference to FIG. 4A, the dogs 58 and arms 60 are restrained radially inwardly in a running-in-hole (RIH) and pull-out-of-hole (POOH) mode to permit the tool to respectively travel downhole and uphole unhindered. Turning to FIG. 4B, the dogs 58 and arms 60 are radially outwardly biased when the tool is in a pull-to-locate (PTL) mode for locating a sleeve valve 10 with the dogs 58 and for positioning purposes. Lastly, in a SET/FRAC mode, as shown in FIG. 4C, the dogs 58 are driven radially outwards with the cone 51 for forcibly engaging a sleeve valve 10 or the casing 4, and the packer 52 is compressed between the cone 51 and the radially outwardly extending stop of the isolation mandrel 64 such that it expands radially outwards to seal the annulus 2.

An additional advantage of the arm-and-dog arrangement of Applicant's isolation tool 50 of the '644 application over bridge plug-like tools is that the open flow space in the annulus between the tool 50 and casing 4 is significantly larger and less susceptible to sand and debris-related problems.

As stated, Applicant's isolation tool disclosed in the '644 application is suitable for use as a treatment tool 50. As described above, the dogs 58 can be used to act as slips in casing 4 so as to anchor the tool 50 anywhere in the completions string 4. This is also useful where the BHA 8 includes an optional abrasajet sub uphole of the shifting tool 30, wherein the treatment tool 50 can be set anywhere in the completion string 4 and fluid introduced into the tubing 6 and out the abrasajet sub to cut ports in the string 4. Such perforating operations can be performed where a sleeve valve 10 has failed, or where no sleeve valve 10 was placed in the area in the original well design. Further, insert-equipped dogs 58 enable setting of the treatment tool 50 below a sleeve valve 10 to pressure test the sleeve valve 10, such as to confirm closure thereof. The isolation packers 52 of the tool continue to be used to isolate the annulus 2 during fracturing.

Herein, the Figures of 4A through 7B represent one embodiment of the tool disclosed in the '644 application adapted for use as the treatment tool 50 of the current BHA 8. In an embodiment, the tool 50 can be configured to be actuable between RIH and POOH/PTL modes, wherein the dogs 58 and arms 60 are restrained radially inwardly to permit the treatment tool 50 to axially travel uphole or downhole unhindered, and a SET mode wherein the dogs 58 are driven radially outward by the cone 51 and the fracturing packer 52 is expanded to seal the annulus 2. The POOH/PTL mode are combined as the sleeve-engaging mechanism 32 of the shifting tool 30 is used to locate the sleeve valve of interest 10 as opposed to the dogs 58 of the treatment tool 50. When used with the shifting tool 30, the arms 60 and dogs 58 of the treatment tool 50 do not need to be radially outwardly biased, as they are not used for locating and positive engagement with the sleeve profiles 18.

FIGS. 5A and 5B illustrate the tool 50 taught in the '644 application adapted as a treatment tool 50 according to FIGS. 4A to 4C, in which the fracturing packer 52 and cone 51 have axially engaged the arms 60 and dogs 58, shown as being set in the casing 4 in the SET/FRAC mode between successive axially-spaced sleeve valves 10. The enlarged view of FIG. 5B illustrates the relationship between the dogs 58/arms 60, cone 51, and axially compressed, radially expanded fracturing packer 52 in the casing 4. The valve assembly 69 is in the first valve mode, wherein the selector valve's annular ports 72,74 are aligned to permit tubing flow between the shifting mandrel bore 42 and annulus 2, such as to flow fracturing fluid from the conveyance tubing 6 to the annulus 2. The bypass valve 76 is closed such that pressure above the packers 52 and bypass plug 78 is isolated from wellbore pressure.

Figure 6A:
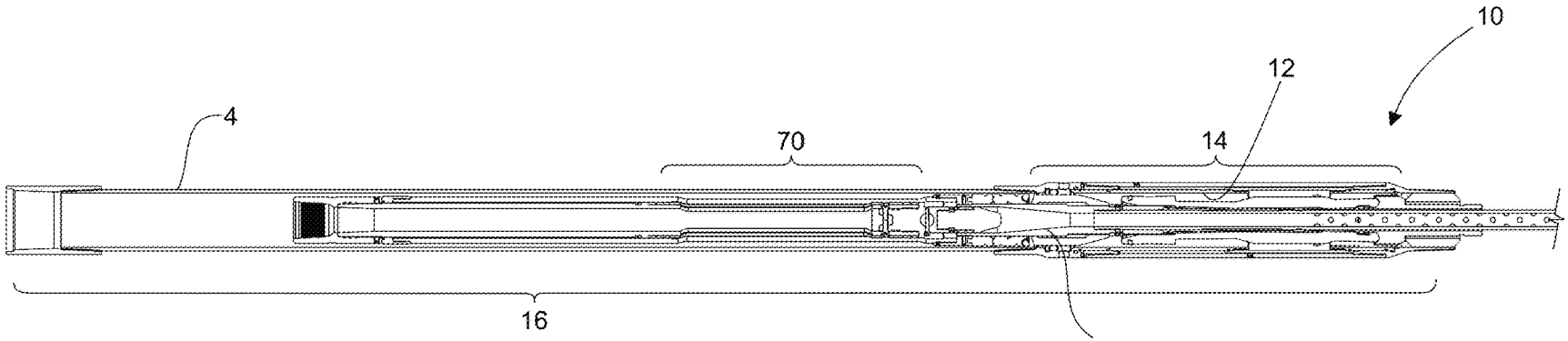
FIGS. 6A and 6B illustrate the BHA according to FIGS. 4A through 4C, as the tool is run-in-hole through a sleeve valve, the flow valve's annular ports aligned to permit tubing flow to the annulus, such as when the packer is set to the wellbore, and the bypass port closed for blocking downhole or equalization flow from the annulus and downhole through tool.
Figure 6B:
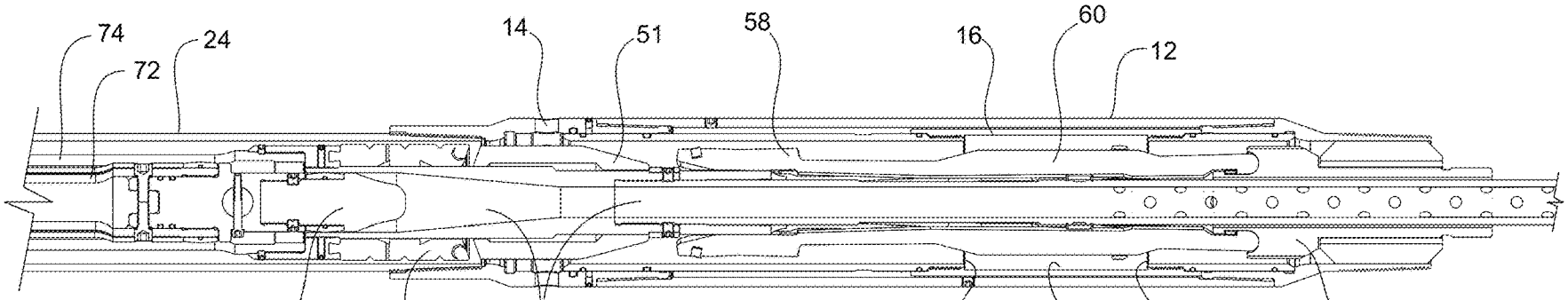

FIGS. 6A and 6B illustrate the treatment tool 50 as it is run-in-hole in the RIH mode through a sleeve valve 10 to position the shifting tool 30 downhole thereof. The valve assembly 69 is in the first valve mode, wherein the selector valve's annular ports 72,74 aligned to permit tubing flow between the shifting mandrel bore 42 and annulus 2. The J-slot mechanism 56 prevents the isolation mandrel 64 from retracting into the isolation housing 65 far enough for the cone 51 to engage and drive the arms 60 or compress the fracturing packer 52. The bypass plug 78 is seated in the isolation mandrel bore 68 to close the tool bypass, in effect closing the bypass valve 76 for blocking downhole or equalization flow from the annulus 2 and downhole through the tool 50.

Figure 7A:
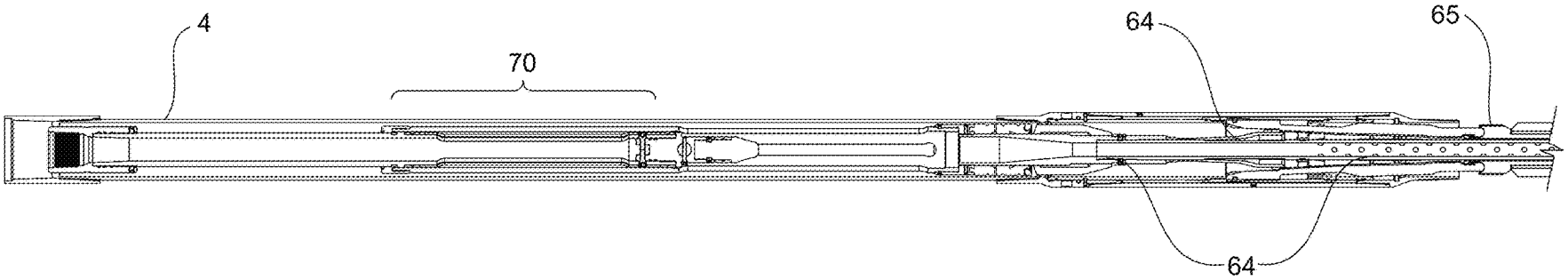
FIGS. 7A and 7B illustrate the tool as it is pulled uphole with the flow valve's annular ports misaligned to block tubing flow to the annulus, and the bypass ports open for equalization flow between the tool and the annulus.
Figure 7B:
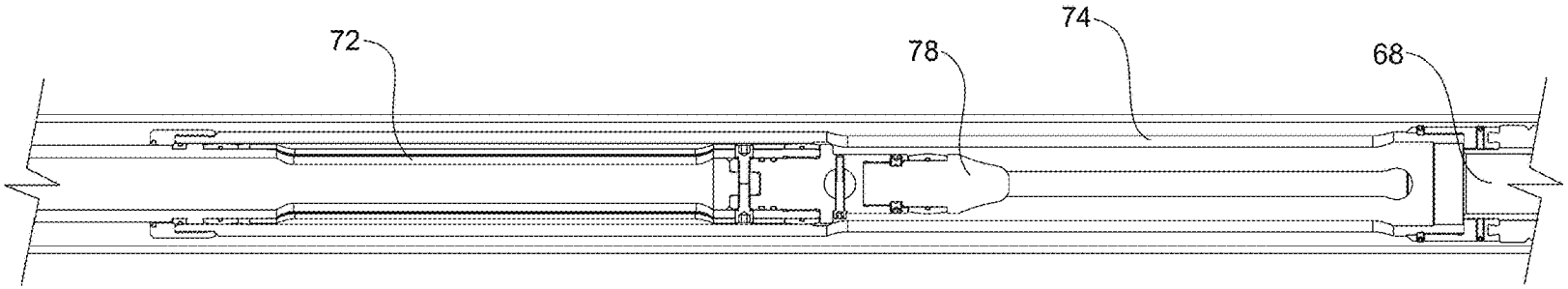

FIGS. 7A and 7B illustrate the treatment tool 50 as it is pulled uphole in the POOH mode. The dogs 58 and arms 60 of the tool 50 are restrained radially inwardly. The valve assembly 69 is in the second valve mode, with the selector valve's annular ports 72,74 misaligned to block flow between the shifting mandrel bore 42 and the annulus 2. The bypass valve 76 is open, i.e. the bypass plug 78 is clear of the isolation mandrel bore 68, for permitting equalization flow between the isolation mandrel bore 68 and the annulus 2. Therefore, when the treatment tool 50 is in the POOH mode, the shifting bore mandrel 42 and conveyance tubing 6 can be pressurized to increase tubing pressure PTP and activate the sleeve-engaging mechanism 32 and shifting assist mechanism 34 of the shifting tool 30.

Operation—Downhole-to-Open Sleeve Valves

With reference to FIGS. 1A to 11, an embodiment of an improved BHA 8 having coupled shifting and treatment tools 30,50, and a valve assembly 69 telescopically actuable therebetween, is used to open sleeve valves 10 located along a wellbore. In the depicted embodiment, the sleeves 16 of the sleeve valves 10 are configured to be shifted downhole to the open position to expose the ports 14, and shifted uphole back to the closed position to block the ports 14. FIG. 1A though 1C are illustrative of the locating and opening of a sleeve valve of interest 10 by the BHA 8 for treatment therethrough. FIGS. 1D through 1F are illustrative of the closing of the sleeve valve of interest 10 by the BHA 8 before moving to the next successive sleeve valve of interest 10. FIGS. 1G through 1I illustrate a later opening of previously closed sleeve valves 10 using the BHA 8.

With reference to FIG. 1A, a wellbore is illustrated, an axial portion of which includes a sleeve valve 10 incorporated along the wellbore casing 4, the sliding sleeve 16 thereof axially slidable in a sleeve housing 12. The sleeve 16 is shown in the closed position to cover the treatment ports 14 of the housing 12. The BHA 8, attached to the conveyance tubing 6, such as coiled tubing (CT), is initially run-in-hole to a location downhole of the sleeve valve 10 of interest, the treatment tool 50 being in the RIH mode. After the BHA 8 has been lowered to the desired depth it can be pulled uphole to locate the sleeve valve of interest 10. As shown in FIG. 7A, the selector valve 70 of the BHA 8 is actuated to the second position by the uphole pull on the BHA 8, such that the ports 72,74 are misaligned and the bypass plug 78 is clear of the isolation mandrel bore 68. A treatment or TP pump in communication with the bore of the conveyance string 6 and the shifting mandrel bore 42 is turned on to radially extend the shifting dogs 36 and the hydraulically-actuated shifting packer 44 of the shifting tool 30. The shifting dogs 36 are urged radially outward to engage the inner wall of the wellbore casing 4. The conveyance tubing 6 and BHA 8 can continue to be pulled uphole, the treatment tool 50 being actuated to the POOH/PTL mode, wherein the fracturing packer 52 and anchor 54 are not engaged with the wellbore for unhindered movement of the BHA. The shifting tool dogs 36 run along the casing wall until the dogs 36 have engaged the sleeve profile 18 of the sleeve valve of interest 10, thereby locating the sleeve 16. As described above, the shifting dogs 36 passively follow and pass by wellbore interfaces, including casing and tool joints and the sleeve and sleeve housing gaps uphole and downhole of the sleeve 16 itself. The axial length of the shifting dogs 36 and sleeve profile 18 are compatible to engage with each other, whilst the other encountered interfaces are not and are therefore passed over by the shifting dogs 36. Such compatibility can be achieved by selecting an axial length of the sleeve profile 18 to generally correspond to the axial length of the dogs 36, and to be significantly greater than the length of any of the above interfaces that the shifting dogs 36 are not intended to engage with.

In an embodiment, the TP pump can first be operated at a first flow rate so as to enable the shifting dogs 36 to ride along the wellbore to locate the length of annular gap that corresponds with the sliding sleeve profile 18. This first rate is a flow rate that generates the pressure needed to radially extend the shifting dogs 36 and locate the sleeve profile 18. The shifting dogs 36 "float" radially on the sleeve-engaging mechanism 32, the dogs 36 being continuously pushed radially outwardly by the tubing pressure PTP to seek the sleeve profile. At the first flow rate, a first pressure is generated, and the shifting dogs exert a first dog force acting radially against the full drift of the wellbore casing. As the shifting dogs are urged radially outward by a stored energy initiated by a hydraulic force, an increase in wellbore diameter will urge the dogs farther radially outwards, even at modest radial forces. This first dog force is a compromise between effective sleeve profile engagement versus the drag and wear-related issues on the dog's face.

In an embodiment, and depending on the configuration of the sleeve profile 18 and shifting dogs 36, the first flow rate may correspond with sufficient radial first dog force to also enable shifting of the sleeve 16, and if so, the operator would have to consider the disadvantage of swabbing by the shifting packer 44 during extended BHA movement.

In a preferred embodiment, a second, higher flow rate, second tubing pressure PTP, and second dog force, is applied after the sleeve profile 18 has been engaged to produce additional actuating force to securely retain the shifting dogs 36 in radial engagement between the profile shoulders 20,22 during axial shifting. As an optional release angle of the profile shoulders 20,22 departs further from 90 degrees, the second dog force would be selected to be correspondingly higher to resist camming out of the shifting dogs 36 from the profile 18. The second tubing pressure can also be used to sufficiently expand the shifting packers 44 to manage or prevent fluid leakage and thereby enable fluid force in the annulus 2 to aid or effect downhole hydraulic force on the BHA 8 to assist with shifting the sleeve 16 downhole. For example, the first fluid rate could be about 300 liters/min or provide a tubing pressure of about 600 psi and, if needed, a second rate could be 600 liter/min or provide a tubing pressure of 2400 psi. In other embodiments, the shifting tool 30 can be operated at a single flow rate and tubing pressure, for example 500 liters/min, that enables both sleeve location and shifting, as well as sufficient expansion of the shifting packer 44. Note that in another embodiment, as described below starting at FIG. 12A, flow orifices can be provide to manage the flow rate and resulting generated pressures. As discussed in the embodiment of FIGS. 18A-18C, having engineered orifices for BHA RIH operations and sleeve-shifting operations, first flows of 300 liters/min can result in a first pressure of 500 psi, and second flows of 600 liters/min can result in pressures of 1000 psi.

When the shifting dogs 36 engage the sleeve profile 18, the shifting tool's packer section 34, being physically spaced downhole from the sleeve-engaging mechanism 32, is located in the wellbore casing 4 downhole of the sleeve valve 10.

In FIG. 1B the BHA 8 affects the opening of the sleeve valve 10, the BHA 8 being urged downhole by the weight of the conveyance string 6 as well as optional downhole annular fluid flow acting on the shifting packer 44, and the shifting dogs 36 correspondingly shift the sleeve 16 downhole to the open position to expose the treatment ports 14. The TP pump directs fluid flow down through the conveyance string 6 to the BHA 8 to maintain tubing pressure PTP in the shifting mandrel bore 42 and continue to drive the shifting dogs 36 into the sleeve profile 18 to retain the dogs 36 therein during shifting of the sleeve 16. The tubing pressure PTP can also be brought to a level sufficient to energize the shifting packer 44 so as to constrict and substantially block the annulus 2. The annular fluid pressure PANN on the energized shifting packer 44 applies a hydraulic force in the downhole direction to drive the BHA 8 downhole, assisting the downhole weight of the tubing string 6. The shifting dogs 36 continue to be urged into the sleeve profile 18 by tubing pressure PTP in the shifting mandrel bore 42 and maintain engagement with the sliding sleeve 16 as it is shifted downhole to the open position. The shifting packer 44 will slide a short distance along the casing 4 as the sleeve 16 opens, for example several inches. The inner and outer ports 72,74 of the selector valve 70 remain misaligned in the short axial shifting stroke so as to maintain fluid pressure PTP within the fluid bore 42 and keep the shifting dogs 36 and shifting packer 44 activated. The bypass plug 78 can remain spaced from the isolation mandrel bore 68 and maintain an open isolation mandrel bore 68 therethrough in communication with the annulus.

The forces applied by the TP pump to actuate the sleeve-engaging mechanism 32 and sleeve 16, together with the downward compression on the tubing string 6, may be sufficient to shift the sleeve 16 to the downhole open position without utilizing the annular fluid pumps to assist. In embodiments of the BHA 8 having a jet tool located uphole of the shifting tool 30, the fluids exiting the jet nozzles of the jet tool to the annulus 2 apply fluid pressure and a downhole shifting force to the expanded shifting packer 44. The shifting packer 44 remains robustly engaged due to the tubing pressure PTP being greater than annular pressure PANN as there is a large pressure drop across the jet nozzles of the jet tool.

Depending on the sleeve valve manufacturer's specifications, a relatively high initial opening force may be required to overcome the retaining force of shear screws or other sleeve retaining mechanisms of the sleeve valve 10. In such situations, the TP pump rate can be increased as needed to actuate the shifting packer 44 and the annular pump FP can send fluid flow downhole in the annulus 2 to apply an assistive downhole shifting force to the shifting packer 44. In embodiments without a jet tool, there is no fluid exit path and the TP pump can be run to achieve the desired tubing pressure PTP in the fluid bore 42 and then shut off or idled.

FIG. 1C illustrates the BHA 8 having been actuated downhole to cycle the treatment tool 50 to the SET/FRAC mode. The wellbore downhole of the opened sleeve valve 16 is blocked by the treatment tool 50, and the TP pump can be turned off (or idled for pressure balancing) to radially retract the shifting tool dogs 36 and shifting packer 44. The downhole movement of the shifting mandrel 40 relative to the isolation mandrel 64 actuates the selector valve 70 to the first valve mode to align and open the ports 72,74 and engage the bypass plug 78 with the isolation mandrel bore 68 to isolate the bore 68 downhole thereof. The wellbore isolation mechanism 52 of the treatment tool 50 is expanded to isolate the annulus 2 when the tool 50 is actuated to the SET/FRAC mode. The cycling of the treatment tool J-slot mechanism 56 and setting SET of the isolation mechanism 52 can also result in the BHA 8 moving downhole of the opened sleeve valve 10. The annular or frac pump FP can then be turned on for annular fracturing through the open sleeve ports 14. The TP pump can also be turned on to offset the annular pressure PANN and flow, or to supplement the annular frac flow, the fluid from the TP pump flowing downhole through the conveyance tubing 6 and into the annulus 2 through the aligned ports 72,74. As the bypass plug 58 and isolation mechanism 52 have isolated the wellbore section downhole of the treatment tool 50, the only flow path for the fluid introduced into the wellbore is into the formation via the exposed treatment ports 14 of the opened sleeve valve 10.

Figure 1D:
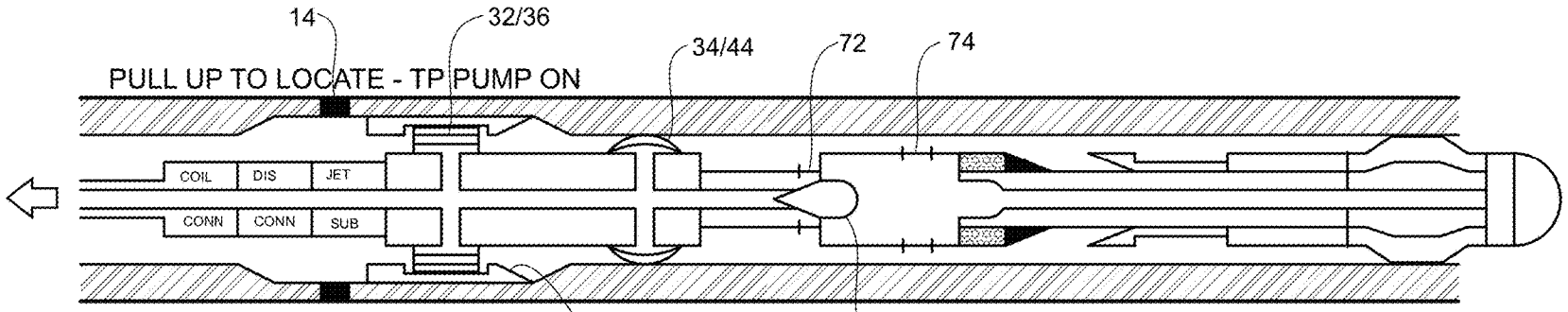

FIG. 1D illustrates an embodiment wherein, after treatment, the sleeve valve 10 is to be closed. The BHA 8 and shifting tool 30 are pulled uphole to actuate the valve assembly 69 to the second valve mode, and the TP pump is turned on to once again energize the shifting dogs 36 and shifting packer 44. The BHA 8 continues to be pulled uphole to locate and re-engage the shifting dogs 36 with the sliding sleeve 16, the shifting tool dogs 36 shown having located and engaged the opened sliding sleeve's profile 18. During the uphole pulling of the BHA 8, the treatment tool 50 is cycled to the POOH/PTL mode.

Figure 1E:
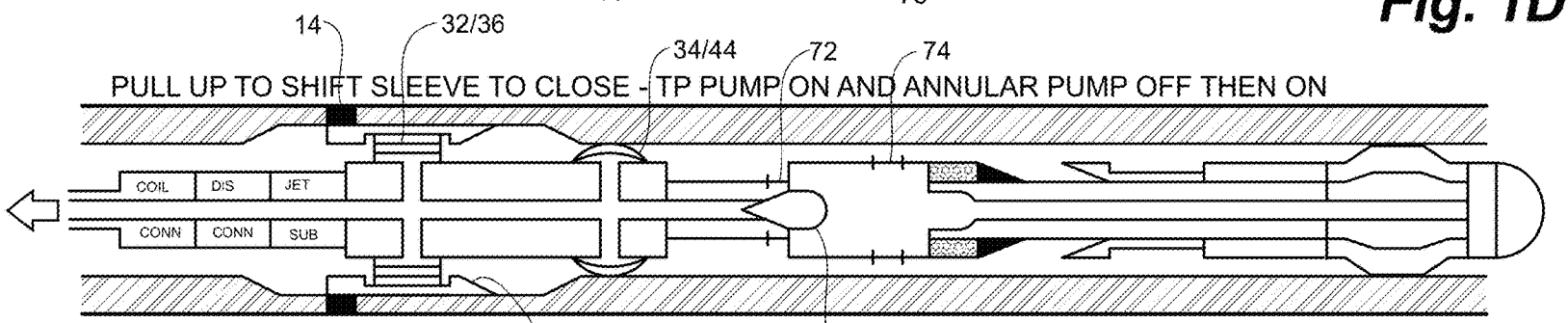

FIG. 1E illustrates the operational step after FIG. 1D wherein after re-engaging the sliding sleeve 16, a further uphole pull on the shifting tool 30 shifts the sliding sleeve 16 uphole to the closed position, such as to avoid sand returns and/or permit the formation to "reset". The treatment tool 50 remains in the POOH/PTL mode. The TP pump remains on to energize the shifting dogs 36 and drive them into the sleeve profile 18 as the shifting tool 30 shifts the sleeve 16 to the closed position. Once the sleeve valve 10 has been actuated to the closed position, the TP pump can be turned off to deactivate the shifting dogs 36 and shifting packers 44. With the treatment tool 50 still in the POOH/PTL mode, the BHA 8 can now be pulled uphole to actuate a subsequent sleeve valve of interest 10 or to surface. With reference to FIG. 2, the next lowering of the conveyance tubing 6 and BHA 8 will cycle the treatment tool 50 to the RIH mode.

Similarly, FIG. 1D also illustrates an embodiment wherein, sometime after production, with most sleeve valves 10 open, the BHA 8 can be run-in-hole to close one or more sleeve valves 10 corresponding to one or more underproductive or compromised zones. For a sleeve valve 10 to be closed, the BHA 8 is run-in-hole downhole of the identified sleeve valve 10 and the BHA 8 is pulled uphole with the TP pump turned on to locate and re-engage the shifting dogs 36 with the sliding sleeve 16. The shifting tool dogs 36 are shown as having located and engaged the opened sliding sleeve's profile 18 and the treatment tool 50 also being pulled uphole to cycle the tool 50 to the locate mode POOH/PTL. As the wellbore has many opened sleeve valves 10, the ability to use annular fluid pressure PANN to provide an assistive shifting force is compromised. Accordingly, as FIG. 1E illustrates, the operational step after FIG. 1D for closing the open sleeve 10 comprises re-engaging the sliding sleeve 16 with the shifting dogs 36 and an uphole pull on the shifting tool 30 to shift the sliding sleeve 16 to the closed position. As mechanical pulling of the shifting tool 30 is generally insensitive to fluid flow through the ports 14 of uphole intervening sleeve valves 10, the BHA 8 can be used to close the sleeve valve 10 of interest despite the open sleeve valves 10 uphole.

Figure 1F:
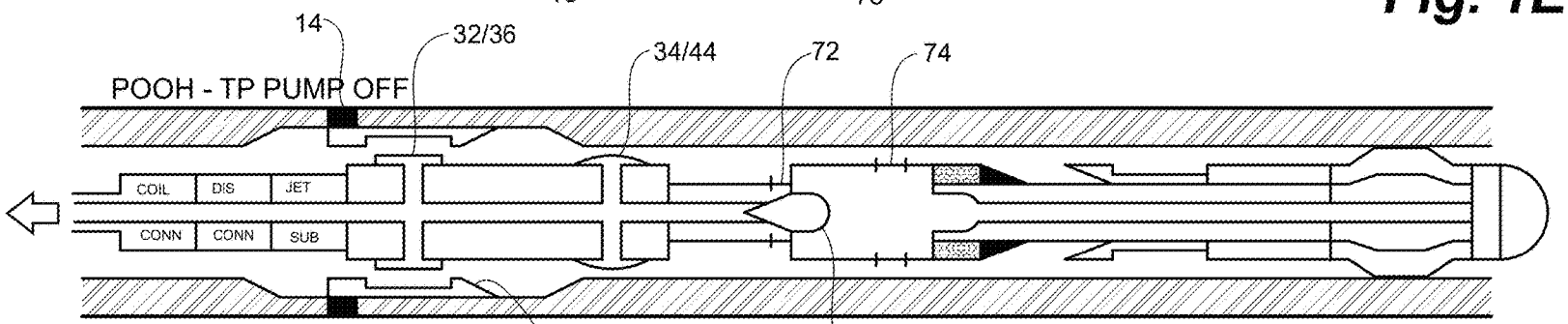

FIG. 1F illustrates the operational step after FIG. 1E wherein, after the sleeve valve is closed, the TP pump is turned off to retract the shifting tool dogs 36 and shifting packer 44, and continued uphole pull on the BHA 8 pulls both the shifting tool 30 and treatment tool 50, in the POOH/PTL mode, free of the sliding sleeve 16 to move uphole to the next successive sleeve valve 10 of interest or to surface. As the BHA 8 progresses uphole to locate and close subsequent sleeve valves 10, the treatment tool 50 remains in the POOH/PTL mode, as there is no need to cycle the conveyancing string 6 downhole. This enables the sleeve valves 10 to be closed rapidly without unnecessary cycling of the conveyancing string 6 and corresponding wear thereto. In embodiments, the treatment tool 50 can be omitted such that only the shifting tool 30 is present on the BHA 8.

Figures 1G, 1H, 1I:
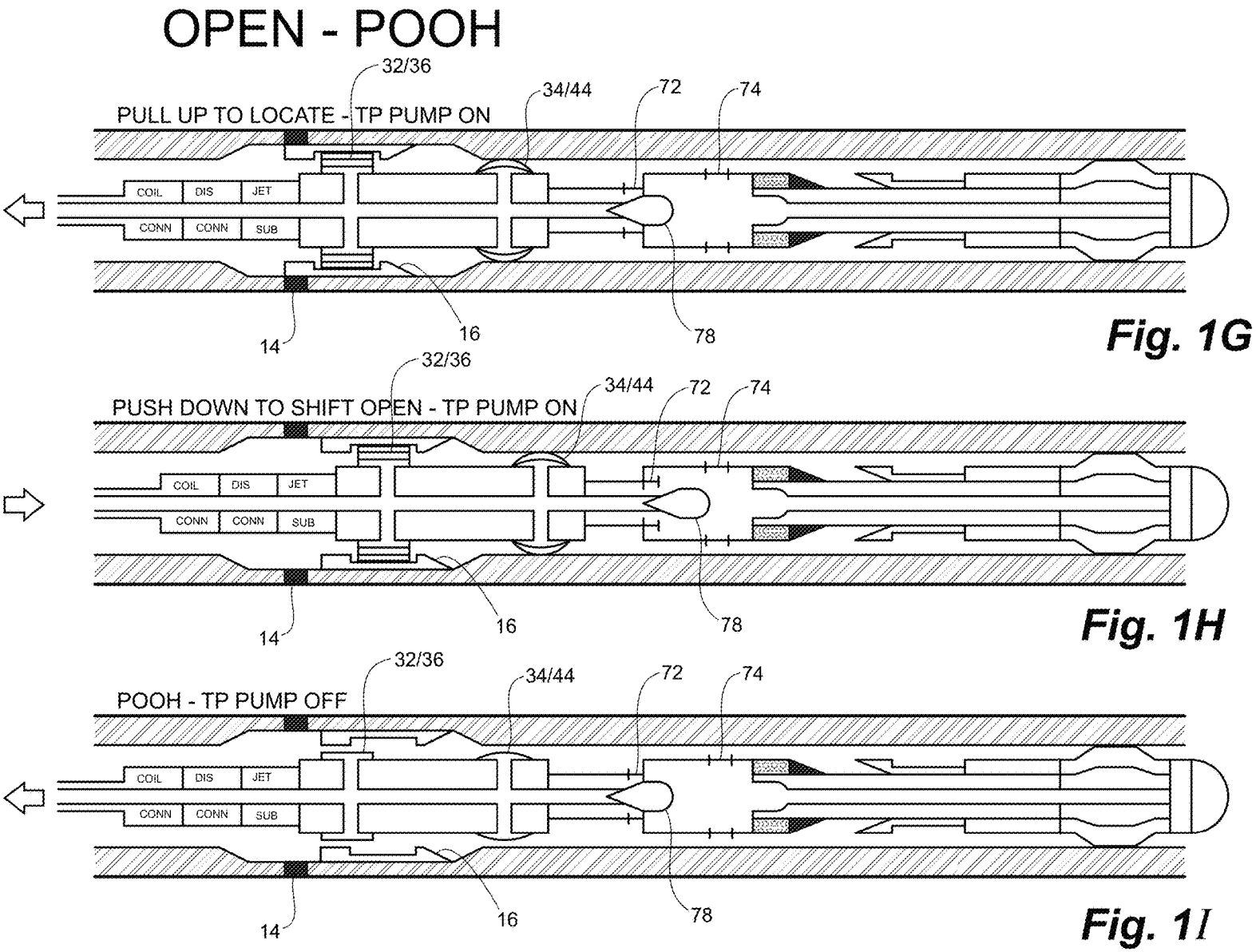

With reference to FIGS. 1G through 1I, there are operational scenarios in which a closed sleeve valve 10 is opened and left open before moving uphole to the next sleeve valve. An example of such a situation includes accessing a wellbore in which all the sleeve valves have been opened and treated and closed again to rest. After the formation is deemed ready for production, all the sleeve valves 10 can be reopened. No treatment is required and the treatment tool 50 is not implemented. The BHA 8 of the current embodiment is again suitable for this operation with a minimum of tensile pulling and pushing compressive cycles.

Turning to FIG. 1G, a sleeve valve 10 is shown in the closed position in an open and leave-open operation. The sleeve opening operation is carried out in a manner similar to the step illustrated in FIG. 1A, wherein after the BHA 8 is run-in-hole to locate the shifting tool 30 downhole of the sleeve valve 10 of interest, the BHA 8 is pulled uphole to actuate the valve assembly 69 to the second valve mode, the ports 72,74 of the selector valve 70 misaligned and the isolation mandrel 64 and bypass valve 76 open. The treatment tool 50 is also cycled to the POOH/PTL mode as the isolation mandrel 64 is pulled uphole. The TP pump is turned on to hydraulically energize the shifting dogs 36. The shifting tool dogs 36 are shown in FIG. 1G having located and engaged the closed sliding sleeve's profile 18;

FIG. 1H illustrates the operational step after FIG. 1G for actuating the sliding sleeve 16 to the open position to expose the treatment ports 14, similar to that of FIG. 1B. The TP pump, annular pump, or both, are flowing to drive the shifting packer 44 and shifting dogs 36 downhole to shift the sleeve 16 downhole to the open position. The treatment pump cycle does not advance as the valve assembly 69 does not fully collapse during the limited sleeve-opening movement.

FIG. 1I illustrates an operational step after FIG. 1H wherein after the sleeve valve 10 is opened, the TP pump is turned off to retract the shifting tool dogs 36 and shifting packer 44. As the distance covered by the downhole shifting of the sleeve 16 was not sufficient to cycle the treatment tool 50 to the SET/FRAC mode, the treatment tool 50 remains in the POOH/PTL mode. Thus, the BHA 8 can be pulled uphole to the next sleeve valve 10 for opening without further cycling of the conveyancing string 6.

Operation—Pull-Uphole-to-Open Sleeve Valves

In other embodiments, the BHA 8 can also be used to actuate pull-uphole-to-open sleeve valves 10.

Figure 3D:
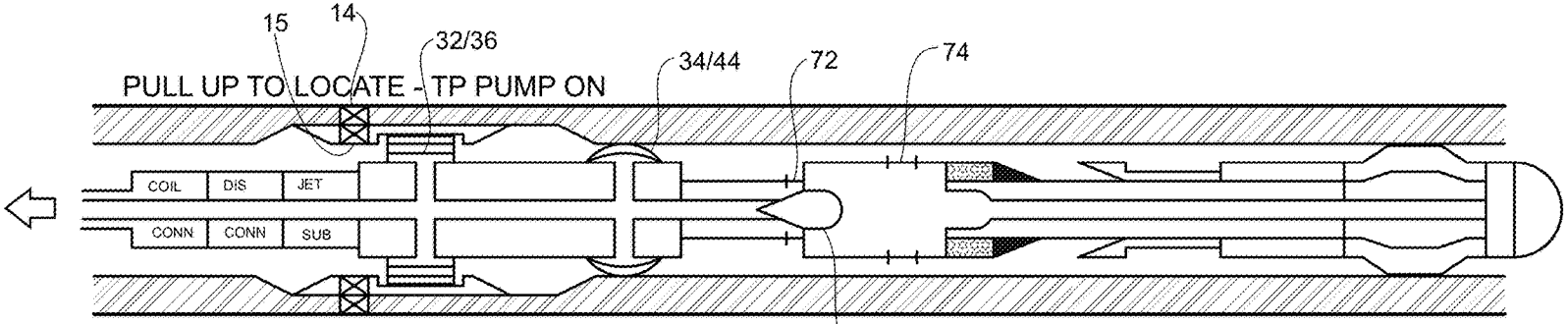
Figure 3E:
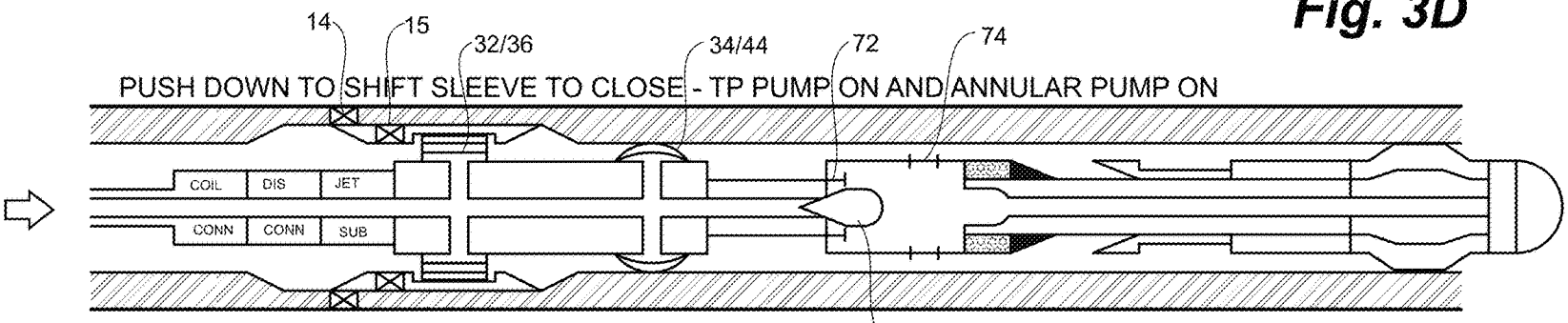
Figure 3F:
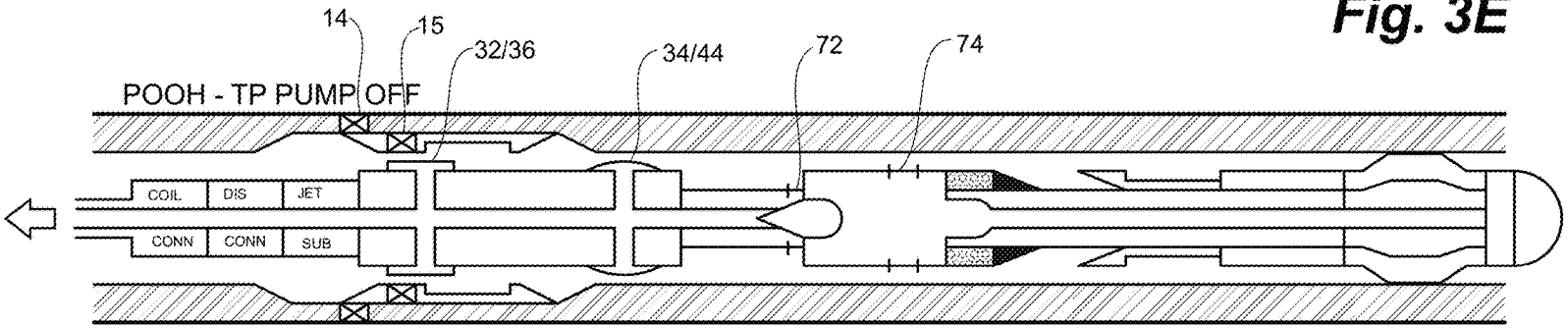
Figures 3G, 3H, 3I:
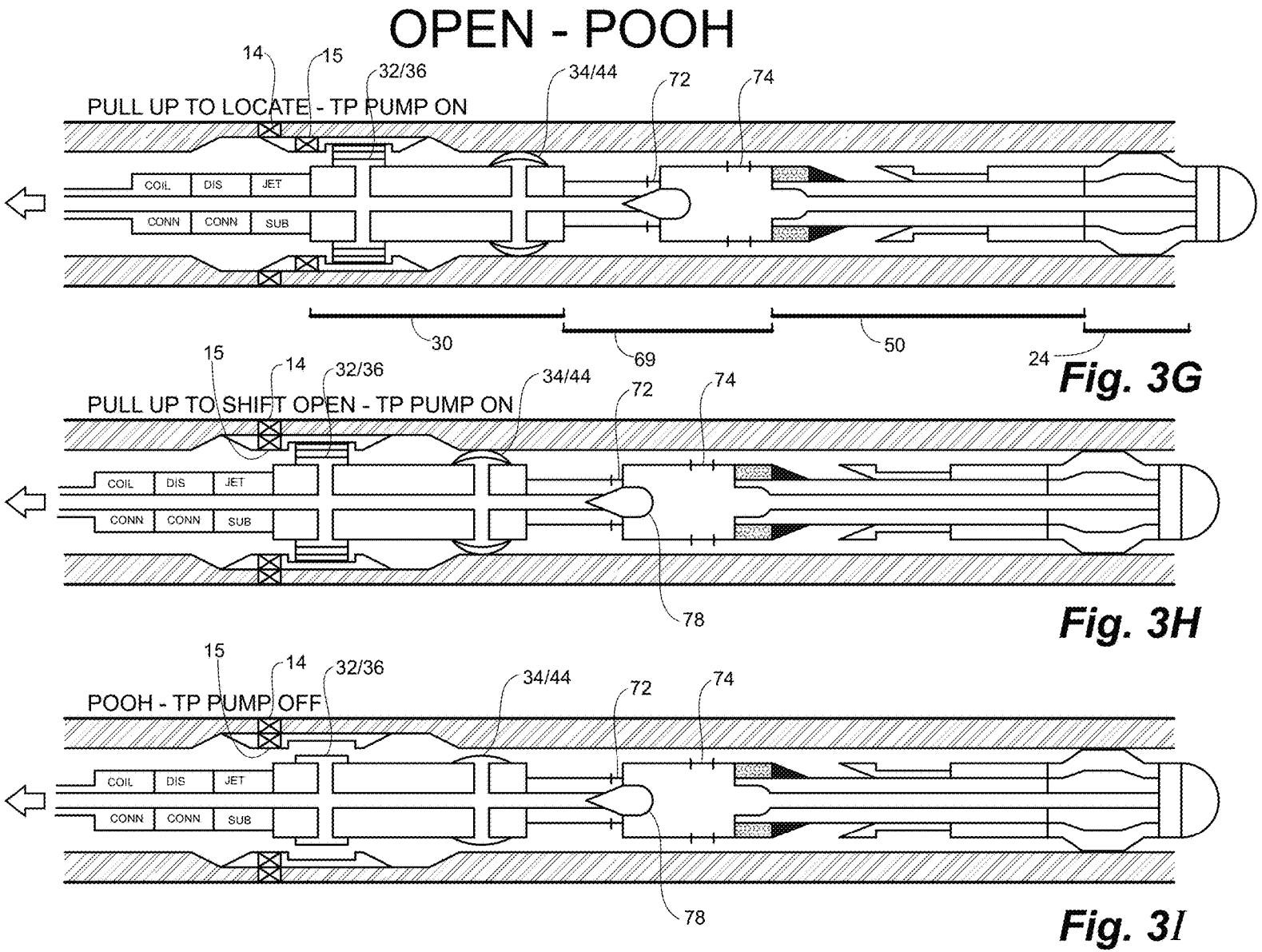

FIGS. 3A through 3I depict the BHA 8 being used to actuate pull-uphole-to-open sleeve valves 10. The sleeves 16 comprise a sleeve port 15 configured to be capable of alignment with the treatment ports 14 when in the open position, and misaligned with the treatment ports 14 when in the sleeve 16 is in the closed position. FIG. 3A though 3C are illustrative of the locating and opening of the sleeve valve 10 for treatment therethrough, FIGS. 3D through 3F are illustrative of a closing of an opened sleeve 16 before moving to the next successive sleeve valve 10. FIGS. 3G through 3I depict a subsequent opening of previously closed sleeve valves 10.

FIG. 3A illustrates an initially closed sleeve valve 10 subject to an open, frac, and close operation wherein, after running-in-hole the BHA 8 downhole of the sleeve valve of interest 10, the TP pump is turned on to energize the shifting dogs 36 and urge them radially outwards. The BHA 8 is then pulled uphole to locate the sleeve 16. The shifting tool dogs 36 are shown having located and engaged the closed sliding sleeve's profile 18, the shifting tool's packer 44 located in the casing 4 downhole of the sleeve valve 10. The treatment tool 50 is cycled to the POOH/PTL mode as the shifting tool 30 is pulled uphole.

FIG. 3B illustrates an opening of the treatment ports 14 by uphole actuation of the sliding sleeve 16 to the open position. The TP pump continues to pump fluid to energize the shifting dogs 36 radially outwards whilst the conveyance string 6 is pulled uphole to pull the engaged sliding sleeve 16 to the open position. As the sleeve 16 in this embodiment must be pulled uphole to the open position, fluid force such as annular pressure PANN cannot be used to assist in opening the sleeve 16. Mechanical pulling on the conveyance tubing 6 alone without fluid force assist is effective in overcoming initial threshold sleeve release forces to actuate the sleeve 16 to the open position.

FIG. 3C illustrates a downhole movement and actuation of the treatment tool 50 to the SET/FRAC mode to block the wellbore downhole of the opened sleeve valve 10. The TP pump is temporarily turned off (or on idle for pressure balancing) to retract the shifting dogs 36 and shifting packers 44. The downhole movement of the BHA 8 and shifting mandrel 40 sets the treatment tool isolation packer 52 and actuates the valve assembly 69 to the first valve mode to open the conveyance tubing 6 to the annulus 2 and block the isolation mandrel bore 68 with the bypass plug 78. The annular and/or frac pump is then turned on for providing fracturing flow through the open treatment ports 14 of the opened sleeve valve 10.

FIG. 3D illustrates an embodiment wherein, after treatment, the sleeve valve 10 is to be closed. The TP pump is turned on to increase tubing pressure PTP and activate the shifting dogs 36 and shifting packer 44, and the shifting tool 30 is pulled uphole to locate the sleeve 16. The shifting dogs 36 are shown having located and engaged the opened sliding sleeve's profile 18. The uphole pulling on the BHA 8 also cycles the treatment tool 50 to the POOH/PTL mode to disengage the anchor 54 and permit the BHA 8 to be pulled uphole to locate the sleeve 16.

FIG. 3E illustrates the operational step after FIG. 3D wherein after the shifting dogs 36 have re-engaged the sliding sleeve 16. The TP pump, and optionally the annular pump, pumps fluid downhole to energize and drive the shifting packer 44, and the rest of the shifting tool 30, downhole. The shifting dogs 36 and sliding sleeve 16 engaged therewith are moved downhole with the shifting tool 30 to close the sleeve valve 10. The treatment tool 50 is stationary in the wellbore, held in place by the drag sub 24, and remains in the POOH/PTL mode due to the short axial distance travelled by the shifting tool 30. The relatively short stroke of the sleeve 16 as it actuated from the open to the closed position also maintains the ports 72,74 of the selector valve 70 in misalignment.

FIG. 3F illustrates the operational step after FIG. 3E wherein after the sleeve valve 10 is closed, the TP pump is turned off to retract the shifting tool dogs 36 and shifting packer 44, and an uphole pull on the shifting tool 30 pulls both the shifting tool 30 and treatment tool 50, still in the POOH/PTL mode, free of the closed sliding sleeve 16 such that the BHA 8 can move uphole to the next successive sleeve valve 10 for treatment.

FIG. 3G illustrates a treatment operation wherein pull-uphole-to-open sleeve valves are opened and left open using the BHA 8. The operation begins in a manner similar to the step illustrated in FIG. 3A, wherein the sleeve valve 10 is in the closed position. After running-in-hole the BHA 8 downhole of the sleeve valve 10 of interest, the TP pump is turned on to energize the shifting dogs 36 and the BHA 8 is pulled uphole, the shifting dogs 36 running along the wellbore wall to locate the sleeve profile 18 of the sleeve valve 10 of interest. The treatment tool 50 is cycled to the POOH/PTL mode by the uphole pull on the BHA 8. The shifting tool dogs 36 are shown having located and engaged the closed sliding sleeve's profile 18.

FIG. 3H illustrates the operational step after FIG. 3G for actuating the sleeve valve 10 to the open position, similar to the step depicted in FIG. 3B, in which the TP pump is flowing to energize the shifting packer 44 and shifting dogs 36 whilst the conveyance string 6 and BHA 8 are pulled uphole to pull the engaged sliding sleeve 16 to the open position, aligning the sleeve ports 15 with the treatment ports 14. The selector valve 70 is maintained in the second valve mode and the treatment tool 50 remains in the POOH/PTL mode.

FIG. 3I illustrates an operational step after FIG. 3H wherein after the sleeve valve 10 is opened, the TP pump is turned off to retract the shifting tool dogs 36 and shifting packer 44, and an uphole pull on the shifting tool 30 pulls both the shifting tool 30 and treatment tool 50, still in the POOH/PTL mode, free of the sliding sleeve 16 for movement to the next sleeve valve 10 of interest or to surface. As the BHA 8 progresses uphole to locate and open subsequent sleeve valves 10, the treatment tool 50 remains in the POOH/PTL mode, as there is no need to cycle the conveyancing string 6 downhole. This enables the sleeve valves 10 to be opened rapidly without unnecessary cycling of the conveyancing string 6 and corresponding wear thereto. In embodiments, the treatment tool 50 can be omitted such that only the shifting tool 30 is present on the BHA 8.

While in the above processes, the tubing pressure PTP is controlled by the TP pump and the annular pressure PANN by the frac pump FP, the reverse configuration can also be used if required.

Controlled Tubing Flow Rates to Actuate Shifting Tool

Turning to FIG. 11 and FIGS. 18A to 18C, the hydraulic actuation of the BHA 8 can be cycled using a shifting J-mechanism 156 to minimize tubing pump (TP) management at surface and to better match TP fluid rates downhole and hydraulic actuation pressures.

Figures 18A, 18B, 18C, 19A, 19B:
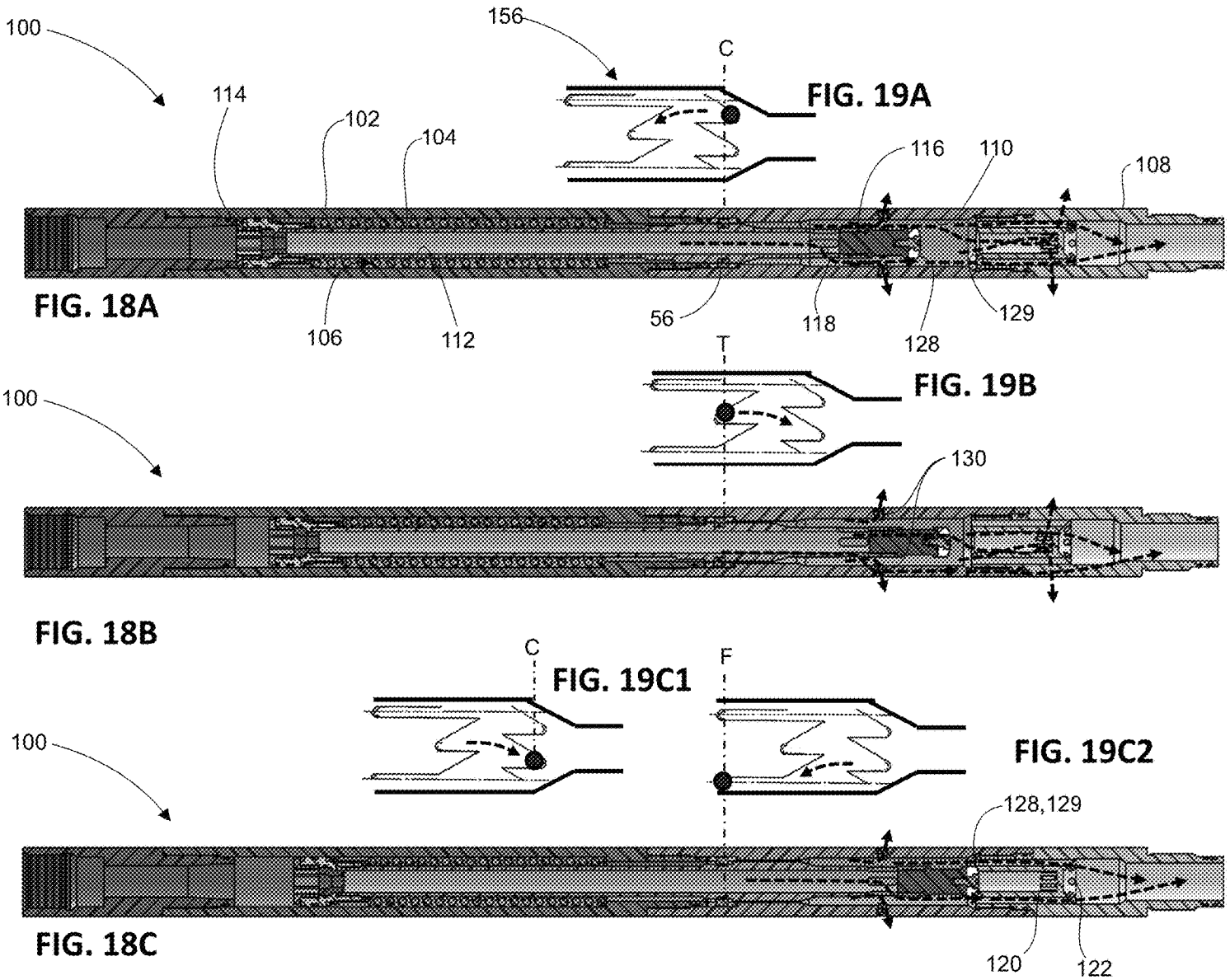

As introduced in FIGS. 18A through 18C, a flow control valve 100 can be provided in this embodiment of a BHA 8, either as shown uphole of the shifting tool 30, or downstream thereof. In FIGS. 12A through 17G, the flow control valve 100 is uphole of the shifting tool 30, and in FIGS. 22A through 22E, a flow control valve 101 is located downhole of the shifting tool 30, having slightly different operation due to the position relative to the source of the tubing pressure and the shifting tool components.

Figure 23A:
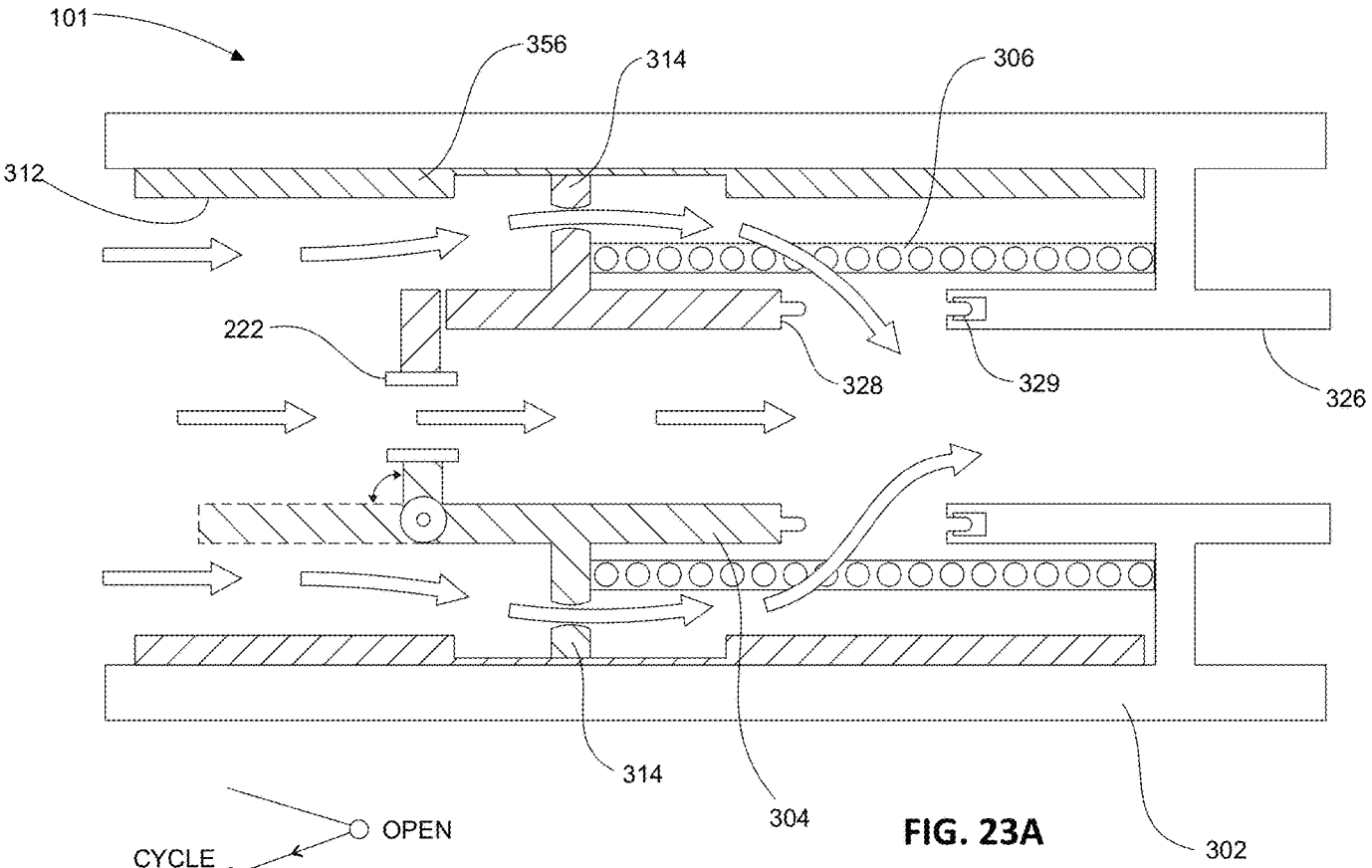
FIG. 23A illustrates a schematic of a form of hydraulic flow valve suitable for use downhole of the hydraulic shifting tool.

For a downhole flow control valve 100 located downhole of the shifting tool 30, such as that shown in FIG. 23A, the valve can also incorporate the flow blocking valve 70, rendering the selector valve's aligning and misaligning ports 72,74 merely optional for hydraulic actuation purposes.

With reference to FIGS. 12A to 12G, operations are performed for the opening of shift-down-to-open sleeve valves 10, isolation of the wellbore therebelow for treatment of opened ports 14, and then tripping uphole to the next sleeve valve 10.

The BHA 8 includes a shifting J-mechanism 156 for flow or pressure-controlled cycling of the flow control valve 100. A schematic of the shifting J-mechanism 156 is shown at FIGS. 19A to 19C2 with J-profile modes labeled as "C" for circ or cycle, "T" flowthrough, and "F" for high pressure mode.

As discussed in greater detail below with respect to the uphole flow control valve 100 of FIGS. 18A to 18C, when cycled to C mode, the valve 100 enables low fluid flow rates to circulate through the shifting tool 30 with low pressures in the shifting bore 42. The low pressure is below a mandrel actuation threshold so that there is no actuation of the sleeve engagement mechanism 32 or shifting-assist mechanism 34. Hereinafter, the sleeve engagement mechanism 32 is referred to as the shifting dog 32 and the shifting-assist mechanism 34 is also referred to as the shifting packer 34 or shifting packer 44 as needed to distinguish from a specifically identified from of mechanism 34 that actuates a packer 44.

This C mode is also the default spring-biased open, cycle advance mode from any previous modes hydraulic operations. The uphole flow control valve 100, at the low-pressure, low flow open mode enables fluid flow rates to and through the flow control valve 70 and to both the annulus 2 and the shifting tool 30. Regardless, the resulting pressure at these flow rates is insufficient to trigger actuation with the low pressures in the shifting bore 42.

The valve 100 must be triggered with a higher threshold flow or pressure to cycle the valve 100 to a high-pressure F mode in combination with a restricted or closed bore downhole of the shifting tool 30. Once triggered, the shifting J-mechanism 156 is oriented for the high-flow actuation for curtailing the dumping of fluid flow to the annulus 2, directing substantially all the fluid to the shifting bore 42 for maximizing fluid pressurization thereof. Thereafter, further adjustment of the fluid flow rates can be from surface, as long as they are maintained above the second threshold so as to remain in F mode. Adjustment of the TP pump flow rate in F mode results in actuation of at least the shifting dogs 32/36, the shifting packer 44, or both the shifting dogs 32/36 and shifting packer 44.

Two high flow rates F1,F2 are contemplated above the second threshold in F mode, a first rate F1 to generate sufficient pressure to actuate the shifting dogs 32/36, and a second even higher rate F2 to generate sufficient pressure to actuate both the shifting dogs 32/36 and shifting packer 34. After the shifting tool operations are complete, a reduction in the TP flow rate at some increment below the second threshold, and there is some hysteresis, the spring biasing opening the valve 100 and cycles to the C mode.

Between the low-flow, low-pressure C mode and the high-pressure F mode is an intermediate high-flow, low-pressure flowthrough T mode. The T mode alternates cycle with the F mode. The T mode is delimited by the shifting J-mechanism 156 to prevent actuation to the F mode, even at high fluid flow rates over the second threshold. The T mode is an intermediate cycle to transition between C and F modes.

The treatment J-mechanism 56 of the treatment tool 50 uses a simplistic three position profile labelled as "Cy" for cycle or POOH mode, "R" for RIH mode and "S" for SET mode. Tubing and annular flow valving positions between the shifting tool 30 and treatment tool 50 are identified as RV1 for opening and closing the tubing discharge from the shifting tool 30 to control the shifting tool bore pressure PTP, and RV2 for opening and closing the bypass valve 76 through the treatment tool 50.

With reference to FIG. 11, operations are commenced to treat a wellbore fit with a plurality of open-down sleeve valves 10,10 . . . . With reference to FIG. 12A, compatible flow control valve 70 and shifting tool 30 characteristics result in illustrated example flow, pressure and shifting tool actuation conditions.

Turning firstly to FIG. 12A, the BHA 8 is run-in-hole to the toe or bottom of the wellbore with the shifting tool 30 hydraulically idle and the treatment tool 50 in the RIH mode. In the first instance, the BHA 8 is positioned below a first sleeve valve 10. At FIG. 12B, the BHA is cycled to LOC mode by applying a triggering first flow rate F1, from the TP, of 0.3 m3/min (300 liters/min), and the shifting J-mechanism 156 advancing to the F mode. In the schematic figures, the illustrated sleeve-engaging mechanism 32 and/or shifting dogs 36 are interchangeable as generic. In other words, the shifting tool 30 operates to engage the sliding sleeve 16 using shifting dogs 36, where they can be one and the same as the sleeve-engaging mechanism 32.

The shifting dogs 36/32 are actuated however, in this embodiment, the shifting packer 44 is not fully actuated or actuated at all. Herein, when the shifting packer 44 is not fully actuated radially, it is deemed as not having been actuated for fluid force shifting purposes. String manipulation from uphole telescopes the isolation mandrel 64 relative to the housing 65, and the treatment J-mechanism 56 advances to the CY or POOH mode.

The shifting dogs 36 drag against the casing 4 until a sleeve profile 18 is reached, the shifting dog 36 expanding into the localized annular recess of the sleeve profile 18. The shifting packer 44 is not yet fully actuated and does not swab against the casing 4.

Figure 12C:
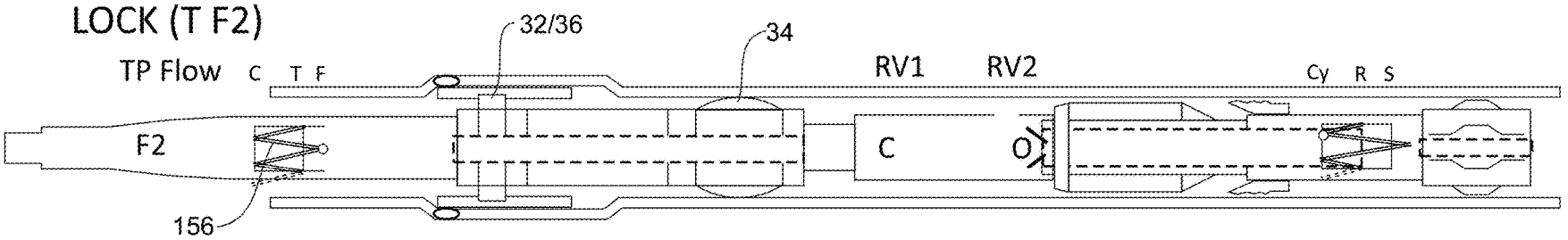

At FIG. 12C, the TP flow rate is increased to second flow rate F2 which further increases the pressure in the shifting bore 42 into LOCK mode, increasing the radial force on the shifting dogs 36 and actuating the shifting packer 44. The shifting packer 44 engages the wellbore casing 4 downhole of the sleeve valve 10. The treatment tool 50 remains in the POOH mode.

Figure 12D:
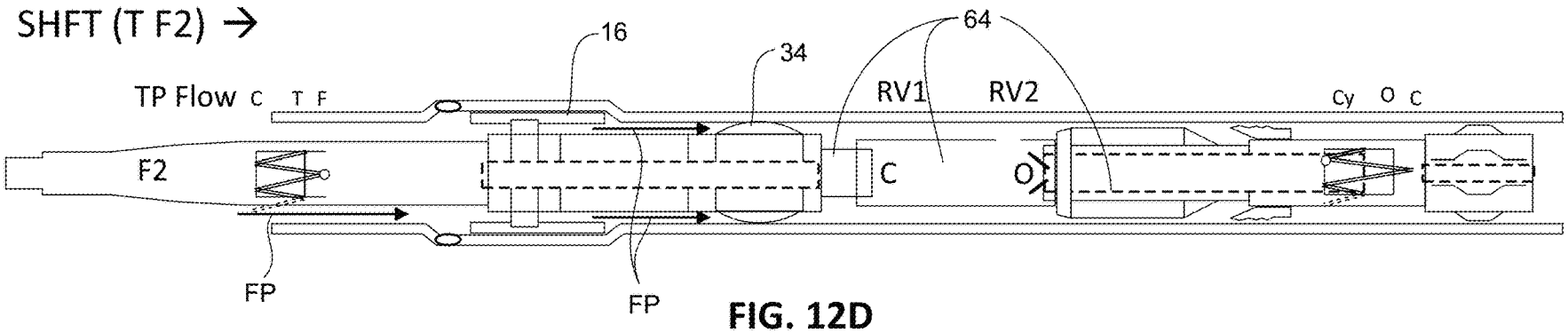

With reference to FIG. 12D, the shifting tool 30 is manipulated into a sleeve-shifting mode (SHFT). The conveyance tubing 6 is placed into compression and particularly, in extended horizontal wellbores, the annular or fracturing pump FP pumps fluid down the annulus 2. The pressure of the annular fluid PANN acts on the shifting packer 34 as a fluid piston and applies shifting-assistance force to the connected BHA 8, driving the BHA 8 downhole the short distance needed to open the sleeve 16. The distance the BHA 8 moves downhole is insufficient to affect the mode of the telescopically-coupled treatment tool 50, the treatment tool 50 remaining in the POOH mode.

Figure 12E:
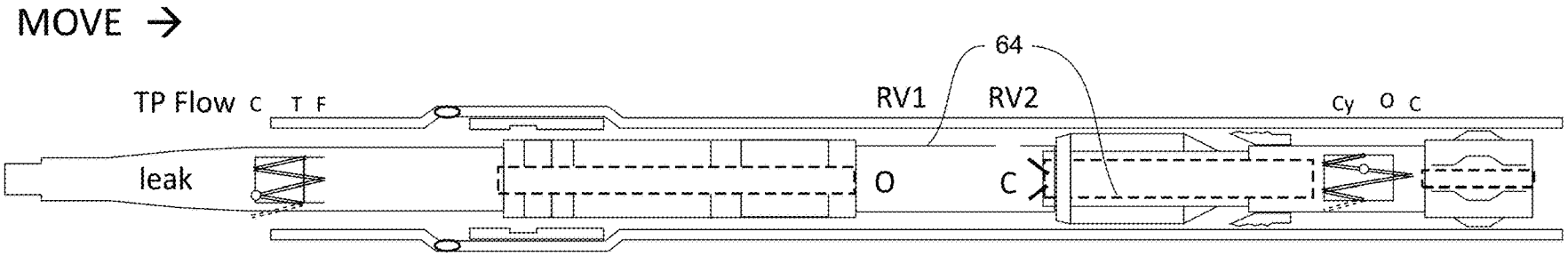

With reference to FIG. 12E, the fluid flow F2 from the TP pump is reduced and flow control valve 100 resets and spring bias cycles back to the low flow, low pressure C mode, releasing the pressure in the shifting bore 42, deactivating the shifting dogs 32 and shifting packer 34. The downhole movement of the conveyance tubing 6 and connected BHA 8 continues downhole. The downhole movement, and collapsing telescopic action of the valve assembly 69, moves the BHA 8 downhole of the sleeve valve 10.

As an alternate embodiment to the telescopic valve assembly 69, or selector valve 70, the BHA 8 can be fit with a slack sub for automatic downhole movement. Details of a slack sub are as set forth in Applicant's published US Application US20200024916A1 as set forth above or the springless slack sub as set forth in Applicant's pending application Ser. No. 16/921,696, entitled Apparatus, Systems And Methods For Completion Operations, filed Jul. 6, 2020, and projected for publication Jan. 7, 2021. Both publication US20200024916A1 and U.S. application Ser. No. 16/921,696 are incorporated herein, in their entirely, by reference.

In this embodiment, the valve assembly 69, such as the selector valve 70 from the prior embodiment, enables sufficient downhole movement to move the shifting tool 30 downhole of the sleeve valve 10, and place the wear tubing 26 adjacent the opened pots 14. The selector valve 70 which alternately blocks fluid from the shifting mandrel bore 42 of the shifting tool 30 can be coupled with a bypass valve 76 that opens and closes the isolation mandrel bore 68.

With reference to FIG. 12F, with further downhole manipulation of the BHA 8, the treatment tool 50 is actuated and cycles to the SET mode. The drag sub 24 of the treatment tool 50 resists movement, restraining the isolation housing 56. The isolation packer 52 is driven downhole with the isolation mandrel 64 into the housing-supported anchor 54, shown as a cone 51 and slips 58, arresting further downhole movement of the isolation packer 52 so that it is compressed into wellbore isolation engagement with the casing 4. The bypass valve 76 closes the isolation mandrel bore 68 through the treatment tool 50. The annular or fracturing pumps FP provide fluid down the annulus 2 which is directed through opened sleeve valve ports 14 into the formation. Finally, as shown in FIG. 12G the BHA 8 treatment tool 50 J-mechanism 56 is mechanically cycled into the pull-out-of-hole (POOH) mode, releasing the isolation packer 52. The bypass valve 76 also opens to bypass fluid through the treatment tool 50, minimizing swabbing while the packer 52 releases from the casing 4. Release of the treatment tool 50 enables uphole pulling of the shifting tool 30 and isolation mandrel 64, moving the BHA 8 uphole towards the next sleeve valve 10 where the LOC, LOCK, MOVE, SET sequence repeats from FIG. 12B until all desired sleeve valves 10 can been opened and treated.

The BHA 8 is also capable of reclosing the sliding sleeves 16 of the sleeve valves 10 after treatment thereof.

FIG. 13 is a table of the sequenced operations of the BHA of FIGS. 11 through 12G according to another embodiment of the method of operation of the BHA 8, more particularly to include a re-closing operation immediately on the treated sleeve valve 10.

Figures 14B, 14C:
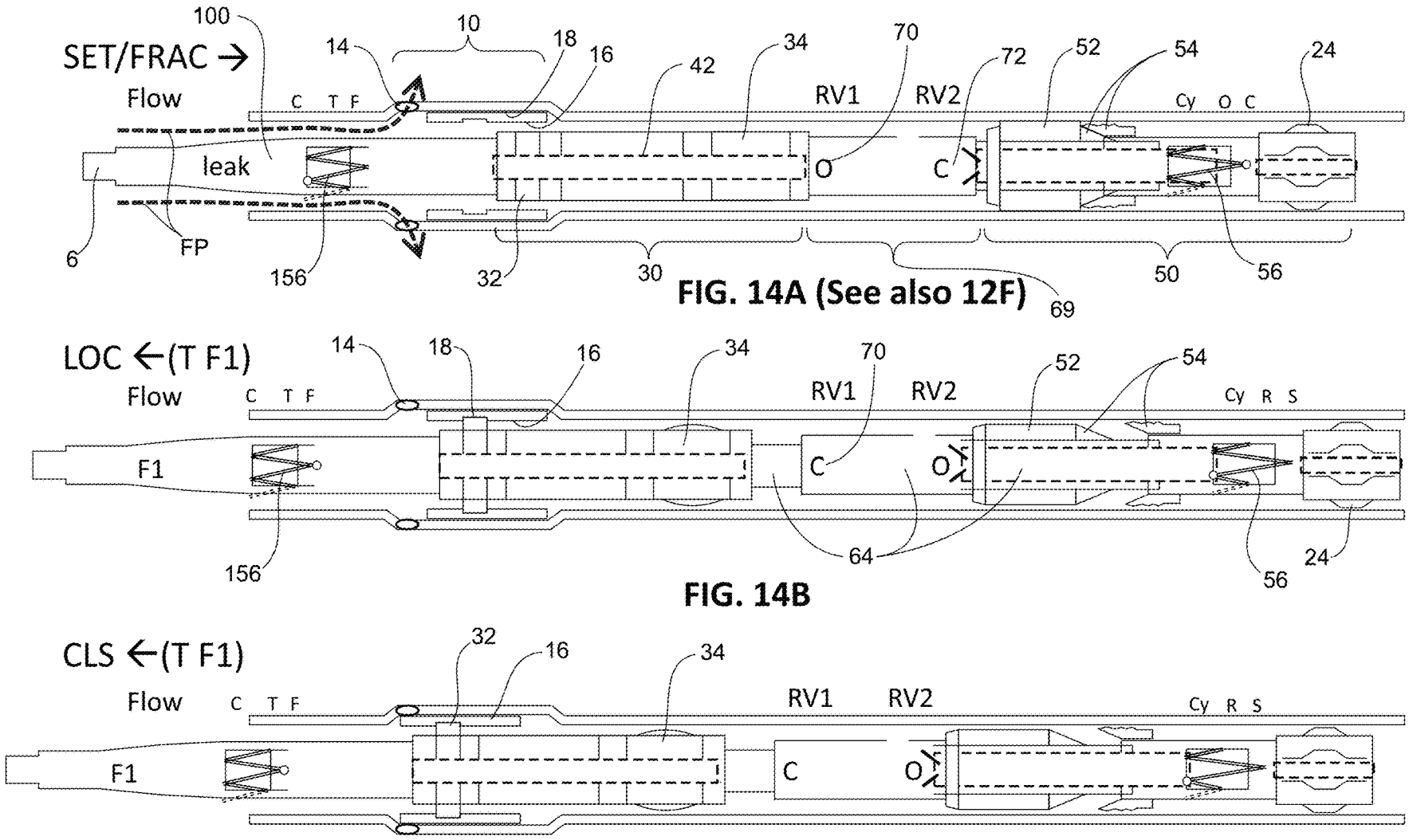
FIG. 14B illustrates the BHA in LOC mode with the shifting tool dogs actuated and the treatment tool in POOH mode.
FIG. 14C illustrates the BHA in sleeve closing mode (CLS) with the shifting tool dogs engaged with the sleeve profile and the BHA pulled uphole.
Figure 14D:
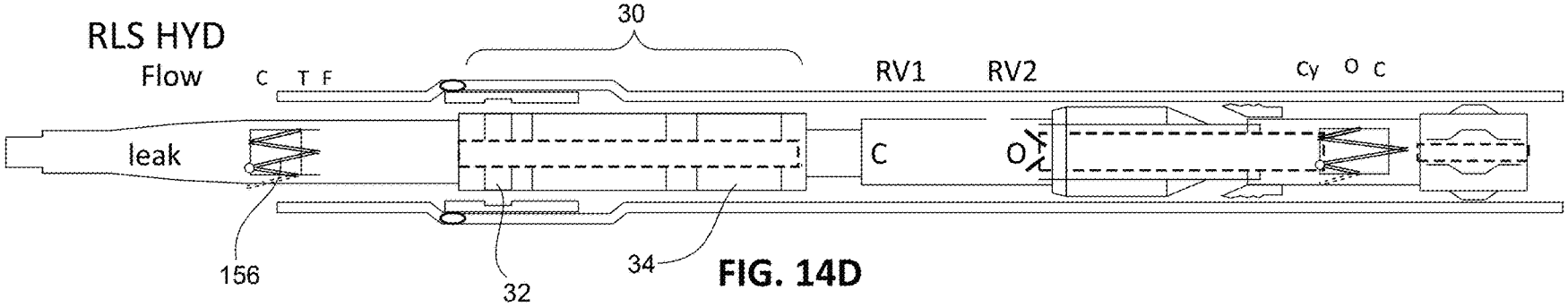
FIG. 14D illustrates the BHA with the shifting tool dogs and shifting packer released in release (RLS) mode for disengaging the shifting dogs from the sleeve profile.
Figure 14E:
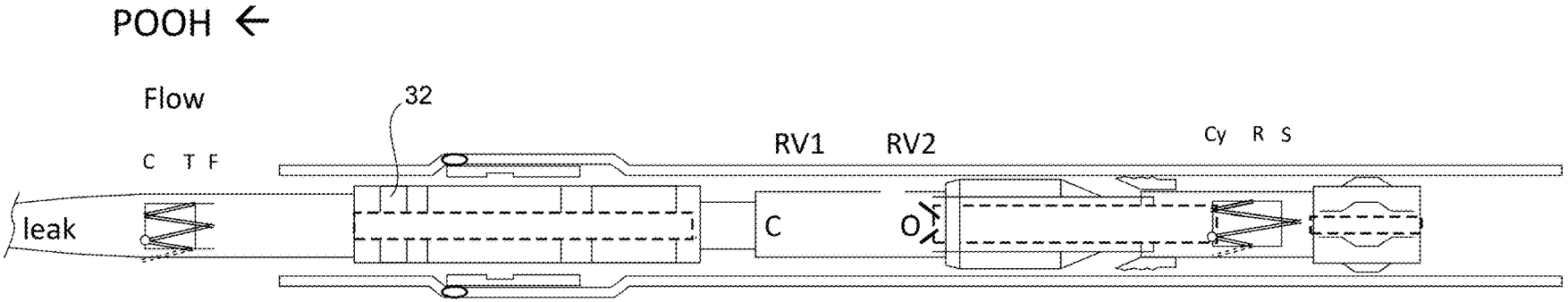
FIG. 14E illustrates the BHA in POOH mode to move uphole of the treated sleeve valve and towards the next sleeve, the BHA being stopped downhole of the next sleeve to reset the tool modes.
Figure 14F:
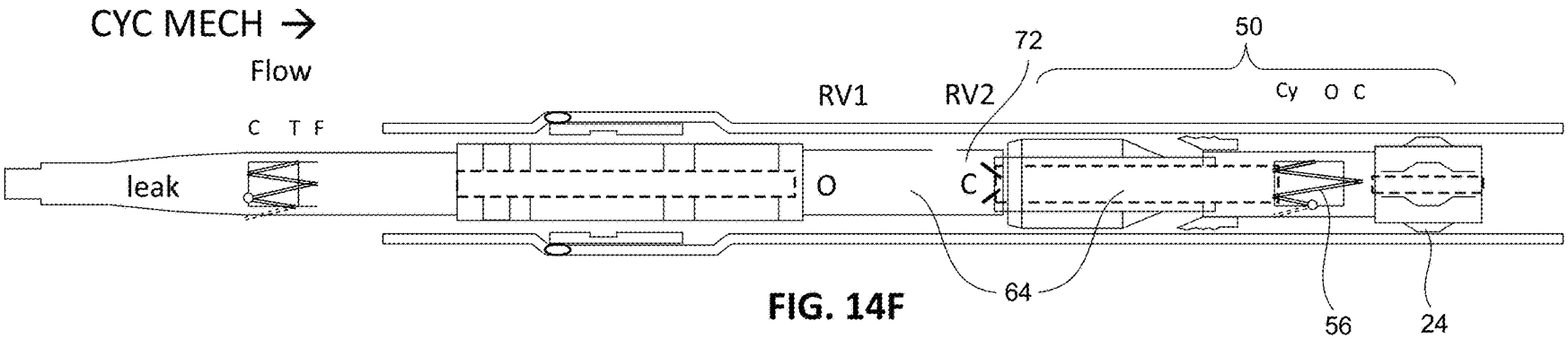
FIG. 14F illustrates the treatment tool being reset from POOH to RIH mode.

With reference to FIG. 14A, which repeats the drawing of FIG. 12F for convenience of viewing continuity of the methodology, the treatment tool 50 had been in the SET mode and the fracturing operation was completed though the ports 14 of the sleeve valve 10. Post treatment, the BHA 8 is downhole of the opened sleeve valve 10. In FIG. 14B, the shifting tool 30 is actuated with TP fluid and LOC mode with first fluid flow and pressure F1 for energizing the shifting dogs 36. The flow control valve 100 cycles to F mode. The treatment tool 50 cycles to POOH mode. The BHA conveyance tubing 6 is pulled uphole and the shifting dogs 36 drag along the casing for a short distance to the sliding sleeve 16 and engages the sleeve profile 18. At FIG. 14C, the shifting dogs 32/36 are engaged with the open sleeve 16 as TP flow F1 is maintained. The tubing 6 is again pulled uphole in the sleeve closing mode (CLS). The shifting dogs 36 pull the sleeve 16 closed. At FIG. 14E the conveyance tubing 6 is pulled uphole in POOH mode to move uphole of the treated sleeve valve and towards the next sleeve. The wellbore logs are typically utilized to stop downhole of the next sleeve valve 10 so as to reset the tool modes. Accordingly, at FIG. 14F, downhole tubing manipulation collapses the selector valve 70 and cycles the treatment tool 50 from POOH to RIH mode. Additionally, the shifting J-mechanism 156 is cycled to the T mode in advance.

Figure 14G:
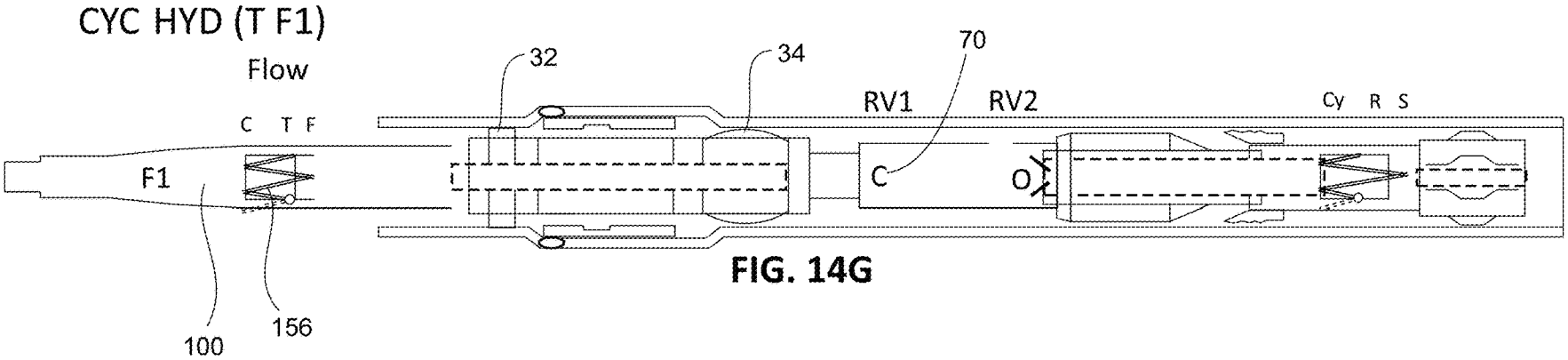
FIG. 14G illustrates the shifting tool being reset from circulation to flow tubing flow mode.
Figure 14I:
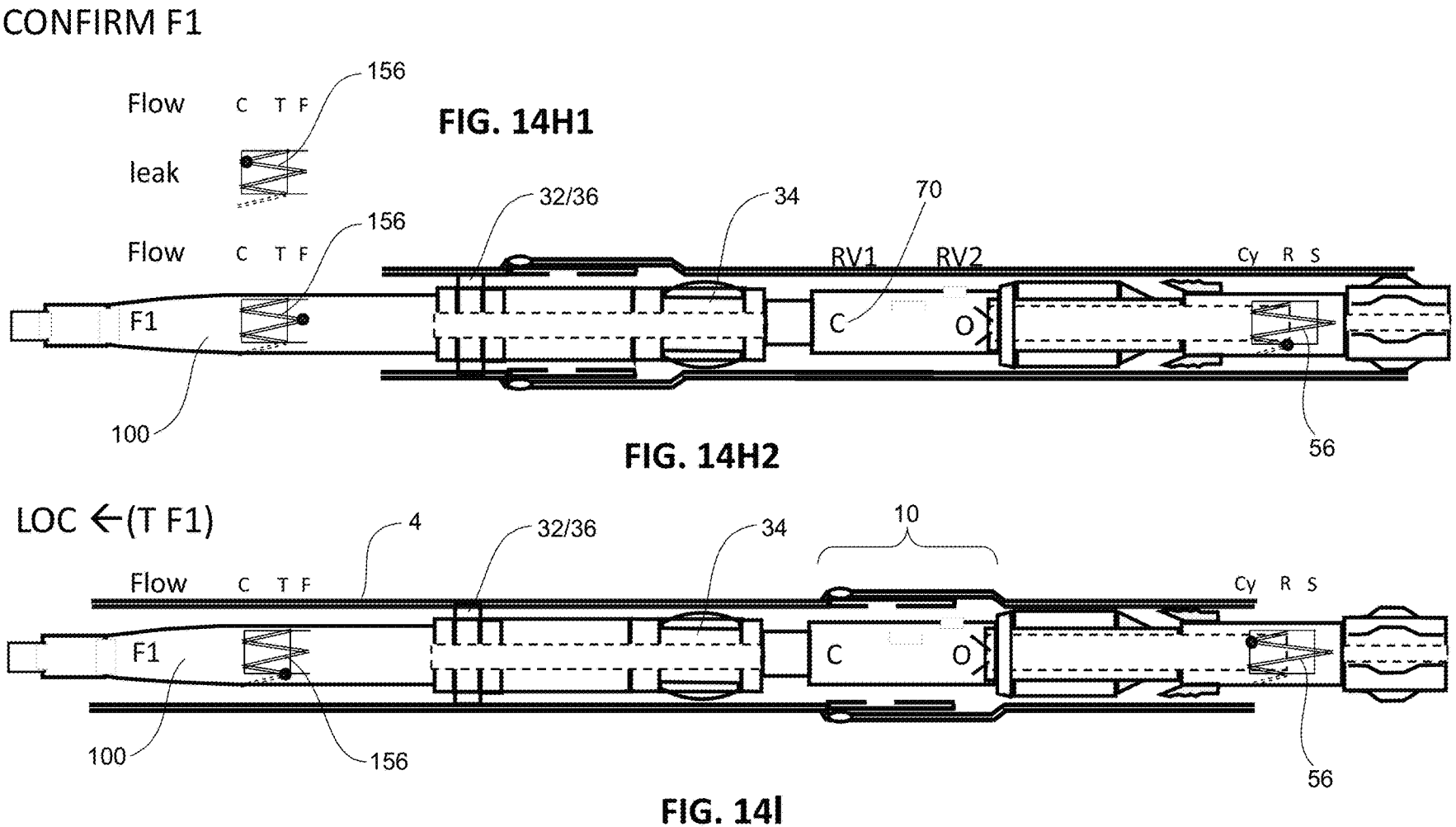
FIG. 14I illustrates the BHA in LOC mode with the shifting tool dogs actuated and ready for pulling uphole to position in the next sleeve and the treatment tool in POOH mode.

FIG. 14G illustrates the shifting tool being reset from circulation to the next cycle. Without some other unscheduled operational cycle, with TP flow F1, the shifting J-mechanism only moves to the T mode and confirmation flow indicates that the pressure is low and therefore needs to be cycled again. Reducing or stopping TP flow allows pressure to leak off at FIG. H1 and then at FIG. 14H2, with TP flow at F1, the shifting J-mechanism 156 moves to the high pressure flowthrough F mode, actuating the shifting dogs 32/36. At FIG. 14I, the BHA can be pulled uphole in LOC mode with the shifting tool dogs 36 actuated to position in the next sleeve 16. The tubing manipulation cycles the treatment tool 50 to POOH mode.

Figures 15A, 15B, 15C, 15D:
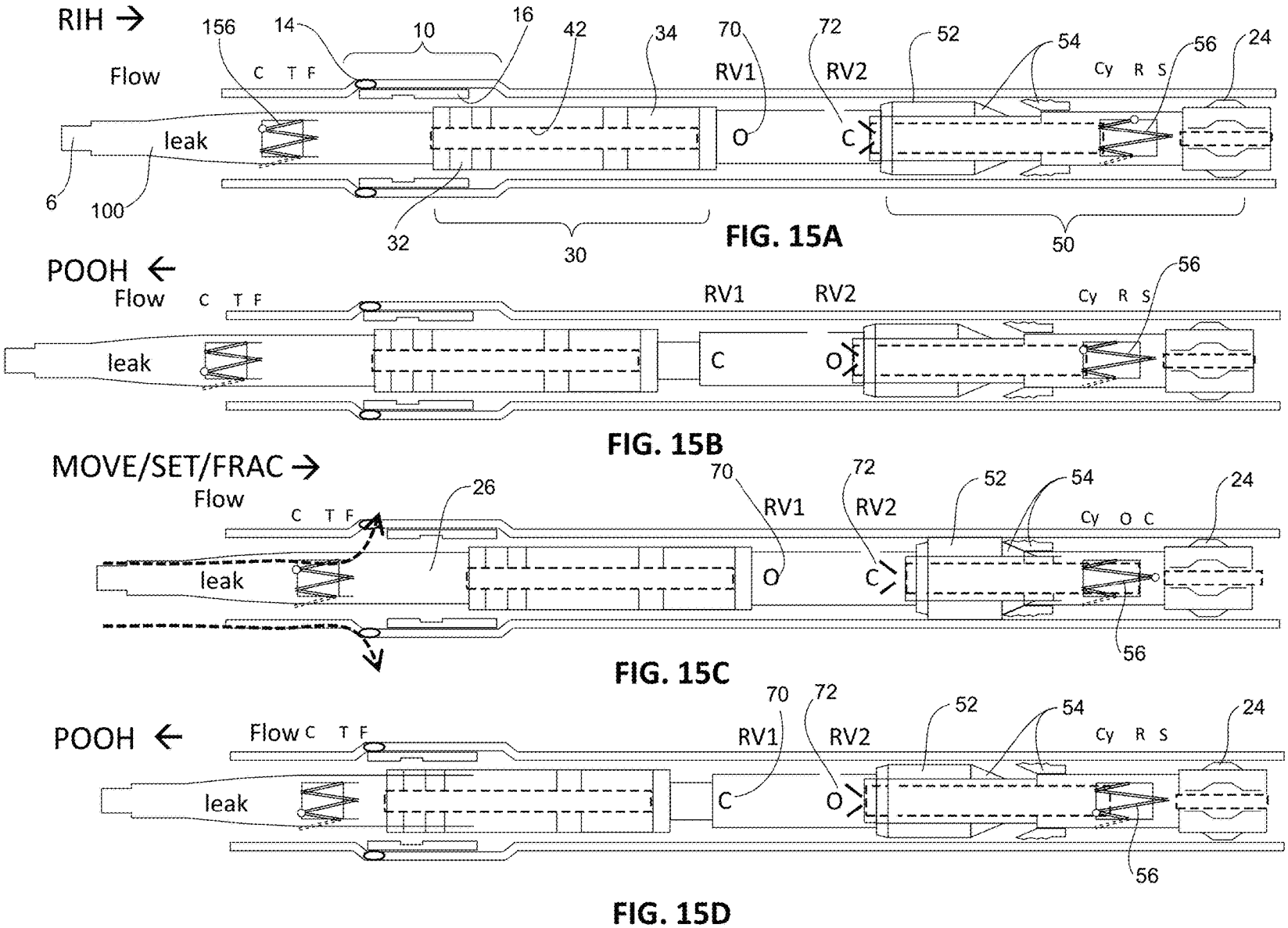
FIGS. 15A through 15D the full cycle of the resettable packer of the treatment tool including RIH, POOH, SET and POOH respectively, before cycling back to RIH mode.

For reference and all the sequences shown from FIG. 12A though 17G, the treatment tool operation is simplistic and repeatable. FIG. 15A through 15D illustrate, in the cycling order of the treatment J-mechanism 56, the full cycles of the resettable packer 52 of the treatment tool 50 including RIH, POOH, SET and POOH respectively, before cycling back to the RIH mode. The hydraulic shifting J-mechanism 156 is passive in this sequence. FIG. 15A illustrates a downhole movement of the BHA in which the selector valve 70 collapses and the isolation mandrel 64 cycles the J-mechanism 56 to RIH mode. FIG. 15B illustrates an uphole or pulling movement of the BHA 8 in which the selector valve 70 extends and the isolation mandrel 64 cycles the J-mechanism 56 to POOH mode. The isolation packer 52 is not set in either the RIH or POOH mode. FIG. 15B illustrates a downhole movement of the BHA in which the selector valve 70 again collapses, notablly closing the bypass valve 72, and setting the packer 52 to engage the wellbore, isolating the annulus 2 thereabove. The isolation mandrel 64 cycles the J-mechanism 56 to SET/FRAC mode. In the last cycle, at FIG. 15D, a final uphole movement of the BHA extends the selector valve 70, opens the bypass valve 72, and again cycles the J-mechanism 56 to POOH mode to release the packer 52

The BHA is also capable of an efficient open-only operation on a wellbore of previously treated and closed sleeve valves 10, the sleeve valves 10 having sleeves 16 fit with a profile 18.

Turning to FIG. 16, a table of sequenced operations illustrates metehodology for the BHA according to another embodiment of the operation thereof, namely to reopen a plurality of closed sleeve valves 10.

Figure 17A:
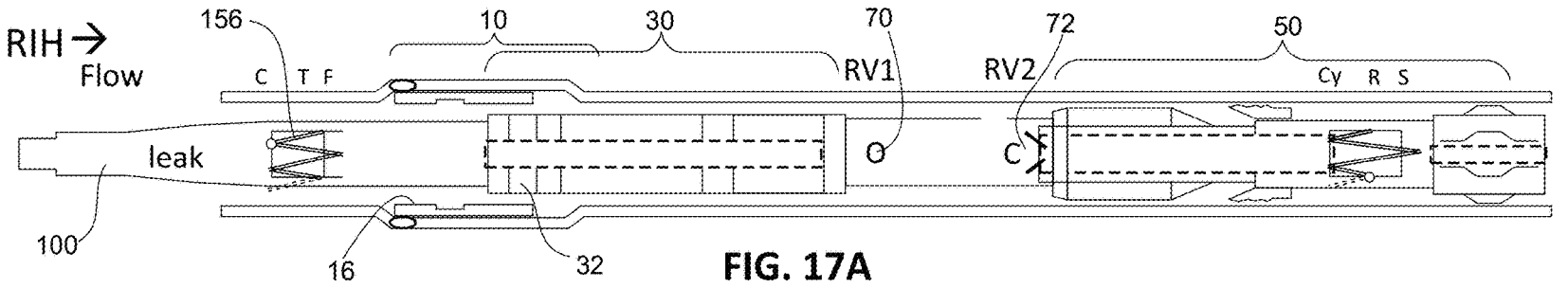
FIG. 17A illustrates the re-opening operation of the BHA with the initial step of running the BHA in RIH mode to the toe or bottom of the wellbore, downhole of the closed, treated sleeve valves.
Figure 17B:
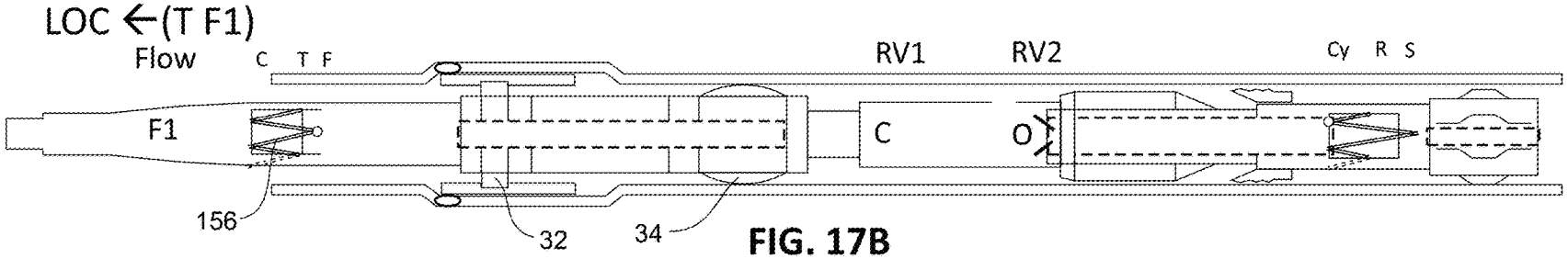
FIG. 17B illustrates the BHA in LOC mode with the shifting tool dogs actuated and the dogs positioned in the sleeve profile.
Figure 17C:
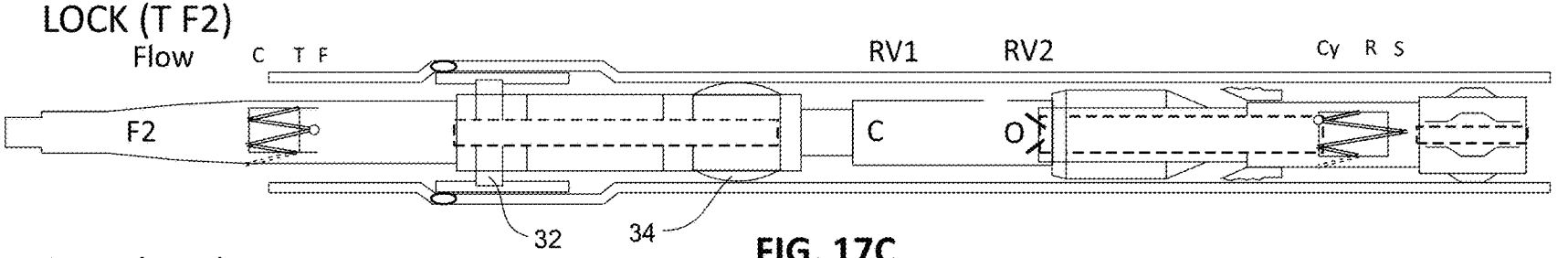
FIG. 17C illustrates the BHA in dog LOCK mode with the shifting tool dogs and shifting packer actuated and the treatment tool in POOH mode.
Figure 17D:
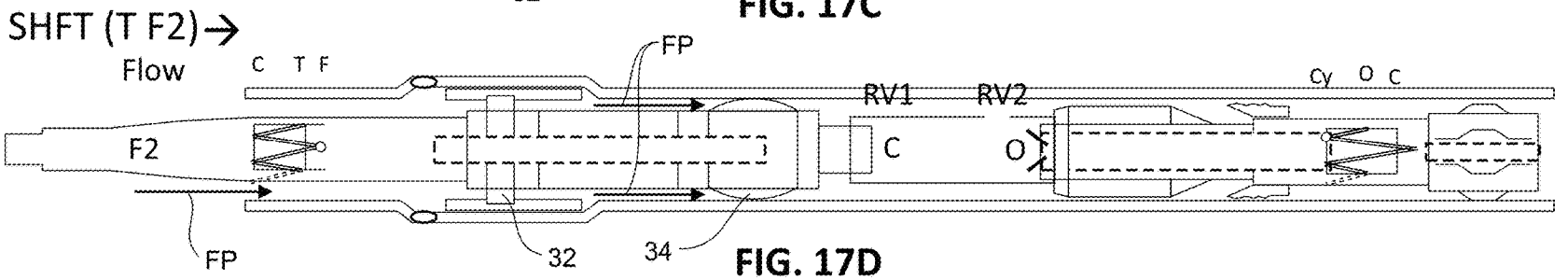
FIG. 17D illustrates the BHA in SHFT mode with the shifting tool dogs engaged in the sleeve profile, the shifting packer actuated and the BHA lowered downhole the short distance needed to re-open the sleeve.
Figure 17E:
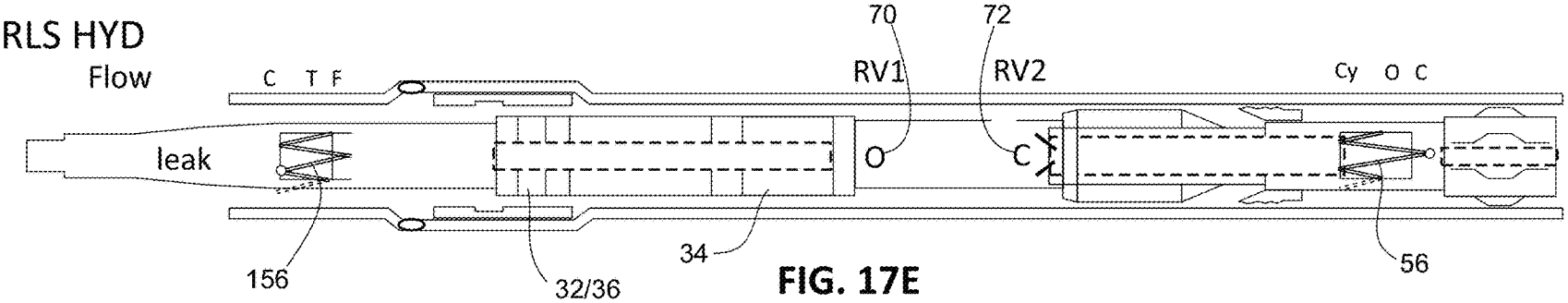
FIG. 17E illustrates the BHA with the shifting tool dogs and shifting packer released for disengaging the dogs from the sleeve profile, the BHA lowered to open the valve but not set the treatment packer.
Figure 17F:
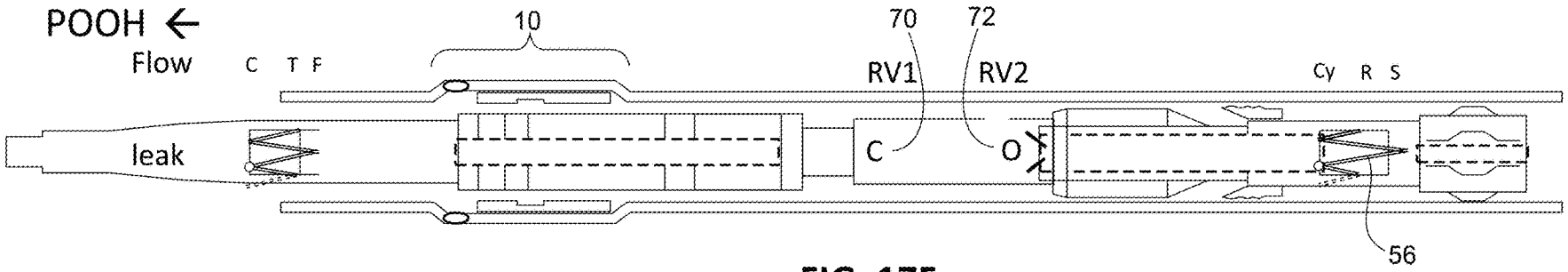
FIG. 17F illustrates the BHA in POOH mode for moving uphole towards the next sleeve.
Figure 17G:
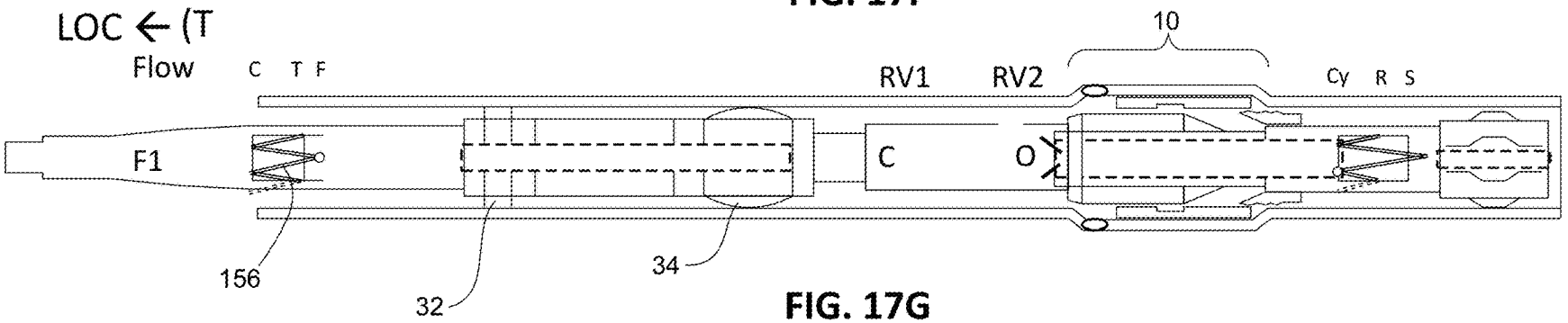
FIG. 17G illustrates the BHA in LOC mode with the shifting tool dogs actuated and the dogs positioned riding along the casing wall to the next sleeve valve where the sequence repeats from FIG. 17B.

With reference to FIG. 17A, the BHA 8 is in RIH mode in an initial step to the toe or bottom of the wellbore, positioned downhole of the plurality of closed, treated sleeve valves. The lowermost sleeve valve 10 of interest is depicted. At FIG. 17B the TP flow is increased to F1 to cycle the flow control valve 100 to F mode, and the shifting tool 30 to LOC mode. The shifting dogs 32/36 are actuated for positioning the dogs in the sleeve's profile 18 when the BHA reaches the sleeve valve 10. At FIG. 17C, with the sleeve 16 engaged, the TP flow is increased to F2 locking the shifting dogs 32/36 and actuating the shifting packer 44. The treatment tool 50 is in POOH mode. At FIG. 17D, the shifting tool 30 is forced downhole such as by tubing weight to the engaged dog 36 alone or further by adding annular flow through FP again the shifting packer 44. The shifting tool 30 of the BHA 8 lowers downhole the short distance needed to re-open the sleeve. The selector valve 70 is not fully collapsed and the valve 70 remains closed to retain the shifting tool actuation pressure.

Now that the sleeve valve 10 is re-opened, the BHA 8 can continue uphole to the next sleeve valve 10 for opening. At FIG. 17E the shifting tool 30 is released by reducing TP flow and pressure in the flow control valve 100 leaks out to the annulus. At FIG. 17F the BHA is pulled uphole, cycling the treatment tool 50 to POOH mode for moving uphole towards the next sleeve valve 10. At FIG. 17G, the TP pump provides flow F1 and the shifting tool 30 is actuated to LOC mode for dragging the shifting dogs 32/36 along the casing wall to the next sleeve valve where the sequence repeats from FIG. 17B.

Turning to FIGS. 18A to 18C, one embodiment of the hydraulic-actuation flow control valve 100 is shown for flow-rate actuation of the shifting tool 30 components. With reference to FIG. 18A, the flow valve 100 has a tubular housing 102, a tubular mandrel 104, a mandrel spring 106 that acts between the housing 120 and the mandrel 104. The spring 106 biases the mandrel 104 uphole in the housing 104.

A distribution sub 108 is located at the downhole end of the housing 102 to control flow discharging therefrom. The tubular housing has housing bore 110 in fluid communication with the bore of the conveyance tubing 6. The mandrel 104 is axially movable within the housing 102 and cycles between at least an uphole (FIG. 18A), an intermediate (FIG. 18B) and a downhole position (FIG. 18C) delimited or controlled by the shifting J-mechanism 156.

The mandrel 104 has a mandrel bore 112. A nozzle 114 is fit at the mandrel's uphole end for controlled restriction of fluid flow therethrough. The nozzle 114 creates a fluid force piston, responsive to variable fluid rates passing therethrough. The nozzle 114 is responsive at higher flow rates to generate sufficient hydraulic forces for the mandrel 104 to overcome the biasing spring 106 and regulate the extent of downhole movement of the mandrel 104 to the intermediate or downhole positions as dictated by the J-pin 160 and J-slot profile 158 of the shifting J-mechanism 156. As described in greater detail below, the J-mechanism 156 resides between housing bore 110 and the mandrel 104, located in this embodiment downhole of the spring 106. The mandrel bore 112 is closed at a bottom plug 116, but is also provided with one or more flow discharge ports 118 adjacent the bottom plug 116 for fluid communication into the housing bore 110. Fluid received by the flow control valve 100 is directed through the axially movable mandrel to the bore 110 of the housing below. The fluid entering the housing 102 primarily exits through the distribution sub 108 and controls the pressure in the shifting tool 30 below.

Figure 18D:
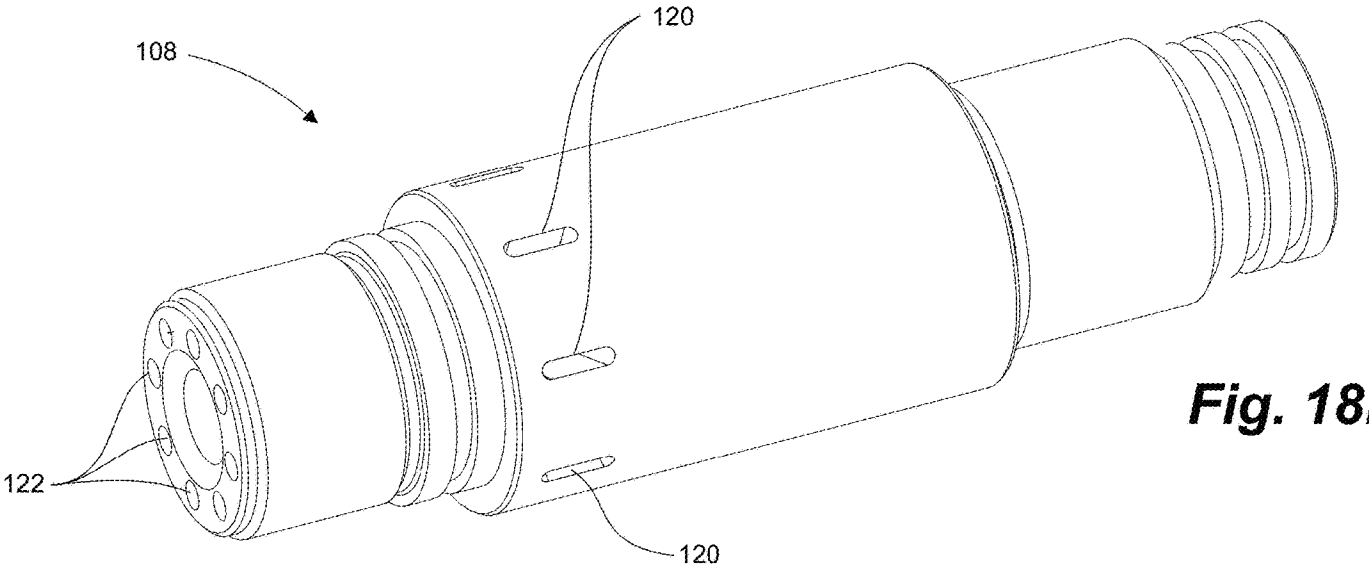
FIGS. 18D and 18E are perspective side and cross-sectional views respectively of the bottom sub of the flow valve to show the circumferentially staggered flow ports, namely the axial ports for unrestricted flow from the flow valve in all modes of FIGS. 18A to 18C to the shifting tool below, and the radial ports branching from the central bore for communication with the annulus, the central bore and thus the annular flow being blocked in the high flow mode of FIG. 18C.
Figure 18E:
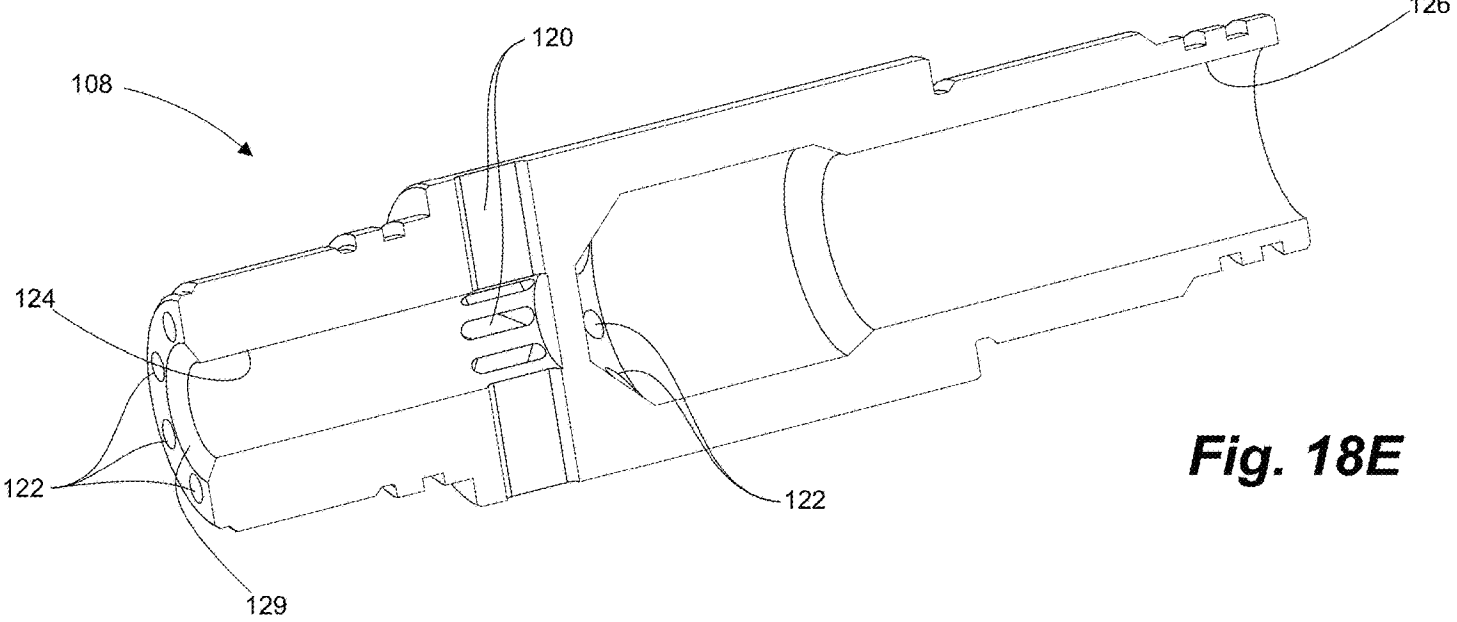

Best seen in FIGS. 18D and 18E, the distribution sub 108 has radial ports 120 for fluid communication between the housing bore 110 and the annulus 2 without, and axial ports 122 for fluid communication between the housing bore 110 and the shifting tool 30 therebelow. The radial ports 120 are circumferentially distributed through the wall of the distribution sub 108 and the axial ports 122 extend axially through the sub wall, passing spaced from, and between, the radial ports 120. The flows through the radial and axial ports are discrete and maintained separate from one another. The radial ports 122 are connected to, and branch out radially from a common inlet bore 124 and fluidly communicate with the annulus 2. The common inlet bore 124 has a sealing seat 129 that is releasably blocked by a sealing surface 128 on the mandrel's bottom plug 116 when the mandrel 104 is at its downhole position. The axial ports 122 remain open throughout all positions of the mandrel 104 and discharge into a common outlet bore 126 that is in fluid communication with the shifting mandrel bore 42.

The flow control valve 100 can be provided with an additional leak path, to the annulus 2, that is available regardless of the position of the mandrel 104. For example, the valve housing 102 can be fit with one or more side nozzles 130 adjacent the housing's downhole end for bleeding fluid from the housing bore 112 in all positions of the mandrel 104. The side nozzles 130 can provide pressure equalization from the valve 100 at low flow rates or annular wash functions, such as to clean sleeve valves 10, at higher flow rates.

The nozzle 114, the side nozzles 130, and the bottom sub's radial and axial ports 120,122 work together and can be sized for BHA design flow rates and mandrel 104 movement actuation pressures compatible with the shifting dog 32 and packer 34 requirements.

Returning to FIGS. 18A, 18B and 18C, three flow rate operation regimes are illustrated. Each valve operational mode is associated with a cycle of the J-mechanism 156. In FIG. 18A, a no or low-flow, low-pressure circulation mode is shown in which the mandrel 104 is spring biased to its full open position. The shifting J-mechanism 156, shown in FIG. 19A, is at C mode. This is also the default J-mechanism cycling position accessed by a low flow, spring biased reset of the mandrel 104. The mandrel plug 128 is spaced from the distribution sub 108 and all flow ports from the valve 100 are open, particularly radial ports 120. Fluid pressure in the valve 100 is low.

In order to advance the J-mechanism cycle, the flow rate to the valve 100 is increased to a first triggering threshold FT. The backpressure of fluid rate FT flowing through the nozzle 114 hydraulically forces the mandrel 104 downhole against the spring 106 until the J-slot 158 engages the J-pin 160. The J-Pin is on a collar rotatable in the housing 102 to permit the J-pin 160 to follow the J-slot 159. The downhole movement of the mandrel 104 is stopped at an intermediate axial position, shown in FIG. 19B, and labeled as the T mode. The mandrel plug 128 is still spaced from the distribution sub 108 and all flow ports from the valve 100 are open, particularly radial ports 120. As the mandrel is estopped from further downhole movement, the flow rate through the tool can be varied at high rates above the triggering threshold. As all flow ports remain open, the pressure in the housing 102 and leaving the distribution sub 108 remains low or, at least lower than that which actuates the shifting tool 30. If the flow rate drops to rates below about that of the triggering threshold rate, the mandrel will cycle back to the C mode. Thus, in order to actuate the shifting tool, the valve 100, the operator reduces the TP flow rate and the mandrel cycles back to the C mode.

To actuate the shifting tool 30, a high-flow rate is provided to the valve 100, again at a first flow rate threshold F1, greater than that of the cycle triggering threshold FT. The high flow rate through the nozzle 114 overcomes the spring 106 and the J-slot 158 engages the pin once again, rotating the J-pin collar and permitting the J-mechanism to move to the J-slot profile leading to the high rate flowthrough F mode position, as shown in FIG. 19C2. As the J-slot was previously locked at T mode, the J-mechanism first needs to be cycled through the low pressure C mode, at FIG. 19C1, before again increasing the flow rate to F1 and following the J-slot as shown in FIG. 19C2.

At the first threshold rate F1, the mandrel plug 116 approaches the distribution sub 108. The mandrel 104 snaps closed as the sealing surface 128 nears and then seals against the seat 129. As a result, the fluid in the valve housing bore 110 can no longer flow freely through radial ports 120 to the annulus. Virtually all fluid flow now must pass through axial ports 122 and out common outlet port 126 to the shifting tool 30. As disclosed above, a valve at the downhole end of the shifting tool 30 cooperates with the flow control valve 100 above so that the high pressure fluid exiting therefrom is trapped in the shifting tool 30 to act on the dogs 32/36 and packer 34. One such downhole valve is the selector valve 70 disclosed above.

In the flowthrough F mode, the TP pump rate can be further increased, such as to stage the actuation of the dogs 32/26 at the first threshold F1 and then at higher threshold rate F2 to also actuate the packer 34.

To cycle the valve 100 to the low pressure C mode, the fluid rate is reduced, and due to the partial fluid lock of the mandrel plug to the distribution sub 108, the mandrel will not release until the pressure is somewhat less than F1.

Figure 19D:
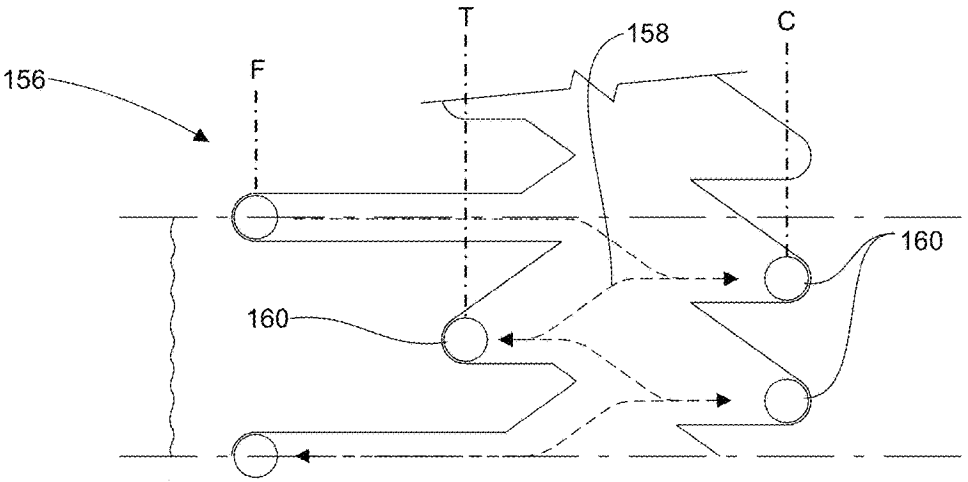
FIGS. 19D and 19E are alternate J-mechanism illustrations suitable for the flow control valve of FIGS. 18A to 18C, and showing the pin moving relative to the mandrel slots rather than the mandrel slots moving relative to the pin.
Figure 19E:
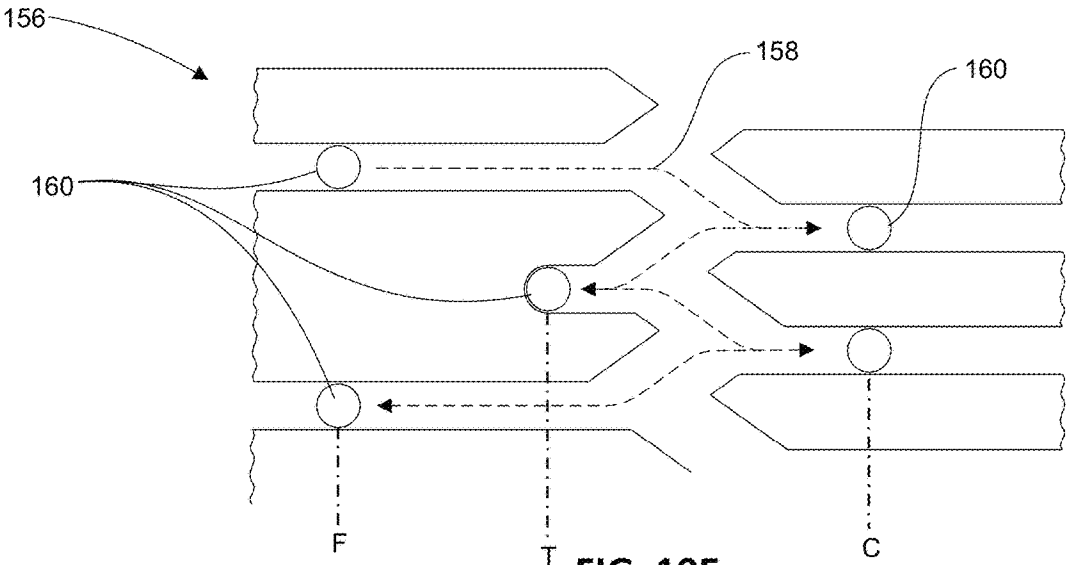

FIGS. 19A to 19C2 are schematic representations of the J-mechanism for the flow valve of FIGS. 18A to 18C respectively, the J-slot being located in the mandrel and the pin fixed in the housing, FIGS. 19C1 and 19C2 illustrating the hydraulic cycling needed to move between triggering mode and high flow mode. In a more conventional depiction, FIGS. 19D and 19E illustrate the J-pins moving within the J-slot profiles. The open ended C and F profiles of FIG. 19E minimize debris interference and utilize delimiting of the mandrel movement to maintain the J-pins within the extreme, open-ended slot positions.

FIG. 19E illustrates a shifting J-mechanism 156 where the extreme uphole and downhole positions of the J-pin 160 are not delimited by the J-slot profile 158, but instead are delimited by the movement of the mandrel 104. At the flowthrough F mode, the mandrel 104 cannot travel any further uphole than the structure allows, in this embodiment by the butt end of a top sub threaded into the housing 104.

Example Flow Rate and Pressure Regimes

The various ports in the flow control valve 100 control the actuation. In one embodiment of the valve 100 is about 44" long having a housing 102 ID and mandrel 104 OD of 2". The mandrel 104 has a through bore 112 of about 0.8" ID. The replaceable nozzle 114 was selected at 0.5" ID. At the bottom of the mandrel 104, four flow discharge ports 118 are provided, each with a nominal dimension of about 1.2×0.3". Eight side ports are fit to the housing, each of which can be blank or fit with 0.125" ID ports. At the distribution sub, the common inlet port is 0.8" diameter for feeding eight radial ports 120, each of about a nominal 0.6×0.3" and the axial ports 122 can be eight 0.25" passages.

As set forth, based on even one-half of the axial nozzles in use, the flow control valve can handle flowrates upwards in the order of over 600 L/min. For a nozzle 114 setup for 500 psi at 300 L/min, such as for actuating the dogs 36, cycling of the tool after locating or shifting operations, the valve 100 would open and cycle at a flow rates lower than about 180 L/min, being about 60% of pump-rate for the high pressure F mode. At the second flow rate F2, such as for actuating the packer 34, the flow rate be about 435 L/min for generating pressures of 1000 psi.

If the valve 100 was set setup for higher pressure in the flowthrough F mode, say 1000 psi at 300 L/min, then the valve would open and cycle at 160 L/min, at about 53% of the TP F1 rate. With no flow from the TP, the valve 100 would remain closed, remaining in the high pressure actuating F mode as the pressure leaked off down to about 720 psi differential pressure across the mandrel plug. The second threshold flow rate F2 would be about 435 L/min for pressures of 2000 psi such as for actuating the packer 34.

Alternate Flow Control Valves

Other flow control valves have been used for controlling actuation pressure of downhole components, including inflatable packers. As disclosed in FIGS. 20A to 20C, another embodiment of a hydraulic flow control valve 200 is drawn from U.S. Pat. No. 5,271,461 to Decker. Extracted and paraphrased from the abstract, and adding reference numerals to accord as possible with the common elements with flow control valve 100, one notes, an inflatable stimulation tool 200 is designed to be deployed by coil tubing having a shuttle valve 204 which reciprocates within the bore of a tubular mandrel. The shuttle valve 204, opens and closes various ports in the device to alternately seal and unseal the inflatable packer element.

Figures 20A, 20B, 20C, 21:
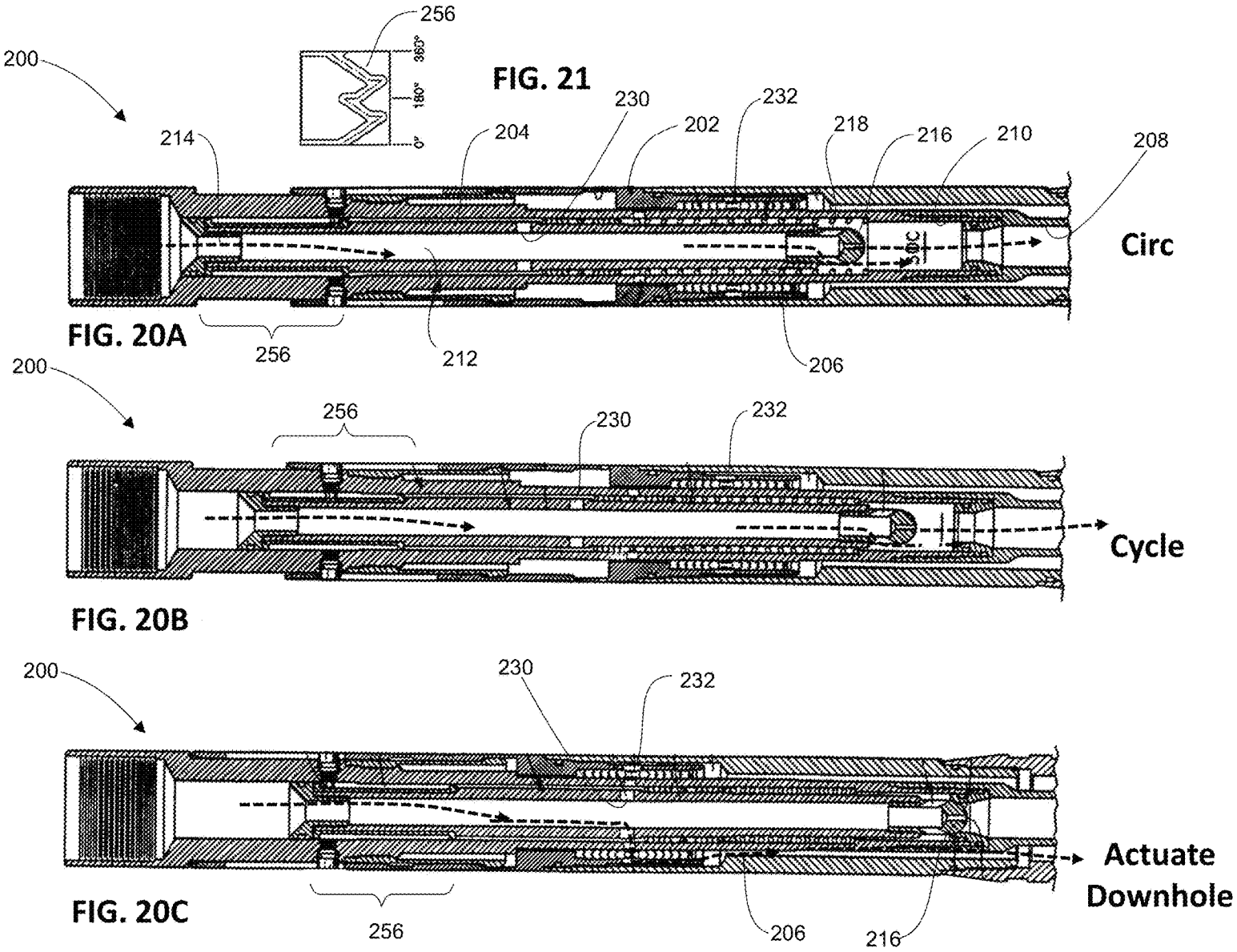
FIGS. 20A to 20C illustrate cross sectional view of an alternate hydraulic flow valve selected from U.S. Pat. No. 5,271,461 to Decker applied in a "Coiled tubing deployed inflatable stimulation tool"
FIG. 21 illustrates the J-mechanism corresponding to the tool modes as shown in FIGS. 20*a* to 20C.

In FIG. 20A Decker's shuttle valve is a mandrel 204 which is shown in a first low pressure flow mode. The fluid flow exits downhole mandrel ports 218 into a tubular housing bore 210. Fluid also exits mandrel plug end 216. Spring 206 biases the mandrel 204 uphole and in a default open flow position. A J-mechanism 256, shown also in plan view in FIG. 21, controls the axial positioning of the mandrel 204. In FIG. 20B, an increased rate of fluid flow through a nozzle 214 forces the mandrel 204 to a cycle position in preparation for enabling the mandrel to move in the next J-cycle to the closed high pressure position. In FIG. 20C, once the pressure was reduce and then increased again to a high rate, the mandrel is force fully downhole. The mandrel plug 216 essentially blocks discharge from the housing bore 210 and high pressure fluid develops in the mandrel. In this embodiment a radial port in the mandrel become aligned with a port in an intermediate tubular and high pressure fluid flows downhole to the inflatable packer, or in the current embodiment can be directed to the shifting tool 30. The fluid rate down the tubing from the TP can be varied as described earlier to stage wise actuate the dogs 32/36 at a first threshold flow rate F1 and pressure, and actuate the packer 34 at a second threshold flow rate F2 and pressure.

Downhole Flow Control Valve

With reference to FIGS. 22A to 22E, a hydraulically actuated flow control valve 101 can be provided downhole of the shifting tool 30 for delimiting and cycling between the various modes of the shifting tool 30. Like FIGS. 12A through 12G earlier, this embodiment is an operation for opening and treatment a sleeve valve 10.

The flow modes through the valve 101, located downhole of the shifting tool 30, is generally opposite to that of the uphole-located flow control valve 100 of FIGS. 12A-12G. The downhole flow control valve 101 is located downhole of the shifting tool 30 and controls the actuating pressure therein by throttling the discharge, not the inlet thereto. In an embodiment, similar to embodiments incorporating the uphole flow control valve 100, the downhole flow control valve 101 can have a J-mechanism 356 for delimiting between a circulate mode C, a flowthrough mode T, and a high pressure mode F. The downhole flow control valve 101 can have substantially the same structural design as the uphole valve 100, but located downhole of the shifting tool 30, and uphole of the valve assembly 69, and can incorporate the flow blocking valve 70. An example of a downhole flow control valve is shown in FIG. 23A.

With reference to FIG. 23A, a valve 101 has a mandrel 304 is movable in a housing 304. The mandrel 304 is biased uphole by spring 306 to a fully open, cycle off or circulation C mode. The nozzle 314 is flow-actuated to move downhole against spring 306 using the resistance of fluid flow through nozzle 314. The mandrel 304 has a tubular plug end 328 that cooperates with seal seat 329 on an outlet port 326. In either of the open modes, the mandrel receives fluid flow in bore 312 from the shifting tool 30 and discharges fluid to the treatment tool 50. As shown in FIG. 23B, the J-mechanism 356 has a low, or low flow, "cycle off" or C mode, a triggering or cycling T mode at a high flow rate threshold in which the mandrel is driven downhole and arrested by the J-mechanism to remain held open but not closed, and finally a closed or high pressure F mode at second flow rate F2 in which the mandrel's discharge is closed at seal 328,329 and all the flow pressure is applied to the shifting tool 30 uphole thereof. This replaces the flow-blocking function of valve 70 for the purposes of actuating the shifting tool 30. The valve 70, while shown, does not act in contradiction to the flow control valve 101 but can serve other additional annular and BHA fluid communication purpose if still applied Returning to FIG. 22A, operation of the BHA 8 to cycle through the various flow control valve modes is similar to that of embodiments having an uphole flow control valve 100. The valve 101 is triggered with a triggering threshold flow or pressure FT to cycle the valve 101. With reference to the J-mechanism patterns shown in FIG. 23B, and similar to those of FIGS. 19D and 19E, the flow valve 101 can be alternatingly cycled between the triggering mode T, the circulate C mode, and the high pressure flowthrough mode F, and biased back to the circulate mode C each time the tubing flow rate or pressure drops below the threshold flow FT and pressure. In the circulate mode C and triggering mode T, fluid from the tubing string 6 is permitted to exit downhole to the annulus 2, in this case though the valve 101, thus limiting the amount of pressure PTP that can be built up in the shifting tool bore 42 and tubing bore. In the circulate C and triggering modes T, substantially all the fluid from the tubing string 6 is directed downhole into the valve assembly 69 and toward the treatment tool 50. In the closed F mode, fluid introduced into the tubing string 6 cannot exit from the downhole flow control valve as it does not have a flowpath into the annulus 2 and as a result, tubing pressure PTP builds, thus permitting actuation of the shifting dogs 36 and shifting packer 34 of the shifting tool 30 via tubing pressure PTP. Using the flow control valve 101 of FIG. 23, the fluid-blocking action of the valve 70 is rendered moot for actuation of the shifting tool.

Figure 22A:
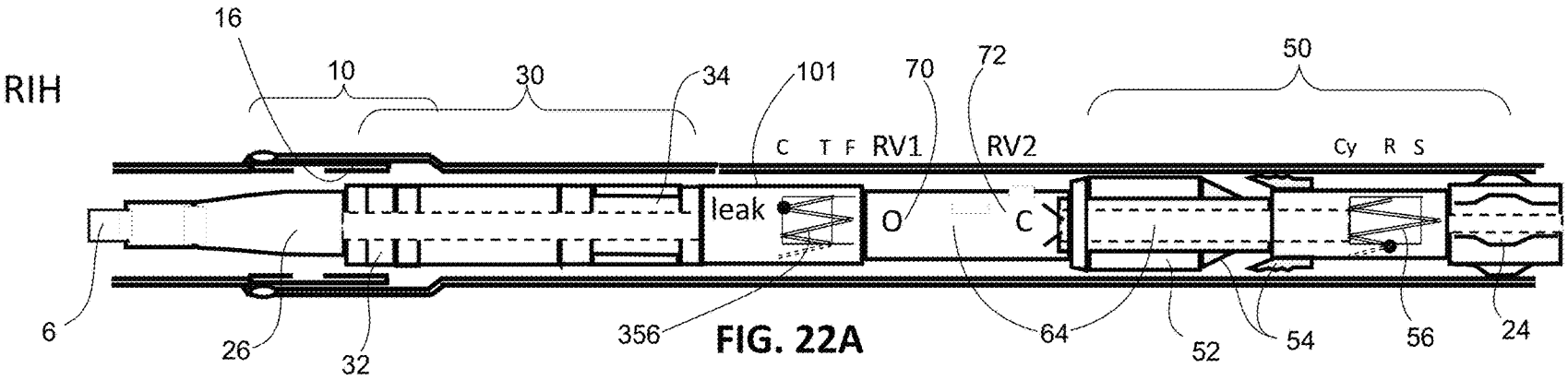
FIGS. 22A to 22E are schematic cross-sectional representations of the BHA operation for shift down sleeves using a hydraulic flow control valve located downhole of the shifting tool dogs and shifting packer and the operations for opening a sleeve downhole and treatment following therefrom. More particularly.
Figure 23B:
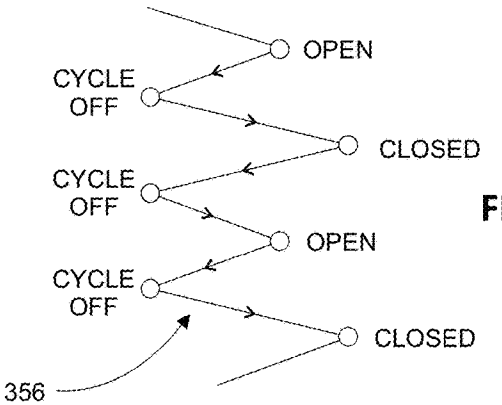
FIG. 23B illustrates a J-mechanism profile for operation of the valve of FIG. 23A.

With reference to FIG. 22A, the BHA 8 is shown in RIH mode with the shifting tool 30 idle and the treatment tool 50 in RIH mode. The flow control valve 101 is in the circulate mode C. While the flow blocking valve 70 is not operational for shifting tool 30 operation, it is in the open position and does permit fluid in the tubing string 6 to communicate with the annulus both through the flow control valve 101 and the flow blocking valve 70. In any event, the BHA 8 is configured for RIH.

Figure 22B:
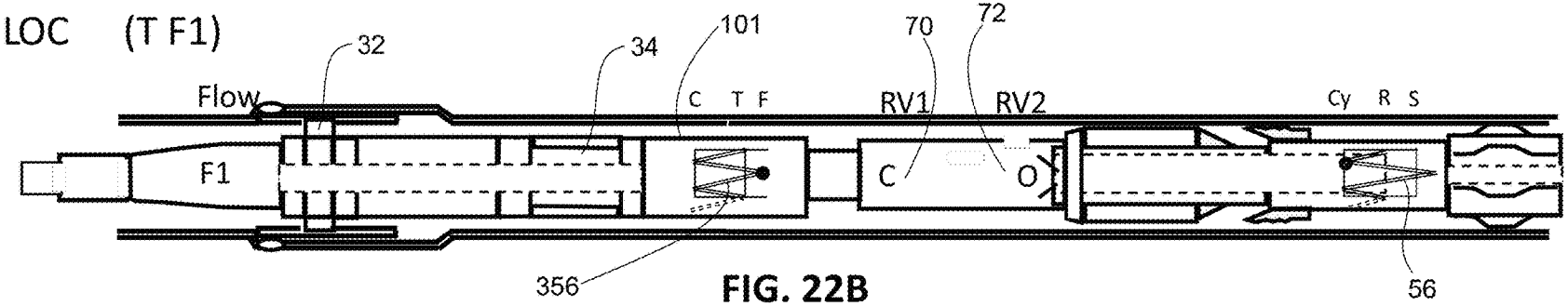

With reference to FIG. 22B, the BHA 8 is shown having been actuated to the LOC mode by increasing tubing flow and pressure PTP to cycle the flow control valve 101 from the C mode to the F mode, blocking fluid flow therethrough and/or the string manipulation closure of the flow blocking valve 70. With no significant exit path to the annulus 2, pressure in the tubing PTP builds and the shifting dogs 36 are actuated. The uphole pull on the tubing string 6 also cycles the treatment tool 50 to the POOH mode. The shifting dogs 36 are shown having engaged with the sleeve profile 18. The tubing flow rate is shown as being at a first flow rate F1, which is sufficient to actuate the shifting dogs 36 but, in this embodiment, not sufficient to actuate the shifting packers 44.

Figure 22C:
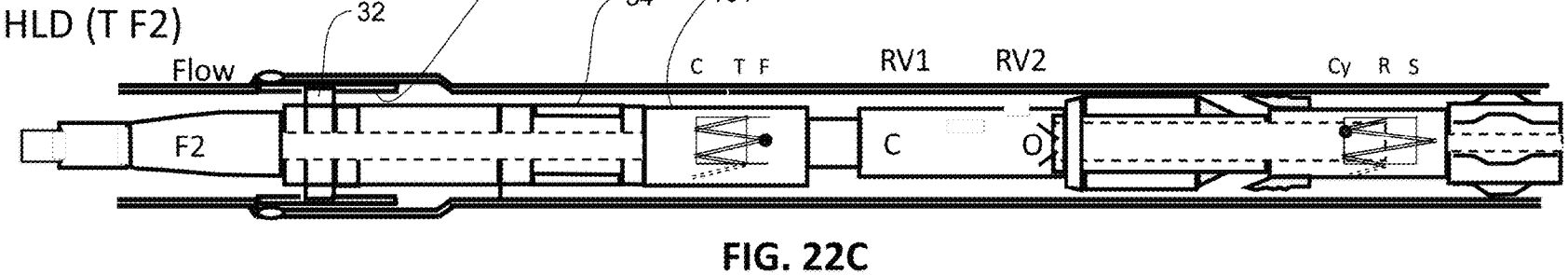

Turning to FIG. 22C, the BHA 8 is actuated to the dog hold or locking mode (LOCK) by increasing the tubing flow rate to a second, higher flow rate F2, with the shifting tool dogs 36 secured engaged with the sleeve and the shifting packer 44 now actuated. The treatment tool 50 remains in POOH mode.

Figure 22D:
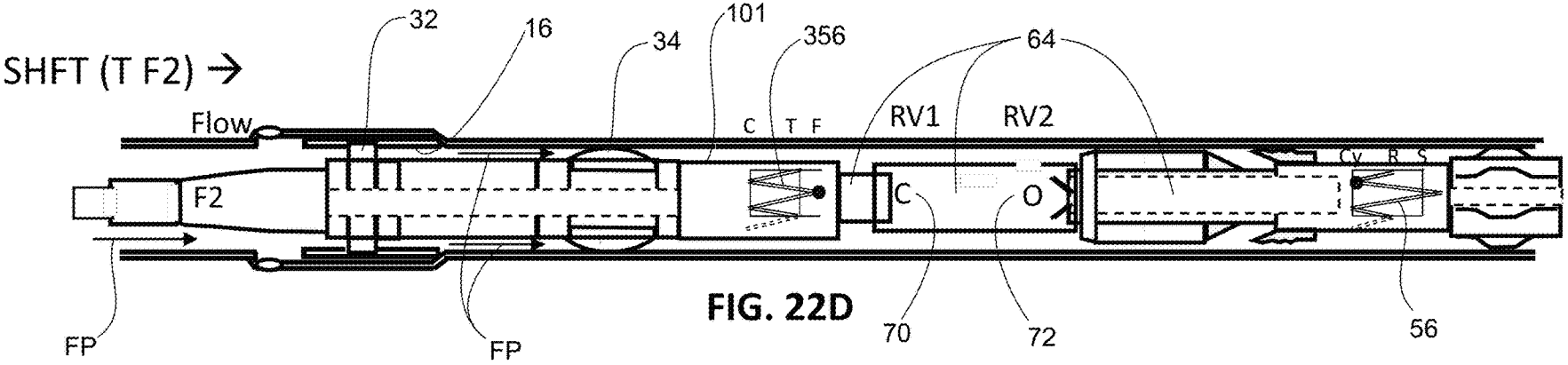

With reference to FIG. 22D, the BHA 8 is operated in shifting mode SHFT. The BHA is lowered and the annular pumps are operated to produce annular fluid flow FP. One or both of the tubing weight and fluid force on the packer 34 drives the BHA downhole the short distance needed to open the sleeve 16/As the valve assembly 69 and isolation mandrel has not fully collapsed, the treatment tool 50 remains in POOH mode.

Figure 22E:
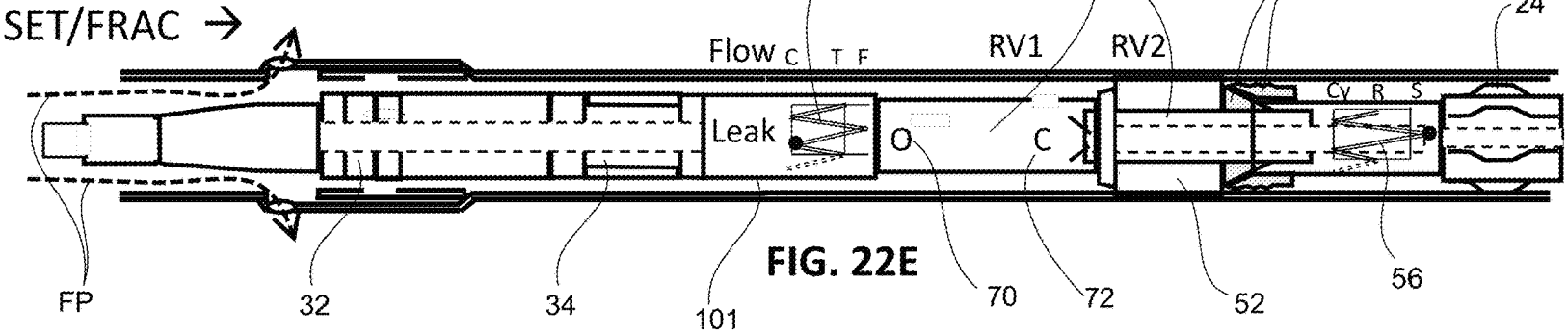

With reference to FIG. 22E, the BHA 8 is actuated to the SET and treatment mode. The shifting dogs 32/36 and shifting packer 36 are released by stopping TP fluid flow and the pressure drops. The tubing string pressure PTP drops below the threshold level to cycle the flow control valve 101 back to the open circulate mode C. The BHA 8 is moved downhole below the sleeve valve 10 to locate the uphole wear tubing 26 at the opened ports 14. the treatment tool 50 is manipulated to the SET mode with the treatment packer 54 engaging the casing. The BHA movement below the opened ports 14 can be through the telescopic action of the valve assembly 69 or, using a slack sub, or dual J-mechanism as described above. The annular pumps FP deliver treatment fluid down the annular for delivery to the formation through the opened ports.

An Embodiment of a Shifting Tool

With reference to FIGS. 24 through 32C, in an alternative embodiment of the shifting tool 30, the sleeve-engaging mechanism or dog packer 32 can comprise a shifting mandrel 40 located within a shifting housing 41, forming a shifting annulus 43 therebetween. Located about the shifting mandrel 41 from the uphole end of the shifting tool are: an uphole stop 135, a sleeve-engaging mechanism 34, a tubular dog collet 188 having a dog packer 32 in the annulus 43 therebeneath, a first tubular dog piston 80, an actuating chamber 85, a second tubular shifting packer piston 90, a shifting packer 44 and a downhole stop 137. The pistons 80,90 are axially and sealably movable in the shifting annulus between the mandrel and housing 40. The actuating chamber receives fluid pressure PTP from the bore 42 of the shifting mandrel, communicated through ports 86 between pistons 80,90. The tubing pressure PTP in chamber 85 actuates the dog and packer pistons 80,90 to move forcibly uphole and downhole respectively. The dog piston is actuable uphole to compress the dog packer and the packer piston is movable downhole to actuate the shifting packer. The dog packer is axially compressible for radial expansion into the dog collect for expanding the shifting dogs into engagement with the casing or sliding sleeve.

Figure 30A:
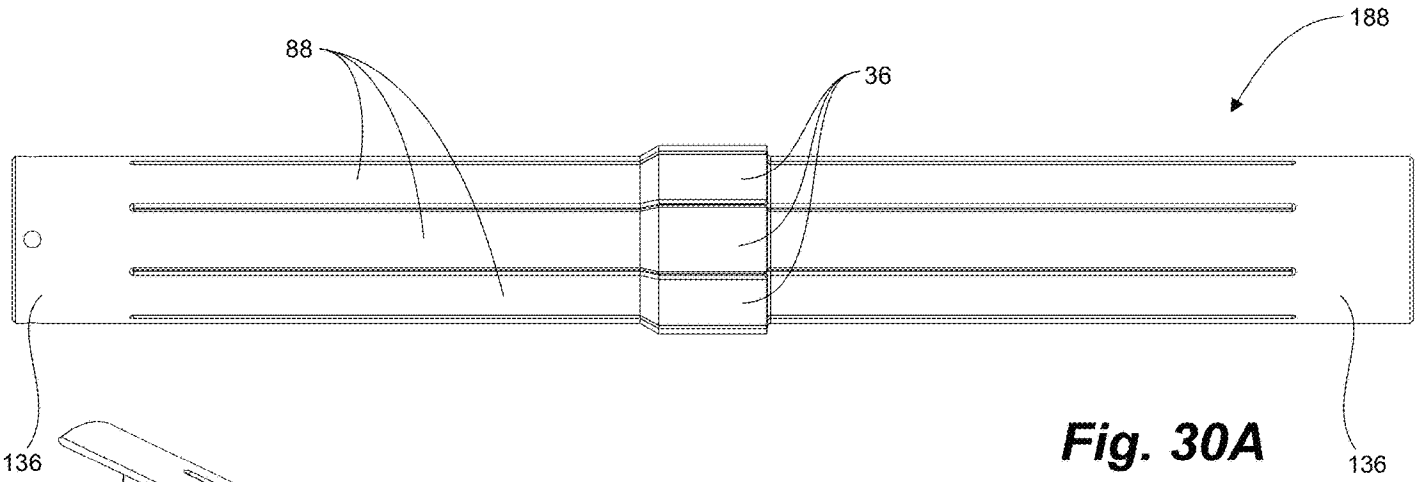
FIGS. 30A and 30B are side and perspective cross sectional views respectively of the dog beam illustrating the circumferentially discrete beams and continuous end caps.
Figure 30B:
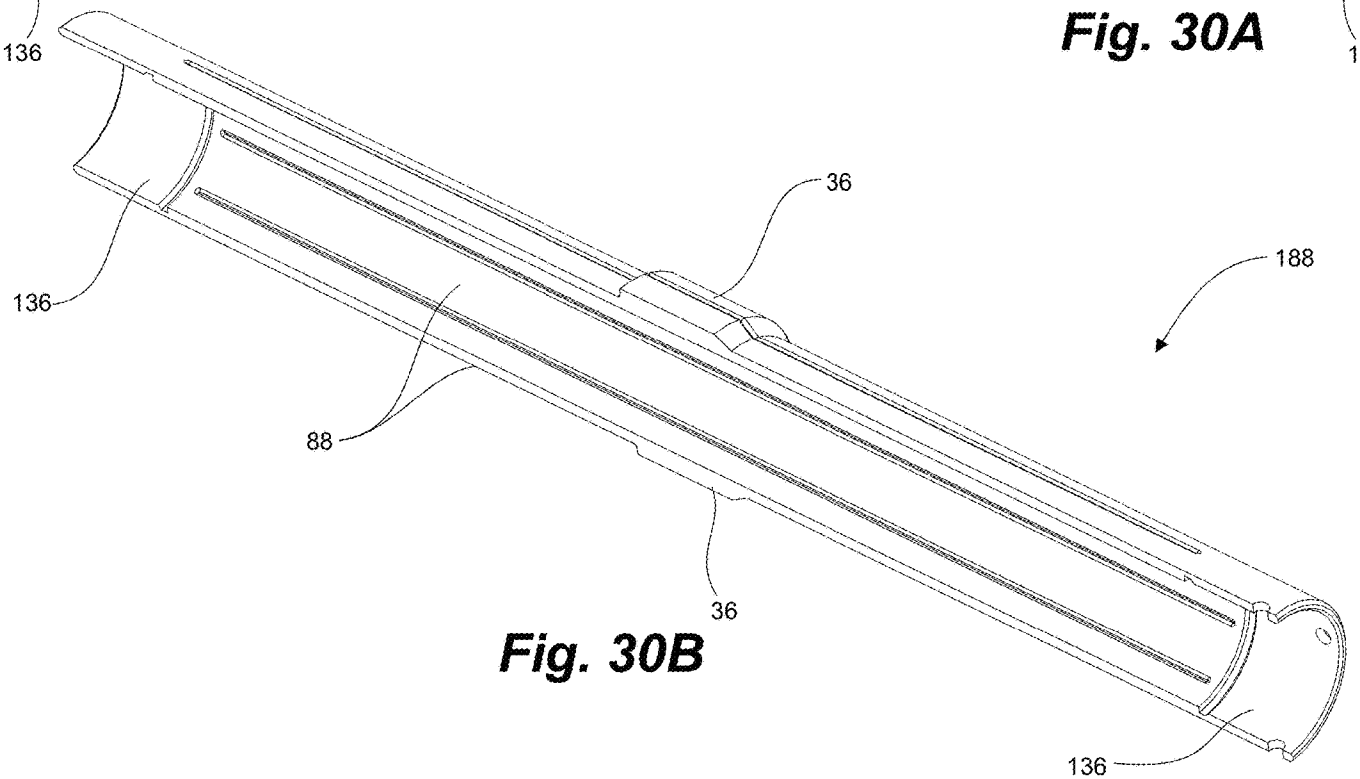

As shown in FIGS. 30A and 30B, each shifting dog 36 is located on its respective beam 88 of multiple beams spaced circumferentially about the tubular beam collet 188. In this embodiment the dogs 36 are located intermediate along their respective beams 88 and extend radially outwardly therefrom. The beams are fixed at opposing ends to bookend collars 136 and are independently flexible therebetween. The tubular dog collet 188 is sandwiched axially between the uphole stop 135 and the housing 41. The beams have a neutral position which is cylindrical such that the shifting dogs 36 are in a radially-retracted position when the shifting tool 30 is at rest. When the collet is radially expanded from about its midpoint, the effective diameter of the shifting dogs increases. The radial displacement of the beams remains in the elastic range and, when the load is removed, the dog beams return to their neutral position.

The dog packer 32 is positioned radially inwardly of the dog beams 88, and axially between the shifting piston 80 and and an axial spacing stop 471*n* this embodiment, the spacing stop 47 locates the dog packer intermediate along along the dog beams 88 at the shifting dogs. Tubing pressure PTP drives the dog piston 46 toward the dog packer 82, thereby compressing against the spacing stop 47 and radially expanding the dog packer 82 into the beams 88, which in turn urges the shifting dogs 36 and beams 88 radially outwards, such as for engaging the casing or a shifting sleeve 16. Biasing spring 84 is provided, acting in the shifting annulus, between the housing 41 and the piston 80, to return the dog piston to a neutral position once the tubing pressure subsides.

With reference to FIG. 25, a BHA with the shifting tool's dogs 36 and dog piston 80 arranged in the bore of a sleeve valve 10. The dogs 36 are aligned with the profile 18 of the sleeve 16. The dog piston 82 is in a disengaged position and the dogs are in the RIH mode. An embodiment of the spring 84 is shown in FIG. 25 as a wave spring for increased spring force over a shorter axial length.

Turning to FIG. 27A, the dog packer 32 and the shifting packer 44 are illustrated in the disengaged position in the RIH or POOH mode. As the dog Packer is disengaged, the shifting dogs 36 are correspondingly disengaged With reference to FIG. 27B, with only the dog packer 32 and shifting dogs 36 featured, the piston 82 has compressed the dog packer 32, displacing the the center of the dog beams 88 for radially displacing the shifting doges outwardly. The relative movement of the piston and interaction with the dog packer and shifting packer is better illustrated as follows.

Turning to FIGS. 28A through 29B, the pressure actuated pistons 80,90 are actuated to illustrate the corresponding response in the dog packer 32, shifting dogs 36 and sleeve-shifting packer 44. The dog collet 188 and individual dog beams 88 are omitted for better illustrating the actuating mechanisms.

Figure 28A:
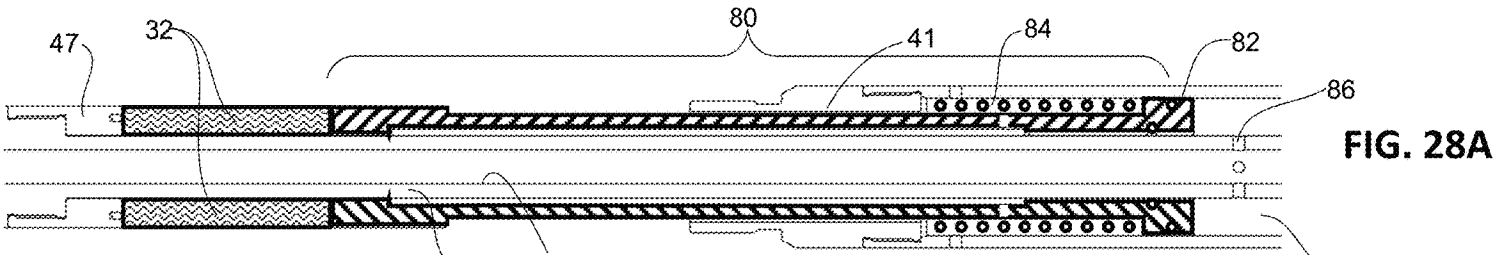
FIGS. 28A and 28B are cross-sectional views of the actuating pistons and respective dog elastomer and shifting packer elastomers of FIG. 26 in a released state, the dog beam removed for clarity, the relative and respective acting piston diameters identified thereon.
Figure 29A:
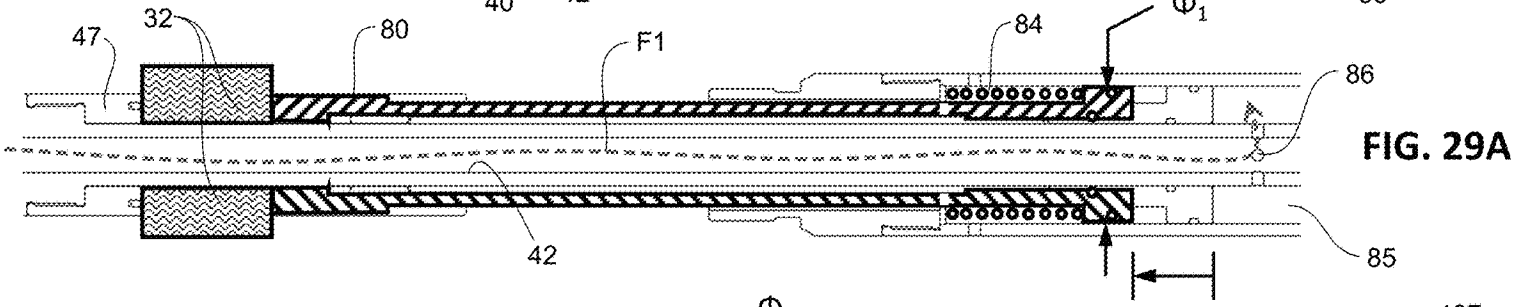
FIGS. 29A and 29B are cross-sectional views of the actuating pistons and respective dog elastomer and shifting packer elastomers of FIGS. 28A an 28B respectively in the actuated, axially compressed states

Turing to the corresponding drawings of FIGS. 28A and 29A, actuation of the shifting dogs 36 is illustrated from the low pressure, disengaged position in FIG. 28A, to the actuated, sleeve-engaged position in FIG. 29A. In FIG. 28A, the mandrel 41 is shown downhole from the spaced stop 47 to about the pressure chamber 86. Piston 80 and return spring 84 are shown in the returned, relaxed position and the dog packer 32, sandwiched axially between the uphole spaced stop 47 and the piston 80, is uncompressed. Fluid force applied to the piston 80 is a function of fluid pressure PTP and affected piston area. The area of the dog piston 80 is illustrated by the net annular area defined by seals at 82, sealing to the housing 41 and the mandrel 40, and the force varies with the tubing pressure according to the flow rates F1 and F2. Another factor is the actuation of the dog packer 32, and the shifting packer 44 for that matter, is the hardness of the packer's material. In FIG. 29A, the piston 80 is displaced uphole by the fluid flow F1 and resulting pressure PTP at pressure chamber 85 for axially compressing the dog packer 32, causing it to expand radially. As discussed in previous embodiments the shifting tool 30 is engineered, when actuated at flow rate F1, to only actuate the shifting dogs 36 and not the shifting packer 44. The piston force and packer material correspond and react based on the available actuating pressure at chamber 85. While the shifting packer piston 90 does react to the PTP at flow rate F1, the radial displacement is insufficient to engage the casing and thus avoids significant wear or swabbing using BHA movement.

Figure 28B:
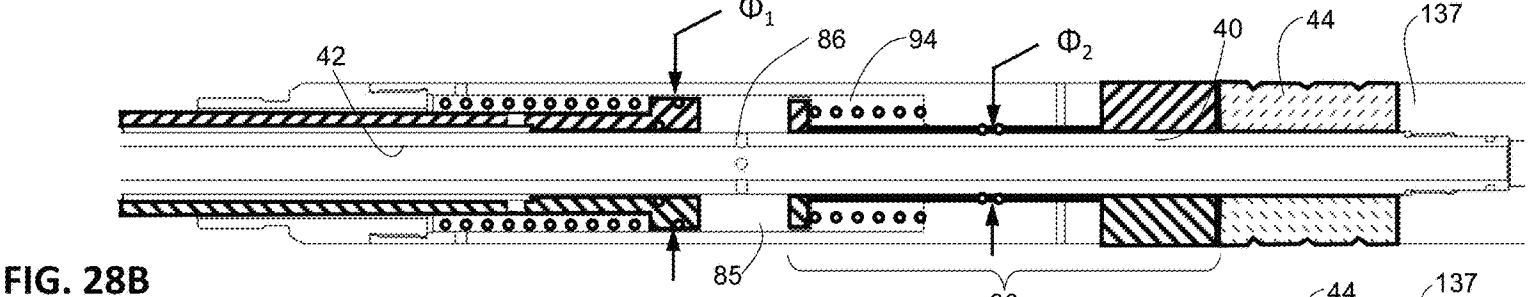
Figure 29B:
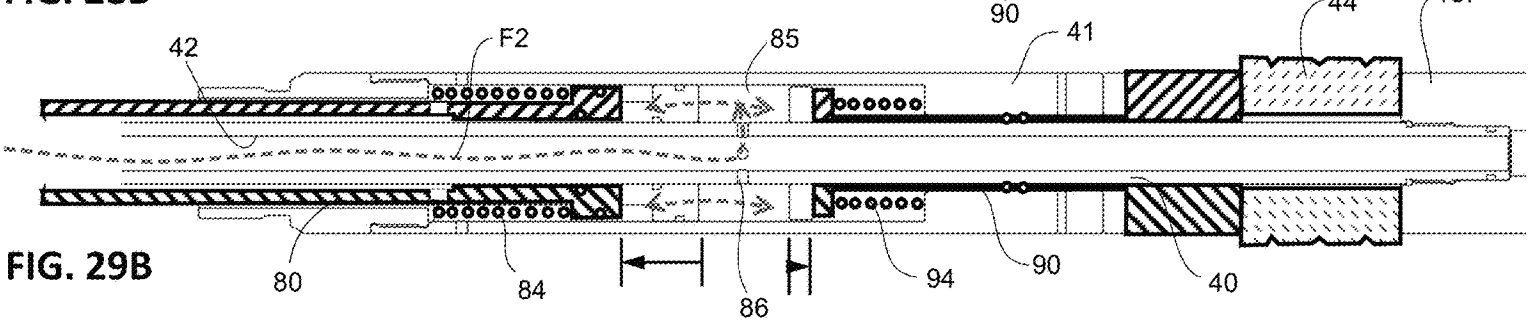

Turing to the corresponding drawings of FIGS. 28B and 29B, actuation of the shifting packer 44 is illustrated from the low pressure, disengaged position in FIG. 28B, to the actuated, casing-engaged position in FIG. 29B. In FIG. 28B, the mandrel 40 is shown from about the pressure chamber 86 and downhole to about the downhole stop 137. Packer piston 90 and return spring 94 are shown in the returned, relaxed position and the shifting packer 44, sandwiched axially between the piston 90 and the downhole stop 137, is uncompressed. Fluid force applied to the piston 90 is a function of fluid pressure PTP and affected piston area. The area of the packer piston 90 is illustrated by the net annular area defined by seals at 92, sealing to the housing 41 and the mandrel 40. In FIG. 29A, the piston 90 is displaced downhole by the fluid pressure PTP at pressure chamber 85 and, at the higher flow rate F2, produces sufficient force to axially compress the shifting packer 44, causing it to expand radially sufficiently to engage the casing for creating an annular, hydraulic piston condition. Sufficient actuation includes providing an effective fluid seal about the annulus 2 convert annular pressure on the shifting packer, to downhole motive force to assist the BHA movement.

Figure 24:
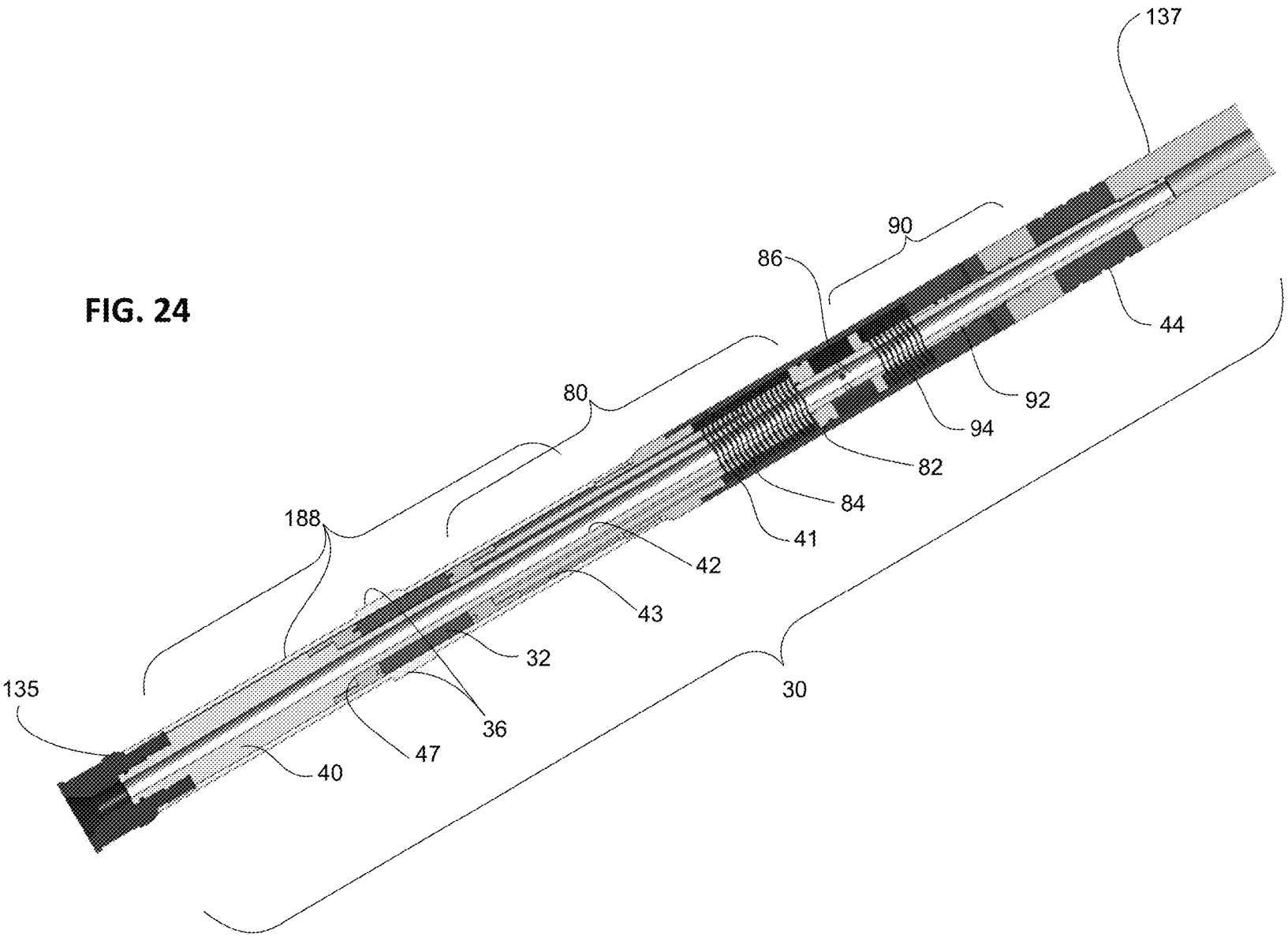
FIG. 24 is a cross-sectional view of an embodiment of a shifting tool having a beam-type shifting dog for expansive actuation using an axially compressible elastomer and an axially compressive shifting packer, both of which being axially actuated using hydraulic pistons.
Figure 31A:
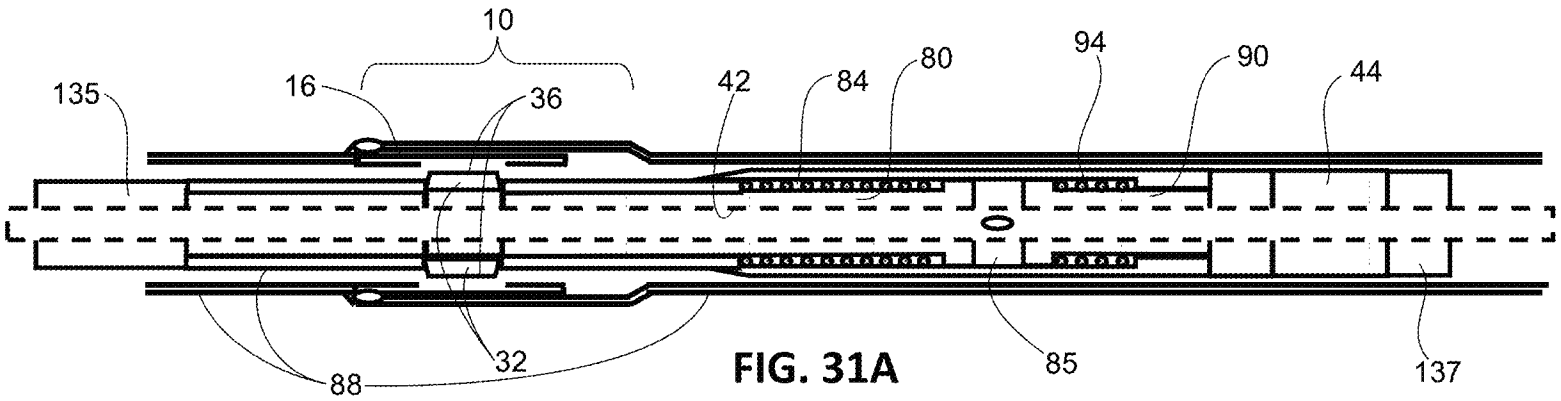
FIGS. 31A and 31B are schematic cross-sectional views of the shifting tool of FIGS. 29A, 29B, 30A and 30B aligned with the profile of a sliding sleeve, and illustrating the released and actuated, axially compressed states respectively.
Figure 31B:
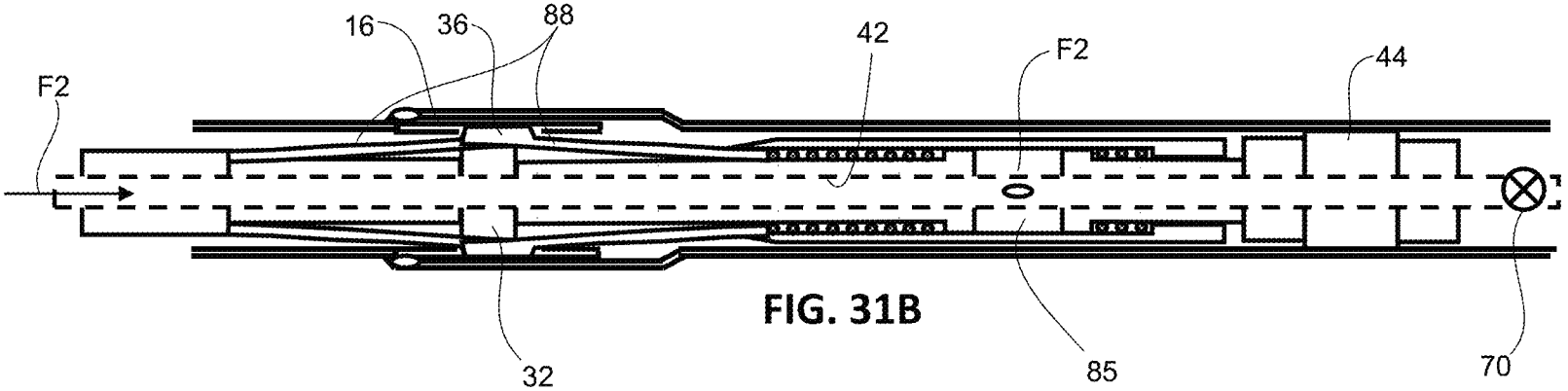

In schematic format shown in FIGS. 31A and 31B, and illustrating the entirely of the shifting tool 30 of FIG. 24 with the shifting dogs 36 positioned in a sleeve valve 10, and the shifting packer 44. Actuation of the shifting dogs 36 is illustrated from the low pressure, disengaged position in FIG. 31A, to the actuated, sleeve-engaged position in FIG. 31B.

Figure 32B:
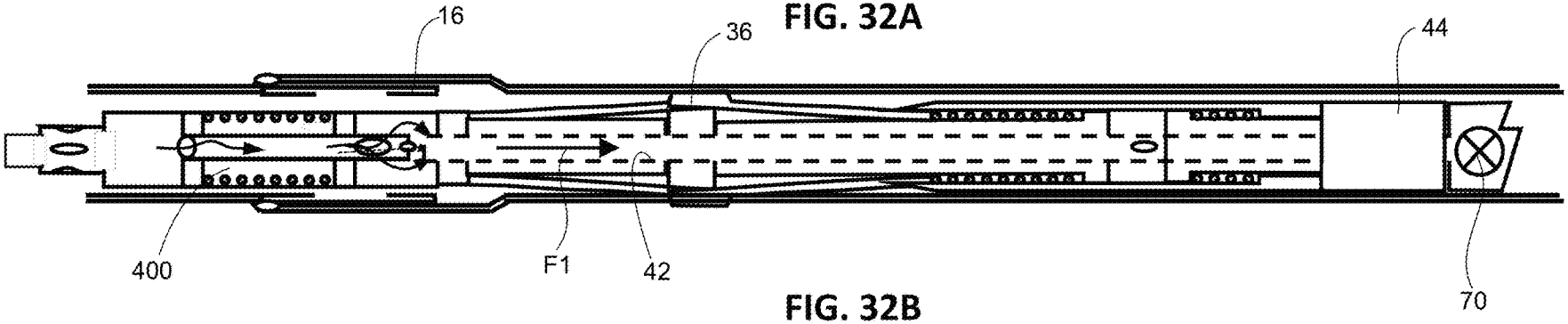

In FIG. 32A, another embodiment of a flow control valve 400 is illustrated. Similar to the flow control valve 100 of FIGS. 18A to 18C, the mandrel is actuable from an open, low pressure C mode shown in FIG. 32A and a high pressure, flowthrough mode shown in FIG. 32A. In the flowthrough mode, actuating flow F1 through mandrel of valve 400 is directed entirely downhole into the shifting tool 30 for pressure-actuation of shifting tool dogs 36 and packer 44. In FIG. 32A, when the selector valve 70 downhole of the shifting tool 30 is open, and flow control valve 400 uphole of the shifting tool 30 is in the open C mode, tubing flow simply passes through the shifting tool bore 42 and the differential between tubing pressure PTP and annular pressure PANN is insufficient to actuate either component of the shifting tool 30. Turning to FIG. 32B, when the flow control valve 400 is actuated to the high flow F mode via an increase in tubing flow above the first threshold flow rate, and the selector valve 70 is closed and tubing pressure PTP can be increased sufficiently to actuate at least shifting dogs 36. As shown, a first tubing flow rate F1 is used, which is sufficient to actuate the dog packer 32 and radially extend the shifting dogs 36, but not sufficient to actuate during the shifting packer piston 90 and radially expand the shifting packer 44. As discussed above, the packer piston is either dimensionally configured, has a spring rate that requires a higher pressure to actuate, or the packer materials is harder to compress than that of the dog piston 80.

Figure 32C:
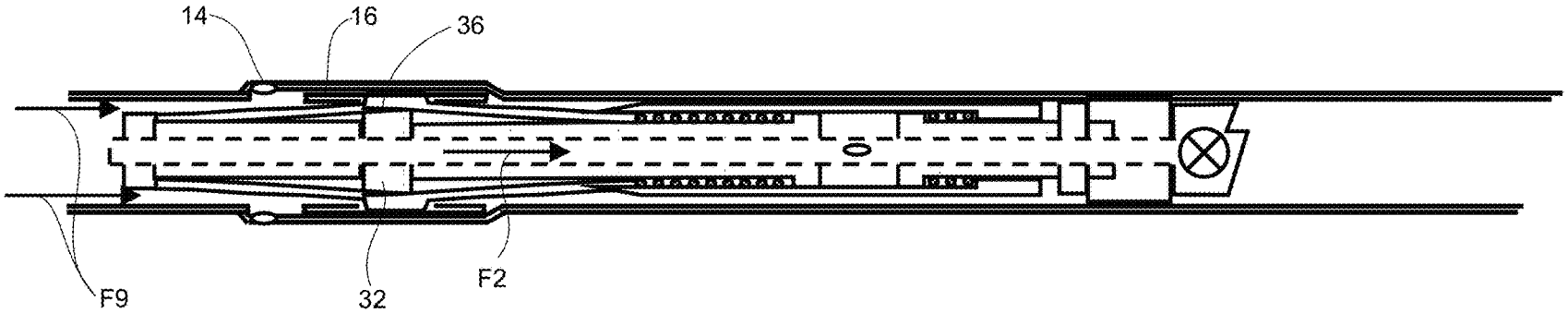
FIG. 32C illustrates the shifting tool of FIG. 32B having been fully actuated with sufficient tubing flow to actuate the shifting packer and then used to shift the tool to the open position.

Turning to FIG. 32C, the flow rate can be increased to the second, higher tubing flow rate F2 to actuate the shifting packer piston 90 and radially expand the shifting packer 44. The increased force on the shifting dogs 36 locks the dogs 36 securing in engagement with a sleeve profile 18 before shifting.

Dog Beam Expansion Test

In a confirmation of the elastometric actuation of the shifting dogs 36, a hydraulic press was employed to replicate the hydraulic piston action of FIG. 28A to 29B. A sliding sleeve 16 was provided having an inner diameter (ID) 4" and an annular profile ID of 4.4" for a profile radial depth of 0.2". The unactuated outer diameter (OD) of the shifting dogs 36 was 3.5" for a running clearance of 0.5" to the bore. The dog beams were circumferentially equi-spaced, beams with 0.25" slots therebetween, each beam being about 21.5" long and the 0.2" upstanding dogs 36 centered each beam being 2" long with a bevel transition of 0.35". The dog beams have OD and ID of 3.1" and 2.64" respectively for a beam height of 0.46". The dog beams were underlaid with an elastomeric tubular cylinder, as an actuating element, 4.5" long having an OD and ID of 2.63 and 1.3" respectively, supported about a ⅓" diameter mandrel.

For the test sleeve 16 and shifting dog 36, the required diametral expansion was 0.9" for the dog's OD to radially engage the profile ID. Elastomers were tested having differing compositions and durometers. Actuating elements of NBR and polyurethane were tested. NBR is a rubber elastomer based on acrylonitrile-butadiene rubber. Both elements having a high resistance to mineral oils and lubricants and the higher temperatures of the downhole environment. The NBR had a Shore durometer hardness of 85 A and the polyurethane had a Shore durometer hardness of 95 A. Setting loads to axially compress and radially expand the elements and surrounding dog beams were nominally 8400 and 11,500 lbf respectively. The axial length of the element was compressed about ½ its length. The radial expansion of the elements to drive the dog beams into the 4.4" ID profiles was reversable, with a relaxation of the dog beam OD back to 3.5". The NBR element had less hysteresis of with relaxed OD at the dog beams of +/−0.010" and the polyurethane of about +/−0.015".

A variety of additional polyurethane elements were reviewed at varying hardnesses and were deemed suboptimal. Note that intending feet for Shore hardness A is blunted and D is pointed. Elements having Shore hardness of 85 A was deemed too soft to machine properly, 90A had acceptable expansion but exhibited excessive axial extrusion and extrusion between the beams. Harder elements having Shore hardness of 60D required excessive setting loads and at 65D would no expand within considered design loading.

An Alternate Dog Beam Actuation Embodiment

Figure 33:
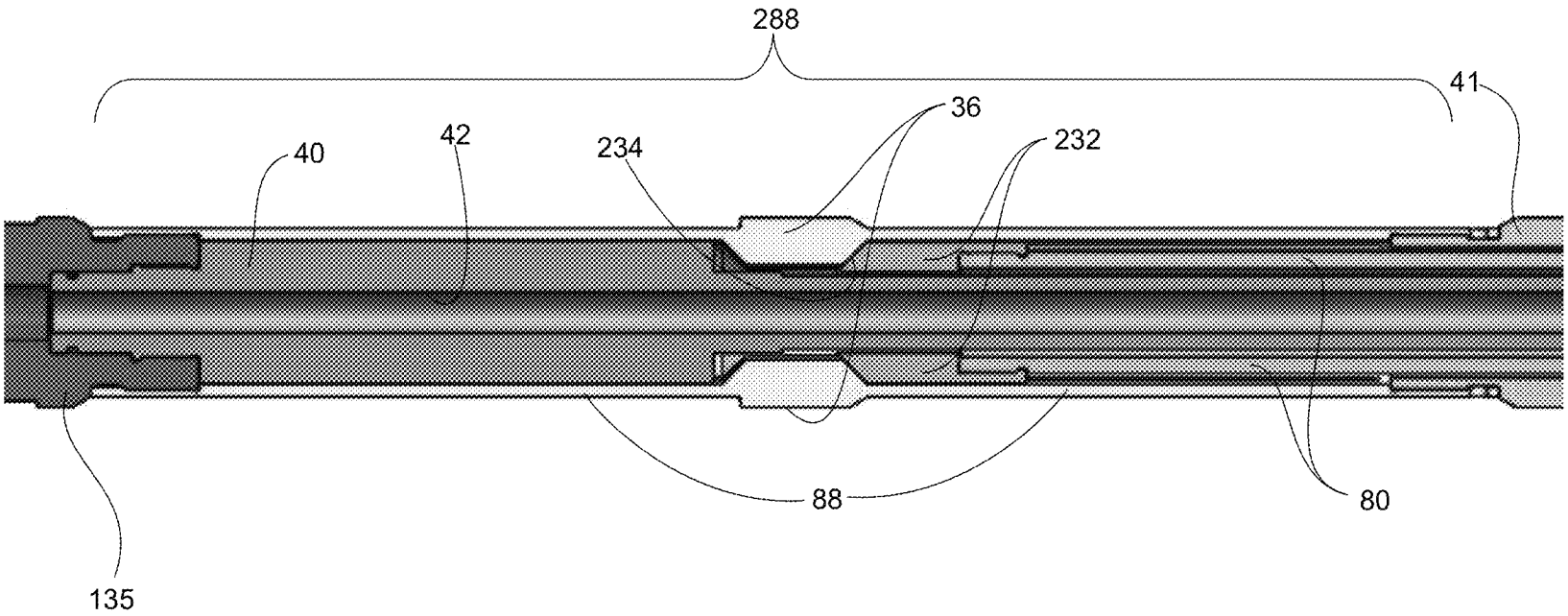
FIG. 33 is a side cross-sectional view of an alternate embodiment of the dog beam and actuation with cooperating ramps replacing the earlier elastomeric expansive actuator.

With reference to FIG. 33, in an alternative embodiment of the sleeve-engaging mechanism 32, the shifting dogs 36 can be located on a dog collet 288 that is configured to be urged radially outwardly by cooperating piston and dog beam ramps 232,234 located on the axially actuable dog piston 80 and beams 88 respectively. The piston ramp 234 is located radially inwardly of the dog beam ramp 234. Similar to the embodiments shown in FIGS. 24 through 32C, the shifting piston 36 of the embodiment of FIG. 33 is located in a shifting annulus 43 formed between the shifting mandrel 40 and shifting housing 41 The uphole piston ramp 232 of the piston 80 is configured to be driven axially toward the beam ramps 234 in response to an increase in tubing pressure PTP, driving the middle of each beam 88 radially outwardly and the respective shifting dogs 36 towards a sleeve. When the tubing pressure is reduced, the piston 80 and piston ramp 232 retract axially, as before, permitting the beams 88 to elastically retract radially inwardly.

We claim:

1. A bottomhole assembly (BHA) conveyed on a tubing string and forming an annulus between the BHA and a wellbore, the BHA for actuating a sliding sleeve of a sleeve valve of interest of one or more sleeve valves located along the wellbore, comprising:

a hydraulically actuated shifting tool having a shifting tool bore in fluid communication with the tubing string and having an axial sleeve-shifting assist mechanism and a sliding sleeve-engaging mechanism, the sleeve-shifting assist mechanism and sliding sleeve-engaging mechanism both in fluid communication with the shifting tool bore; and a treatment tool connected to the shifting tool and downhole thereof, the treatment tool having a resettable isolation packer actuated by manipulation of the tubing string, a treatment tool bore, a mode cycling mechanism, and a drag block, wherein the resettable isolation packer of the treatment tool is positioned downhole of the shifting tool, wherein the shifting assist mechanism comprises an inflatable shifting packer configured to be radially expanded by pressure in the shifting tool bore.

2. The bottomhole assembly of claim 1, further comprising a valve assembly located between the shifting tool and treatment tool, and selectably actuable between a first valve mode wherein the shifting tool bore is isolated from the annulus and the treatment tool bore is exposed to pressure uphole thereof, and a second valve mode wherein the shifting tool bore is in communication with the annulus and the treatment tool bore is isolated from pressure uphole thereof.

3. The bottomhole assembly of claim 2, wherein:

the valve assembly comprises inner ports and outer ports formed in a telescoping shifting mandrel of the shifting tool and a bypass plug located at a downhole end of the shifting mandrel;

in the first valve mode, the inner ports and outer ports are misaligned and the bypass plug is clear of the treatment tool bore; and in the second valve more, the inner ports and outer ports are aligned and the bypass plug blocks the treatment tool bore to isolate the treatment tool bore from pressure uphole thereof.

4. The bottomhole assembly of claim 2, further comprising a flow control valve located uphole of the shifting tool and having a generally tubular valve housing having a housing bore extending therethrough;

a generally tubular valve mandrel axially actuable within the housing bore and having a valve mandrel bore extending therethrough;

a shifting cycling mechanism delimiting an uphole position, an intermediate position, and a downhole position of the valve mandrel;

a mandrel spring located between the valve housing and valve mandrel and configured to bias the valve mandrel to the uphole position;

wherein in the uphole position and the intermediate position, the flow control valve permits fluid to flow from the tubing string into the annulus and the shifting tool bore;

wherein in the downhole position, the flow control valve substantially prevents fluid from flowing from the tubing string into the annulus and permits fluid to flow from the tubing string into the shifting tool bore.

5. The bottomhole assembly of claim 2, further comprising a flow control valve located between the shifting tool and treatment tool and having a generally tubular valve housing having a housing bore extending therethrough;

a generally tubular valve mandrel axially actuable within the housing bore and having a valve mandrel bore extending therethrough;

a shifting cycling mechanism delimiting an uphole position, an intermediate position, and a downhole position of the valve mandrel;

a mandrel spring located between the valve housing and valve mandrel and configured to bias the valve mandrel to the uphole position;

wherein in the uphole position and the intermediate position, the flow control valve permits fluid to flow from the shifting tool bore into the annulus and the treatment tool bore;

wherein in the downhole position, the flow control valve substantially prevents fluid from flowing from the shifting tool bore into the annulus and the treatment tool bore.

6. The bottomhole assembly of claim 1, wherein the cycling mechanism delimits at least:

a run-in-hole (RIH) mode, wherein the isolation packer is deactivated;

a pull-out-of-hole/pull-to-locate (POOH/PTL) mode, wherein the isolation packer is deactivated; and a set/frac mode (SET/FRAC), wherein the isolation packer is activated.

7. The bottomhole assembly of claim 6, further comprising a telescopic connection between shifting tool and the treatment tool and configured to permit the shifting tool to be actuated toward the treatment tool without actuating the mode cycling mechanism.

8. The bottomhole assembly of claim 1, further comprising a slack sub telescopically connecting the shifting tool and the treatment tool and biasing the shifting tool toward the treatment tool.

9. The bottomhole assembly of claim 1, wherein the shifting assist mechanism comprises a shifting packer located between an axial stop and a shifting packer piston, and a shifting packer spring biasing the shifting packer piston away from the shifting packer, the shifting packer piston configured to be axially urged toward the shifting packer in response to pressure in the shifting tool bore to radially expand the shifting packer.

10. The bottomhole assembly of claim 1, wherein the sleeve-engaging mechanism comprises one or more radially inwardly-biased shifting dogs configured to extend radially outwards in response to pressure in the shifting tool bore.

11. The bottomhole assembly of claim 10, wherein the shifting dogs comprise shifting dogs located at a distal end of respective leaf springs connected to the shifting tool at a proximal end, and one or more shifting pistons are configured to urge the shifting dogs radially outwards in response to pressure in the shifting tool bore.

12. The bottomhole assembly of claim 10, wherein the shifting dogs comprise one or more pistons configured to be urged radially outwards in response to pressure in the shifting tool bore, and biased radially inwardly by one or more respective coil springs.

13. The bottomhole assembly of claim 10, wherein:

the shifting dogs are located on radially inwardly biased dog beams;

a dog packer is located radially inwardly of the shifting dogs and between an axial stop and a dog packer piston, a dog packer spring biasing the shifting packer piston away from the shifting packer; and the dog packer piston is configured to be axially urged toward the dog packer in response to pressure in the shifting tool bore to radially expand the dog packer and radially outwardly extend the shifting dogs.

14. A method of actuating a sleeve valve of interest of one or more sleeve valves located along a wellbore, comprising:

running a bottomhole assembly conveyed on a tubing string and forming an annulus between the BHA and the wellbore to a location downhole of the sleeve valve of interest, the BHA having a shifting tool and a treatment tool connected to the shifting tool and downhole thereof, the treatment tool having a resettable isolation packer positioned downhole of the shifting tool;

pressurizing a shifting tool bore of the shifting tool to a first pressure to activate a sleeve-engaging mechanism of the shifting tool;

locating the sleeve valve of interest with the sleeve-engaging mechanism by pulling the bottomhole assembly uphole until the sleeve-engaging mechanism engages with a sleeve profile of the sleeve valve of interest;

actuating the sleeve valve of interest between an open position and a closed position; and reducing pressure in the shifting tool bore to deactivate the sleeve-engaging mechanism, wherein the step of pressurizing the shifting tool bore comprises actuating a valve assembly located between the shifting tool and the treatment tool to a first valve mode wherein the shifting tool bore is isolated from the annulus by pulling uphole on the tubing string.

15. The method of claim 14, wherein the step of actuating the sleeve valve of interest between the open position and the closed position further comprises pressurizing the shifting tool bore to a second pressure higher than the first pressure to at least partially activate a sleeve-shifting assist mechanism of the shifting tool, and introducing fluid into the annulus to apply a downhole force on the shifting-assist mechanism.

16. The method of claim 14, further comprising performing treatment operations through the sleeve valve of interest by:

actuating the valve assembly to a second valve mode wherein the shifting tool bore is in communication with the wellbore and a treatment tool bore of the treatment tool is isolated from pressure uphole thereof;

running the bottomhole assembly downhole to activate the resettable isolation packer of the treatment tool to isolate wellbore pressure downhole thereof; and introducing fluid into the wellbore.

17. The method of claim 16, wherein:

the step of running the bottomhole assembly to a location downhole of the sleeve valve of interest comprises actuating a cycling mechanism of the treatment tool to a run-in-hole (RIH) mode wherein the resettable isolation packer is deactivated; and the step of locating the sleeve valve of interest by pulling the bottomhole assembly uphole further comprises actuating the cycling mechanism to a pull-out-of-hole/pull-to-locate (POOH/PTL) mode wherein the resettable isolation packer is deactivated.

18. The method of claim 17, wherein the step of running the bottomhole assembly downhole to activate the resettable isolation packer further comprises actuating the cycling mechanism to a set/frac mode.

19. The method of claim 14, wherein the step of pressurizing the shifting tool bore further comprises actuating a hydraulically-actuated flow control valve to a downhole position by introducing fluid into the tubing string at a tubing flow rate above a threshold flow rate, wherein in the downhole position the flow control valve directs a substantial portion of the fluid introduced into the tubing string into the shifting tool bore.

20. The method of claim 19, wherein the step of performing treatment operations further comprises reducing the tubing flow rate to below the threshold flow rate to actuate the flow control valve to an uphole position, wherein in the uphole position the flow control valve directs the fluid introduced into the tubing string into the shifting tool bore and the annulus.

21. A bottomhole assembly (BHA) conveyed on a tubing string and forming an annulus between the BHA and a wellbore, the BHA for actuating a sliding sleeve of a sleeve valve of interest of one or more sleeve valves located along the wellbore, comprising:

a hydraulically actuated shifting tool having a shifting tool bore in fluid communication with the tubing string and having an axial sleeve-shifting assist mechanism and a sliding sleeve-engaging mechanism, the sleeve-shifting assist mechanism and sliding sleeve-engaging mechanism both in fluid communication with the shifting tool bore; and a treatment tool connected to the shifting tool and downhole thereof, the treatment tool having a resettable isolation packer actuated by manipulation of the tubing string, a treatment tool bore, a mode cycling mechanism, and a drag block, wherein the resettable isolation packer of the treatment tool is positioned downhole of the shifting tool, wherein the cycling mechanism delimits at least: a run-in-hole (RIH) mode, wherein the isolation packer is deactivated; a pull-out-of-hole/pull-to-locate (POOH/PTL) mode, wherein the isolation packer is deactivated; and a set/frac mode (SET/FRAC), wherein the isolation packer is activated, and wherein the BHA further comprises a telescopic connection between shifting tool and the treatment tool and configured to permit the shifting tool to be actuated toward the treatment tool without actuating the mode cycling mechanism.

22. A method of actuating a sleeve valve of interest of one or more sleeve valves located along a wellbore, comprising:

running a bottomhole assembly conveyed on a tubing string and forming an annulus between the BHA and the wellbore to a location downhole of the sleeve valve of interest, the BHA having a shifting tool and a treatment tool connected to the shifting tool and downhole thereof, the treatment tool having a resettable isolation packer positioned downhole of the shifting tool;

pressurizing a shifting tool bore of the shifting tool to a first pressure to activate a sleeve-engaging mechanism of the shifting tool;

locating the sleeve valve of interest with the sleeve-engaging mechanism by pulling the bottomhole assembly uphole until the sleeve-engaging mechanism engages with a sleeve profile of the sleeve valve of interest;

actuating the sleeve valve of interest between an open position and a closed position; and reducing pressure in the shifting tool bore to deactivate the sleeve-engaging mechanism, wherein the step of actuating the sleeve valve of interest between the open position and the closed position further comprises pressurizing the shifting tool bore to a second pressure higher than the first pressure to at least partially activate a sleeve-shifting assist mechanism of the shifting tool, and introducing fluid into the annulus to apply a downhole force on the shifting-assist mechanism.

* * * * *